US008260175B2

(12) United States Patent
Ichikawa et al.

(10) Patent No.: US 8,260,175 B2
(45) Date of Patent: Sep. 4, 2012

(54) DEVELOPING APPARATUS AND IMAGE FORMING APPARATUS USING SAME

(75) Inventors: Tomoyuki Ichikawa, Kanagawa (JP); Junichi Matsumoto, Kanagawa (JP); Nobuo Iwata, Kanagawa (JP); Natsumi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/253,559

(22) Filed: Oct. 5, 2011

(65) Prior Publication Data

US 2012/0070195 A1 Mar. 22, 2012

Related U.S. Application Data

(60) Continuation of application No. 12/842,058, filed on Jul. 23, 2010, which is a division of application No. 11/622,282, filed on Jan. 11, 2007, now Pat. No. 7,792,472.

(30) Foreign Application Priority Data

Jan. 13, 2006 (JP) ..... 2006-006820
Jan. 27, 2006 (JP) ..... 2006-019678
Apr. 21, 2006 (JP) ..... 2006-118562
Oct. 6, 2006 (JP) ..... 2006-275106

(51) Int. Cl.
*G03G 15/08* (2006.01)

(52) U.S. Cl. ..... 399/253; 399/254

(58) Field of Classification Search ..... 399/120, 399/252, 253, 254

See application file for complete search history.

(56) References Cited

U.S. PATENT DOCUMENTS 5,591,506 A 1/1997 Miller et al.
5,797,074 A 8/1998 Kasahara et al.
6,393,241 B1 5/2002 Matsumoto et al.
6,405,009 B1 6/2002 Shinkawa et al.
6,526,246 B2 2/2003 Iwata et al.
6,542,707 B2 4/2003 Muramatsu et al.
6,567,637 B2 5/2003 Yanagisawa et al.

(Continued)

FOREIGN PATENT DOCUMENTS

JP 4-198966 7/1992

(Continued)

OTHER PUBLICATIONS

Office Action issued Sep. 2, 2011 in Japan Application No. 2006-275106.

(Continued)

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A developing apparatus for an image forming apparatus. In order to suppress toner scattering that may occur after a development operation has been halted for a long time, the developer is transferred to a developer storage unit on the exterior of the developing machine when the development operation ends. A range in which an angle of a restricting member upstream side central angle α, which is a central angle of the surface of a developing roller on the upstream side of a restricting member opposing position opposing a developer amount restricting member in a surface motion direction of the developing roller, is not less than 0° and not more than 60° is set as a low magnetic flux density area γ in which the maximum value of a normal direction magnetic flux density on the surface of the developing roller is not more than 30 mT.

14 Claims, 26 Drawing Sheets

U.S. PATENT DOCUMENTS

| | | | |
|---|---|---|---|
| 6,571,076 | B2 | 5/2003 | Kasahara et al. |
| 6,597,883 | B2 | 7/2003 | Muramatsu et al. |
| 6,628,908 | B2 | 9/2003 | Matsumoto et al. |
| 6,628,913 | B2 | 9/2003 | Matsumoto et al. |
| 6,628,915 | B2 | 9/2003 | Muramatsu et al. |
| 6,785,496 | B2 | 8/2004 | Iwata et al. |
| 6,826,381 | B2 | 11/2004 | Muramatsu et al. |
| 6,882,812 | B2 | 4/2005 | Kasahara et al. |
| 6,882,816 | B2 | 4/2005 | Tamai |
| 6,898,405 | B2 | 5/2005 | Matsumoto et al. |
| 7,043,179 | B2 | 5/2006 | Matsumoto et al. |
| 7,065,313 | B2 | 6/2006 | Matsumoto et al. |
| 7,076,191 | B2 | 7/2006 | Muramatsu et al. |
| 7,085,522 | B2 | 8/2006 | Muramatsu et al. |
| 7,116,928 | B2 | 10/2006 | Muramatsu et al. |
| 7,127,198 | B2 | 10/2006 | Muramatsu et al. |
| 7,130,558 | B2 | 10/2006 | Matsumoto et al. |
| 7,221,891 | B2 | 5/2007 | Matsumoto et al. |
| 7,245,853 | B2 | 7/2007 | Muramatsu et al. |
| 7,277,664 | B2 | 10/2007 | Katsuyama et al. |
| 7,450,891 | B2 | 11/2008 | Muramatsu et al. |
| 7,542,703 | B2 | 6/2009 | Kasahara et al. |
| 2003/0086728 | A1 | 5/2003 | Kikuchi |
| 2007/0274740 | A1 | 11/2007 | Katoh et al. |

FOREIGN PATENT DOCUMENTS

| | | |
|---|---|---|
| JP | 7-20717 | 1/1995 |
| JP | 8-211714 | 8/1996 |
| JP | 8-278695 | 10/1996 |
| JP | 11-143196 | 5/1999 |
| JP | 11-184249 | 7/1999 |
| JP | 11-194617 | 7/1999 |
| JP | 11-249402 | 9/1999 |
| JP | 2002-244440 | 8/2002 |
| JP | 2003-263012 | 9/2003 |
| JP | 11-024407 | 11/2003 |
| JP | 2005-037878 | 2/2005 |
| JP | 2005-91832 | 4/2005 |

OTHER PUBLICATIONS

Japanese Office Action issued Oct. 22, 2010, in Japanese Patent Application No. 2006-006820.

FIG. 20

| | DEVELOPING MACHINE CONSTITUTION | INITIAL STAGE | AFTER 50,000 SHEETS | | |
|---|---|---|---|---|---|
| | | DEVELOPER CHARGE (μC/G) | DEVELOPER CHARGE (μC/G) | TONER SCATTERING | SURFACE STAINING |
| FIRST EXAMPLE | | −31.0 | −29.7 | ○ | ○ |
| SECOND EXAMPLE | | −33.2 | −27.8 | ○ | ○ |
| THIRD EXAMPLE | | −35.4 | −24.4 | △ | ○ |
| THIRD COMPARATIVE EXAMPLE | | −34.1 | −12.1 | × | × |

DEVELOPING APPARATUS AND IMAGE FORMING APPARATUS USING SAME

CROSS REFERENCE TO RELATED CASES

This application is a continuation of U.S. application Ser. No. 12/842,058 filed Jul. 23, 2010, which is a divisional of U.S. application Ser. No. 11/622,282 filed on Jan. 11, 2007 now U.S. Pat. No. 7,792,472, both of which are herein incorporated by reference. Further, application Ser. No. 11/622,282 claims priority to Japanese Patent Application No. 2006-019678, filed Jan. 27, 2006, Japanese Patent Application No. 2006-275106, filed Oct. 6, 2006, Japanese Patent Application No. 2006-006820, filed Jan. 13, 2006, and Japanese Patent Application No. 2006-118562, filed Apr. 21, 2006.

BACKGROUND OF THE INVENTION

1. Field of the Invention

The present invention relates to a developing apparatus using a two-component developer constituted by a toner and a carrier, and an image forming apparatus such as a copier, facsimile, or printer, which uses the developing apparatus.

2. Description of the Background Art

A conventional developing apparatus uses a developing method in which a developer is conveyed by a developer carrier, a voltage is applied between an image carrier carrying an electrostatic latent image and the developer carrier, and toner is moved onto the electrostatic latent image to reveal the electrostatic latent image. An example of this developing method is a magnetic brush developing method using a two-component developer. In this developing method, a two-component developer constituted by a non-magnetic toner and a magnetic carrier is used, and a magnetic brush is formed by the magnetic carrier on the surface of a developing sleeve serving as a developer carrier having magnets disposed in its interior. The magnetic brush is then rubbed against or brought close to a photosensitive body, i.e. a latent image carrier opposing the developing sleeve with a narrow developing gap (doctor gap) therebetween. Here, development is performed by applying a development voltage between the developing sleeve and the photosensitive body such that toner particles carried on the magnetic carrier forming the magnetic brush on the developing sleeve are adhered to the latent image on the photosensitive body.

In this development operation, the toner is gradually consumed, and therefore the developing apparatus must be replenished with new toner. The replenishment toner is mixed with the magnetic carrier while being conveyed together with the magnetic carrier, and through this mixing operation, a charge is applied to the replenishment toner. If mixing is not performed sufficiently up to the point at which the replenishment toner is supplied to the developing sleeve, charge-deficient toner that has not been charged sufficiently is used for development. When charge-deficient toner is used for development, the charge-deficient toner contained in the developer carried on the developing sleeve scatters, leading to toner scattering. The reason for this is that the charge-deficient toner that has not been sufficiently charged has poor adsorbability relative to the magnetic carrier, and therefore separates from the magnetic carrier and scatters easily. Charge-deficient toner in the developing apparatus that is not carried on the developing sleeve also separates from the magnetic carrier easily. As a result, the charge-deficient toner may fly up inside the developing apparatus and leak out through gaps in the developing apparatus on the periphery of the developing sleeve. In this case also, toner scattering occurs.

When toner scattering occurs, the interior of the apparatus is contaminated as toner adheres to other members on the periphery of the developing apparatus. Toner scattering also occurs when toner other than the replenishment toner is charge-deficient, and this toner scattering also contaminates the interior of the apparatus.

For example, Japanese Patent Publication No. 3,391,926 (Prior Art 1) describes a developing apparatus comprising a developing unit having a developer carrier and a developer supply unit for supplying a two-component developer to the developer carrier, and a stirring unit for stirring the two-component developer and circulating the two-component developer to and from the developing unit. The two-component developer is stirred and conveyed to the developing unit by the stirring unit, and therefore the opportunities for stirring increase such that the occurrence of charge-deficient toner and toner scattering can be suppressed. Note that in the developing apparatus of Prior Art 1, toner replenishment corresponding to toner consumption during the development operation is performed in the stirring unit.

However, in the developing apparatus of Prior Art 1, the two-component developer circulates between the developing unit and stirring unit constantly such that when the development operation ends and the developing apparatus is halted, the two-component developer is present in both the developing unit and stirring unit. When the developing apparatus is halted, the charge of the toner contained in the two-component developer gradually decreases. Accordingly, when the developing apparatus is left in a halted state for a long time, the toner contained in the developer turns into uncharged toner having substantially no charge. Similarly to charge-deficient toner, uncharged toner separates from the magnetic carrier easily, and therefore, when the development operation is resumed with uncharged toner present in the developing unit, toner scattering occurs in a similar manner to the charge-deficient toner described above, contaminating the interior of the apparatus. Furthermore, when uncharged toner exists in the developing unit, the developer is carried on the developer carrier by rotating the developer carrier, even if the development operation is not resumed, and as a result, the uncharged toner separates from the developer and scatters. Even when the developer is not carried to the developer carrier, the uncharged toner in the developing apparatus flies up when the developer containing the uncharged toner is conveyed or the developing apparatus receives an external impact, and as a result, the uncharged toner leaks out through gaps in the developing apparatus and scatters. The description provided here deals with toner scattering occurring due to the presence of uncharged toner in the developing unit, but toner scattering may also occur when charge-deficient toner having an insufficient charge, rather than uncharged toner, is present in the developing unit.

Further, in the developing apparatus of Prior Art 1, the two-component developer circulates between the developing unit and stirring unit constantly, and when the stirring unit is replenished with a large amount of toner following an operation to form an image having a high image density or the like, the two-component developer continues to be conveyed from the stirring unit to the developing unit. When a large amount of replenishment toner is provided, the proportion of uncharged toner in the two-component developer increases, and therefore a greater amount of time is required to stir the toner to the desired charge than when the amount of replenishment toner is comparatively small following the formation of an image having a low image area ratio. When a large amount of replenishment toner is provided and the two-component developer continues to be conveyed from the stirring unit to the developing unit in a similar manner to a case in which a small amount of replenishment toner is provided, two-component developer containing charge-deficient toner that has not been stirred sufficiently is conveyed to the developing unit. When two-component developer containing charge-deficient toner is conveyed to the developing unit, toner scattering occurs, contaminating the interior of the apparatus.

Meanwhile, in a developing apparatus using a two-component developer, as described above, the amount of developer carried on the developing sleeve is restricted to a suitable amount for development by a gap, or doctor gap, between a developer amount restricting member, which is disposed opposite the surface of the developing sleeve, and the developing sleeve. A magnetic brush constituted by the developer on the developing sleeve, which has been restricted to an amount suitable for development, is rubbed against or brought close to a photosensitive body in an appropriate state for development, and an image is formed by a development voltage. An example of this type of developing apparatus is described in Japanese Unexamined Patent Application Publication H11-194617 (Prior Art 2).

In this type of conventional developing apparatus, the normal direction magnetic flux density on the surface of the developing sleeve in an area near a doctor gap opposing the developer amount restricting member on the upstream side of the doctor gap in a developing sleeve surface motion direction takes a high value. In the developing apparatus of Prior Art 2, the maximum value of the magnetic flux density in a normal direction relative to the surface of the developing sleeve in an area near the doctor gap on the upstream side of the doctor gap in the developing sleeve surface motion direction takes a high value of 60 [mT]. As a result, the following problems arise.

When the magnetic flux density in a normal direction relative to the surface of the developing sleeve is high, a magnetic brush having a strong inter-carrier connection is formed on the surface of the developing sleeve. Further, when the developer passes through the doctor gap, i.e. the gap between the developer amount restricting member and the developing sleeve, in the area near the developing doctor on the upstream side thereof in the developing sleeve surface motion direction, the magnetic brush in a higher position than the doctor gap collides with the developer amount restricting member. When the magnetic brush having a strong inter-carrier connection collides with the developer amount restricting member, the carriers become less likely to separate, and therefore the developer particles and the developer amount restricting member, as well as the particles contained in the developer, rub together with a high degree of stress. When the developer is rubbed with a high degree of stress, the developer deteriorates, reducing the life of the developer. Hence, in consideration of the life of the developer, the stress received by the developer at the part where the developer amount restricting member and developing sleeve oppose each other must be reduced.

Technologies relating to the present invention are also disclosed in, e.g., Japanese Patent No. 3,492,156, Japanese Unexamined Patent Application H04-198966, Japanese Unexamined Patent Application H08-278695, Japanese Unexamined Patent Application H11-184249, and Japanese Unexamined Patent Application 2002-244440.

SUMMARY OF THE INVENTION

The present invention has been designed in consideration of the problems described above, and a first object thereof is to provide a developing apparatus capable of suppressing toner scattering that may occur when a development operation is halted for a long time, thereby suppressing contamination of the interior of the apparatus, and an image forming apparatus comprising the developing apparatus.

A second object of the present invention is to provide a developing apparatus capable of suppressing toner scattering after a stirring unit is replenished with a large amount of toner, thereby suppressing contamination of the interior of the apparatus, and an image forming apparatus comprising the developing apparatus.

A third object of the present invention is to provide a developing apparatus capable of extending the life of a developer in a developing method using a two-component developer, and an image forming apparatus comprising the developing apparatus.

In an aspect of the present invention, a developing apparatus comprises a developing unit having a developer carrier which rotates while carrying a two-component developer constituted by a magnetic carrier and a toner on a surface thereof, and performs development in a location opposing a latent image carrier by supplying the toner to a latent image on a surface of the latent image carrier, and a developer supply unit for supplying the two-component developer to the developer carrier; and a stirring unit having stirring means for stirring the two-component developer, which is capable of sending and receiving the two-component developer to and from the developing unit. When a development operation in which the toner is supplied to the latent image on the surface of the latent image carrier from the developer carrier is complete, the two-component developer in the developing unit is transferred to a developer storage unit outside the developing unit.

In another aspect of then present invention, a developing apparatus comprises a developing unit having a developer carrier which rotates while carrying a two-component developer constituted by a magnetic carrier and a toner on a surface thereof, and performs development in a location opposing a latent image carrier by supplying the toner to a latent image on a surface of the latent image carrier, and a developer supply unit for supplying the two-component developer to the developer carrier; a stirring unit having stirring means for stirring the two-component developer, which is capable of sending and receiving the two-component developer to and from the developing unit; and a toner replenishing device for supplying replenishment toner to the two-component developer in the stirring unit. The two-component developer in the stirring unit is stirred by the stirring means when transfer of the two-component developer from the stirring unit to the developing unit is halted.

In another aspect of the present invention, a developing apparatus comprises a developing unit having a developer carrier, which performs a surface motion while carrying a two-component developer constituted by a magnetic carrier and a toner on the surface thereof and performs development in a development area opposing a latent image carrier by supplying the toner to a latent image on a surface of the latent image carrier, a developer supply unit for supplying the developer to the surface of the developer carrier, and a developer amount restricting member opposing the surface of the developer carrier, which restricts a layer thickness of the developer that is supplied to the surface of the developer carrier by the developer supply unit and conveyed to the development area. When a central angle at a rotary center of the developer carrier between a restricting member opposing position opposing the developer amount restricting member on the surface of the developer carrier and an arbitrary position on an upstream side of the restricting member opposing position in a surface motion direction of the developer carrier is set as a restricting member upstream side central angle, a range in which an angle of the restricting member upstream side central angle is not less than 0 [°] and not more than 60 [°] is set as a low magnetic flux density area in which a normal direction magnetic flux density on the surface of the developer carrier is within a range of not less than 0 [mT] and not more than 30 [mT].

BRIEF DESCRIPTION OF THE DRAWINGS

The above and other objects, features, and advantages of the present invention will become more apparent from the following detailed description taken with the accompanying drawings, in which:

FIG. 20 is a table showing the results of the first experiment;

DESCRIPTION OF THE PREFERRED EMBODIMENTS

Each embodiment of the present invention will be described in detail below.

First Embodiment

This embodiment, in which the present invention is applied to an electrophotographic system copier (to be referred to simply as a copier 100 hereafter) serving as an image forming apparatus, will now be described.

Figure 1:
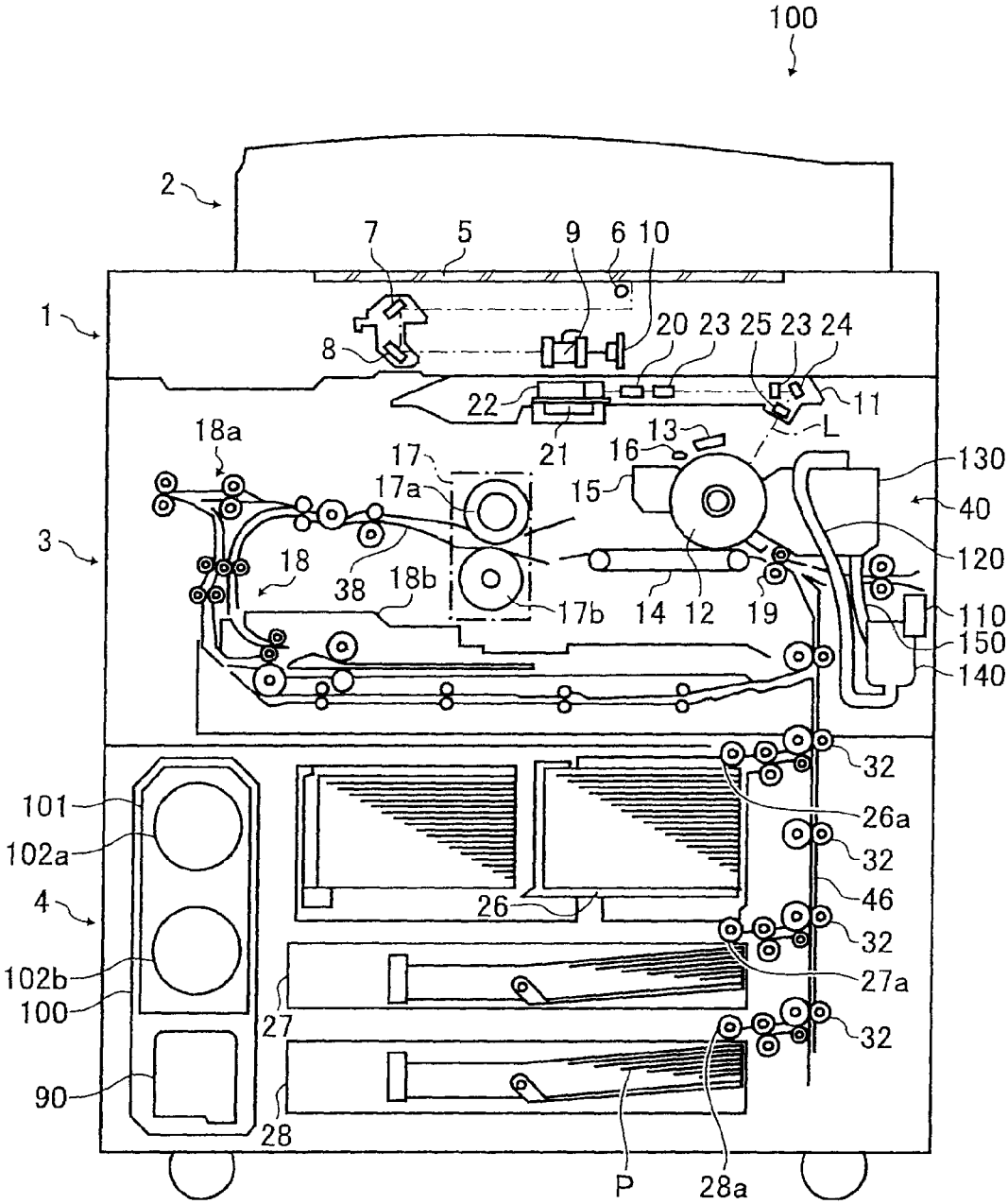
FIG. 1 is a view showing the schematic constitution of a copier according to a first embodiment of the present invention.

First, the basic constitution of the copier 100 according to the first embodiment will be described. FIG. 1 is a view showing the schematic constitution of the main parts of the copier 100. The copier 100 comprises an original reading unit 1, an original automatic supply unit 2, a printer unit 3, and a sheet feeding unit 4.

The original automatic supply unit 2 supplies an original, not shown in the drawing, carried on an upper surface thereof to a contact glass 5, to be described below, automatically.

The original reading unit 1 reads an image on the original, not shown in the drawing. When the original is placed on the contact glass 5 fixed to the upper portion of the original reading unit 1 through a manual user operation, and a start switch, not shown in the drawing, is switched on, original reading by the original reading unit 1 begins immediately. When the start switch is switched on with the original placed on the original automatic supply unit 2, original reading by the original reading unit 1 begins after the original is fed onto the contact glass 5 automatically. When reading begins, the original placed on the contact glass 5 is irradiated with light from a light source 6 that moves in the rightward direction of the drawing. A reflection light image from the original is reflected by a first mirror 7 and a second mirror 8 in sequence. After passing through an imaging lens 9, the reflection light image is detected by an image sensor 10, constituted by a CCD or the like, for reading the reflection light image, whereby image information is read.

The printer unit 3 forms a toner image serving as an image on a transfer sheet P serving as a recording body, and comprises an optical writing unit 11 and a drum-shaped photosensitive body 12 serving as a latent image carrier. Further, a charging apparatus 13, a developing machine 130 serving as a developing unit, a transfer conveyance unit 14, a photosensitive body cleaning apparatus 15, a neutralizer 16, and so on are provided on the periphery of the photosensitive body 12. The printer unit 3 also comprises a fixing apparatus 17, a sheet reversing/discharging unit 18, a resist roller pair 19, and so on. When the start switch is switched on, the photosensitive body 12 is driven to rotate by driving means not shown in the drawing.

The optical writing unit 11 subjects a laser beam L to optical modulation on the basis of an image signal read by the original reading unit 1, and exposes the photosensitive body 12 to the optically modulated laser beam L. More specifically, the laser beam L is emitted by an exposure light source 20 constituted by a laser diode or the like. The laser beam L passes through a scanning/imaging lens system 23 constituted by an fθ lens and so on while being deflected in a main scanning direction (the axial direction of the photosensitive body 12) on a rotary polygon mirror 22, which is driven to rotate by a polygon motor 21. The laser beam L then passes through a mirror 24 and a lens 25 to reach the rotating photosensitive body 12, and scans the surface thereof to form an electrostatic latent image.

The transfer conveyance unit 14 causes a transfer conveyance belt to perform an endless motion while being tension-stretched by a plurality of tension rollers, and causes the transfer conveyance belt to contact the peripheral surface of the photosensitive body 12 to form a transfer nip. Further, a transfer bias roller, not shown in the drawing, contacts the rear surface (hoop inner peripheral surface) of the transfer conveyance belt at the transfer nip. A transfer bias is applied to the transfer bias roller by a power source, not shown in the drawing, and by applying this transfer bias, a transfer electric field is formed in the transfer nip.

The electrostatic latent image formed on the photosensitive body 12 by the exposure performed by the optical writing unit 11 is developed into a toner image by the developing machine 130, and then advances to the transfer nip. Meanwhile, the resist roller pair 19 holds the transfer sheet P, which is conveyed from the sheet feeding unit 4 to be described below when the start switch is operated, between the rollers. The transfer sheet P is conveyed at a timing enabling superposition thereon of the toner image on the photosensitive body 12 at the transfer nip. When the transfer sheet P is conveyed, the toner image on the photosensitive body 12 is pressed firmly onto the transfer paper P at the transfer nip. Then, under the effects of the transfer electric field and nip pressure, the toner image is transferred from the surface of the photosensitive body 12 to the transfer sheet surface. Having passed through the transfer nip, the transfer sheet P is conveyed into the fixing apparatus 17 by the transfer conveyance belt of the transfer conveyance unit 14. The fixing apparatus 17 inserts the conveyed transfer sheet P between a heat roller 17*a* and a pressure roller 17*b*. Then, under the effects of heat and pressure, the toner image is fixed onto the transfer sheet P, and the transfer sheet P is discharged toward the sheet reversing/discharging unit 18.

The sheet reversing/discharging unit 18 discharges the conveyed transfer sheet P onto a discharge tray, not shown in the drawing, on the exterior of the apparatus through a discharge passage 18*a*. Note, however, that when a duplex copy mode has been selected by the user, the transfer sheet P is turned over by a reversing unit 18*b* and then conveyed toward the resist roller pair 19. Thus, the transfer sheet P is conveyed back to the transfer nip from the resist roller pair 19, and a new toner image is transferred onto the opposite surface of the transfer sheet P to the surface on which the previous toner image was transferred.

The photosensitive body cleaning apparatus 15 cleans away transfer residue toner adhered to the surface of the photosensitive body 12 after the photosensitive body 12 passes through the transfer nip, whereupon this toner is collected in a collection tank 90 serving as a toner collecting unit. After being cleaned, the surface of the photosensitive body 12 is neutralized by the neutralizer 16 and then uniformly charged by the charging apparatus 13 in preparation for the next image formation operation.

The sheet feeding unit 4 comprises three sheet feeding cassettes 26, 27, 28 arranged in tiers, each storing a plurality of the transfer sheets P. The sheet feeding unit 4 also comprises a sheet feeding passage 33 having a plurality of conveyance roller pairs 32. The sheet feeding cassettes 26, 27, 28 press the uppermost transfer sheet P stored therein against sheet feeding rollers 26*a*, 27*a*, 28*a*, and by driving the sheet feeding rollers 26*a*, 27*a*, 28*a* to rotate, the uppermost sheet is delivered toward the sheet feeding passage 33. When the start switch is operated, a transfer sheet is delivered to the sheet feeding passage 33 from one of the sheet feeding cassettes. The sheet feeding passage 33 feeds the received transfer sheet P to the resist roller pair 19 of the printer unit 3 using the plurality of conveyance roller pairs 32.

Next, the developing apparatus 40 serving as developing means will be described.

The developing machine 130, which is disposed on the side of the photosensitive body 12, and a stirrer 140, which serves as a stirring unit capable of sending and receiving a two-component developer constituted by a magnetic carrier and a toner to and from the developing machine 130, are connected by two developer transfer pipes serving as developer transfer passage-forming members. The developing apparatus 40 serving as the developing means is mainly constituted by the developing machine 130 and the stirrer 140.

Of the two developer transfer pipes, a pipe for transferring the developer from the stirrer 140 to the developing machine 130 is a first developer transfer pipe 120, and a pipe for transferring the developer from the developing machine 130 to the stirrer 140 is a second developer transfer pipe 150.

Figure 2:
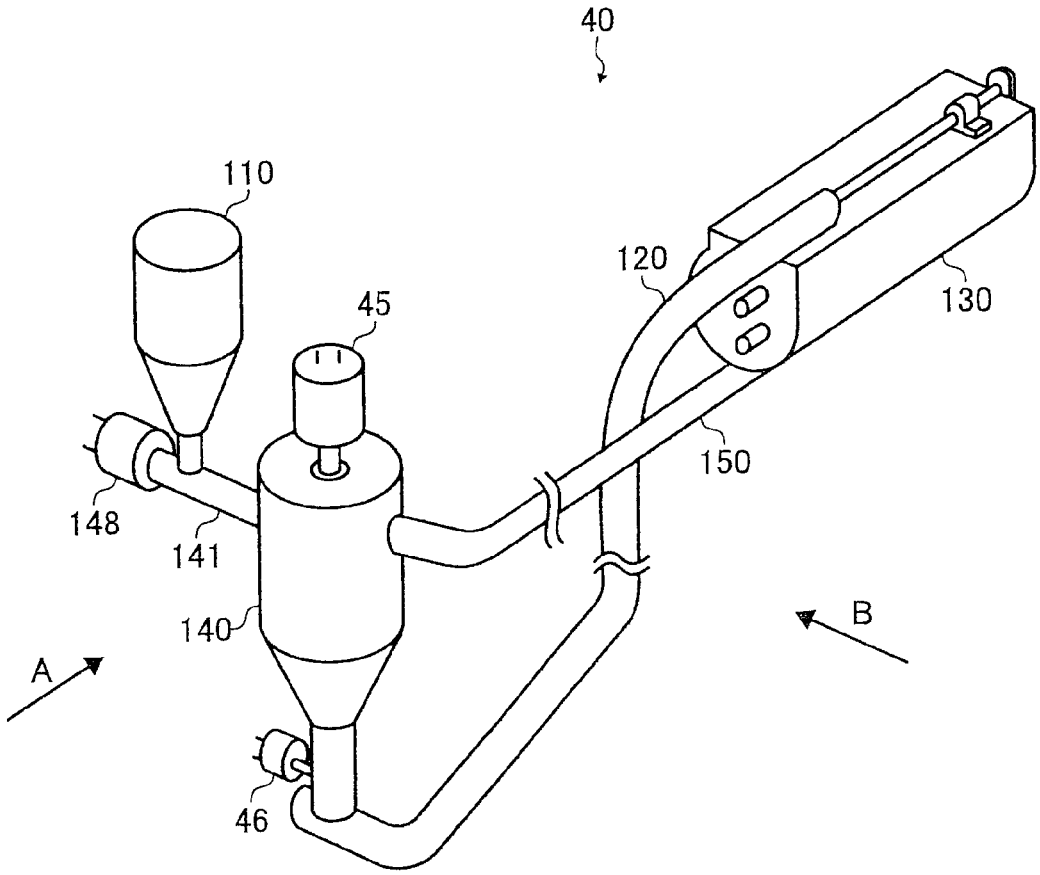
FIG. 2 is a perspective view showing the constitution of a developing apparatus of the copier.
Figure 3:
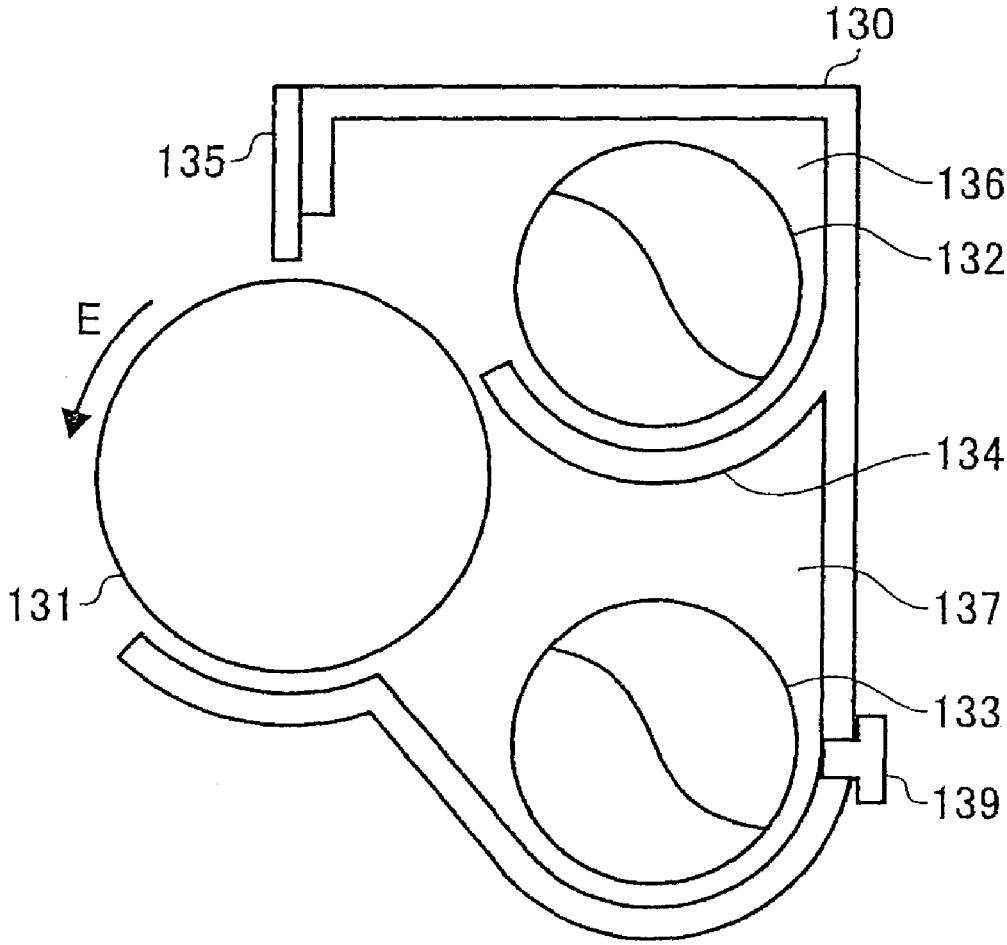
FIG. 3 is a sectional view showing the schematic constitution of a developing machine of the developing apparatus, seen from the direction of an arrow A in FIG. 2.
Figure 4:
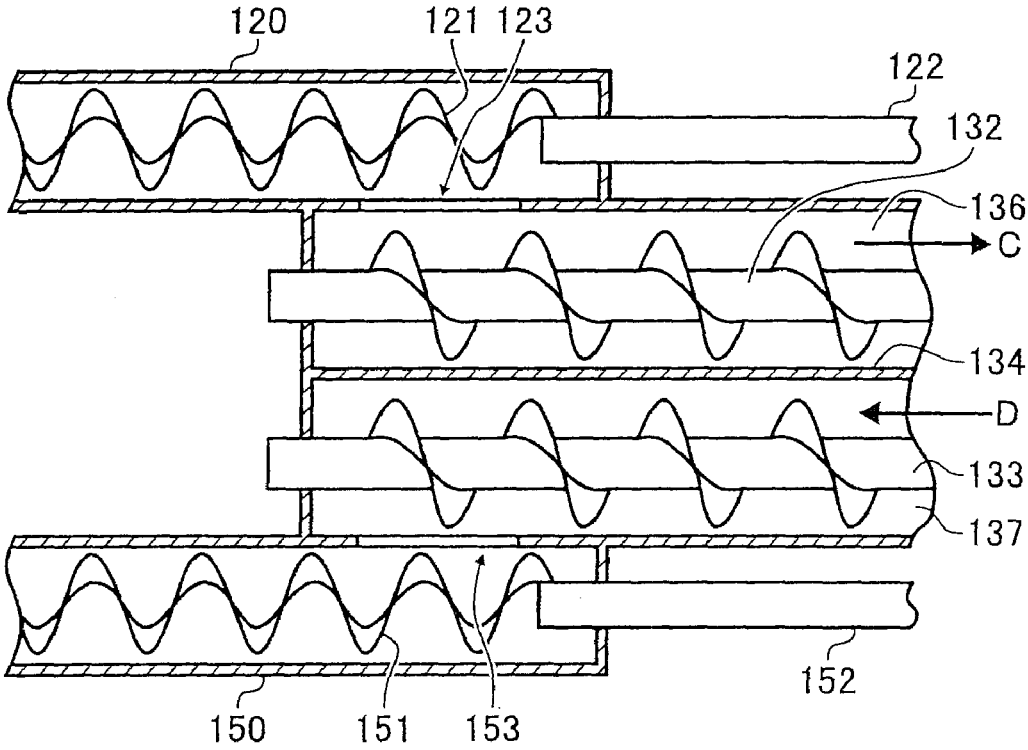
FIG. 4 is a sectional view showing the schematic constitution of the periphery of a front side end portion in FIG. 2 of the developing machine, seen from the direction of an arrow B in FIG. 2.

FIG. 2 is a perspective view showing the constitution of the developing apparatus 40. FIG. 3 is a sectional view showing the schematic constitution of the developing machine 130, seen from the direction of an arrow A in FIG. 2. FIG. 4 is a sectional view showing the schematic constitution of the periphery of a front side end portion in FIG. 2 of the developing machine 130, seen from the direction of an arrow B in FIG. 2.

The developing machine 130 is a so-called two-component developing machine which stores a two-component developer (to be referred to simply as a developer hereafter) formed by mixing together a toner and a magnetic carrier in its interior during a development operation. The developing machine 130 comprises a developing roller 131 serving as a developer carrier, and a supply conveyance screw 132 serving as a developer supply conveyance member for supplying the developer to the developing roller 131 while conveying the developer in the direction of an arrow C in FIG. 4. The developing machine 130 also comprises a collection conveyance screw 133 serving as a developer collection conveyance member for collecting the developer from the surface of the developing roller 131 after the developer has been supplied to the developing roller 131 and has passed through a development area, and conveying the developer in the direction of an arrow D in FIG. 4. The supply conveyance screw 132 and the collection conveyance screw 133 serve as developing unit conveyance members for conveying the developer through the developing machine 130 serving as the developing unit.

Further, a toner container 110 storing unused toner is connected to the stirrer 140 by a toner replenishment passage 141 serving as toner replenishing means.

A space storing the developer in the developing machine 130 is partitioned by a partition wall 134 serving as a partitioning member into a supply conveyance passage 136 serving as a developer supply conveyance passage, or in other words a supply unit comprising the supply conveyance screw 132, and a collection conveyance passage 137 serving as a developer collection conveyance passage comprising the collection conveyance screw 133. The partition wall 134 comprises an opening portion, not shown in the drawing, on the downstream side of the conveyance direction of the supply conveyance screw 132, and the supply conveyance path 136 and the collection conveyance path 137 communicate with each other through this opening portion.

The developing roller 131 is caused to carry the developer in the supply conveyance passage 136 on its surface while rotating in the direction an arrow E in FIG. 3 by the magnetic force of a magnet roller, not shown in the drawing, provided in the interior thereof. The amount of developer carried on the surface of the developing roller 131 is restricted by a doctor blade 135 serving as developer carrying amount restricting means, whereupon the developer is conveyed to an opposing portion between the developing roller 131 and the photosensitive body 12, which serves as the development area. In the development area, the latent image on the surface of the photosensitive body 12 is developed, whereupon the developer from which toner has been consumed separates from the developing roller 131 at an opposing portion between the developing roller 131 and the collection conveyance screw 133, and is collected in the collection conveyance passage 137 as collected developer. Further, the surplus developer that is not supplied to the developing roller 131 from the supply conveyance passage 136 and travels to the conveyance direction downstream end of the supply conveyance screw 132 is transferred to the collection conveyance passage 137 through the aforementioned opening portion in the partition wall 134, and conveyed by the collection conveyance screw 133 together with the collected developer.

Note that the developing machine 130 comprises a toner concentration sensor 139 for detecting the toner concentration of the collected developer near the conveyance direction downstream end of the collection conveyance screw 133 in the collection conveyance passage 137.

The first developer transfer pipe 120 and second developer transfer pipe 150 are pipe-form developer transfer passage-forming members made of metal, resin, rubber, or the like for connecting the developing machine 130 and stirrer 140 to each other. The first developer transfer pipe 120 comprises a first auger 121 serving as a stirred developer transfer member for transferring the developer from the stirrer 140 to the developing machine 130. The second developer transfer pipe 150 comprises a second auger 151 serving as a developed developer transfer member for transferring the developer from the developing machine 130 to the stirrer 140. The first auger 121 and second auger 151 have a shaftless coil shape.

The first developer transfer pipe 120 is connected to the developing machine 130 above the supply conveyance passage 136, and the interior space of the first developer transfer pipe 120 communicates with the supply conveyance passage 136 via a developing machine upper portion opening portion 123 provided in the upper surface of the developing machine 130. Meanwhile, the second developer transfer pipe 150 is connected to the developing machine 130 beneath the collection conveyance passage 137, and the interior space of the second developer transfer pipe 150 communicates with the collection conveyance passage 137 via a developing machine lower portion opening portion 153 provided in the lower surface of the developing machine 130.

Further, a first auger drive shaft 122 is connected to an end portion of the first auger 121 on the developing machine 130 side, while a second auger drive shaft 152 is connected to an end portion of the second auger 151 on the developing machine 130 side. The first auger drive shaft 122 and second auger drive shaft 152 are connected to the drive source of the supply conveyance screw 132 and collection conveyance screw 133 or the developing roller 131 by a gear or the like, and rotate together with the various members of the developing machine 130.

Figure 5:
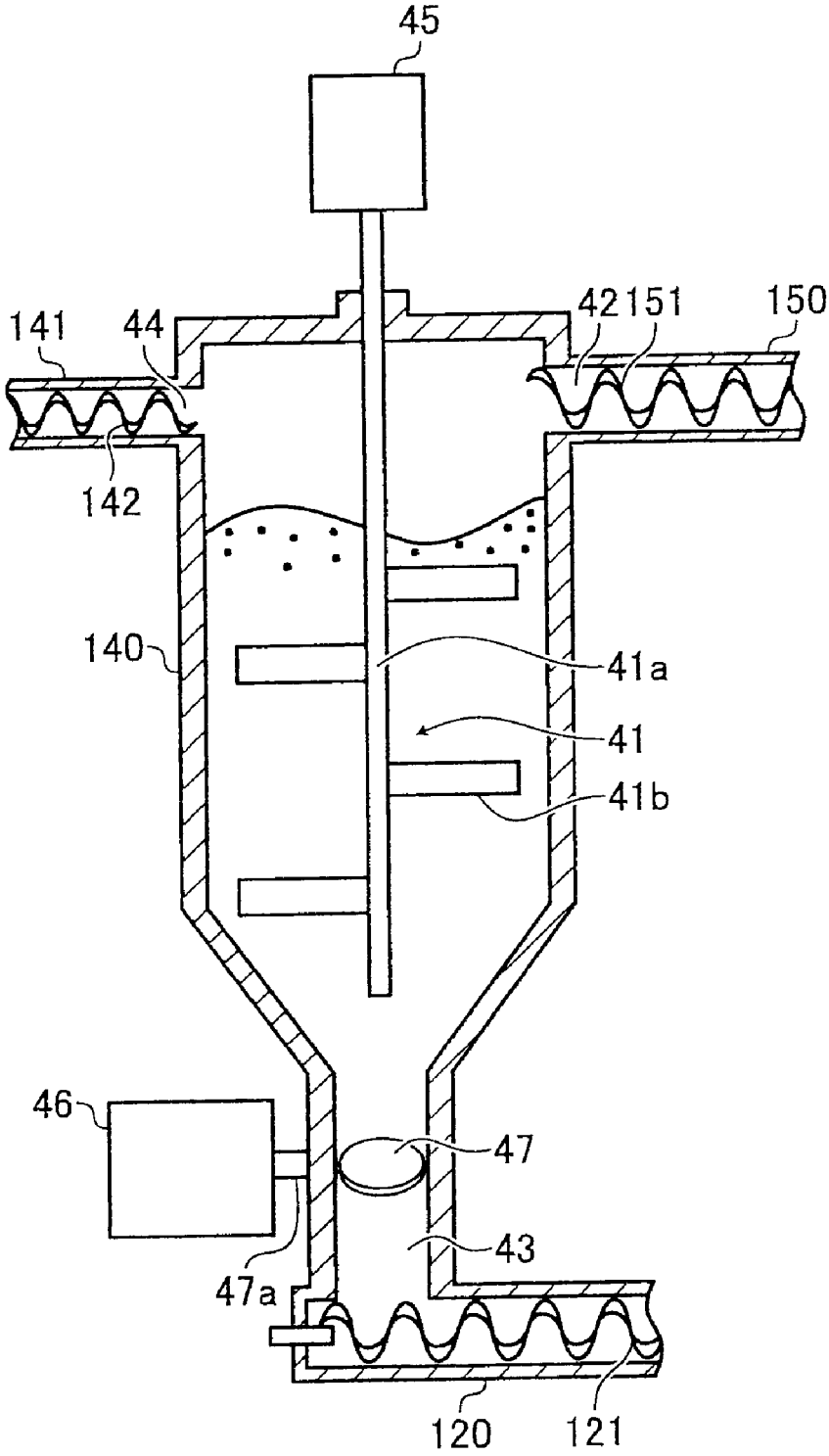
FIG. 5 is a sectional view showing the schematic constitution of a stirrer of the developing apparatus.

FIG. 5 is a sectional view showing the schematic constitution of the stirrer 140, seen from the direction of the arrow A in FIG. 2.

The stirrer 140 comprises a developer inflow port 42 through which developer transferred from the developing machine 130 flows, and a developer outflow port 43 through which developer to be transferred to the developing machine 130 flows. The stirrer 140 also comprises a toner replenishment port 44 through which replenishment toner from the toner container 110 flows. Further, an agitator 41 serving as stirring means for stirring the developer is provided in the interior of the stirrer 140, and the agitator 41 is rotated by an externally provided stirring motor 45. In the agitator 41, a plurality of stirring vanes 41*b* are attached to a stirring shaft 41*a* as shown in the drawing, and by rotating the stirring vanes 41*b*, the developer is stirred.

A valve 47 serving as a transfer passage opening/closing member, or in other words developer transfer amount control means, is disposed in the developer outflow port 43 at the bottom of the stirrer 140. The valve 47 is made of resin, metal, or the like, and has an identical circular cross-section to the cross-section of the developer outflow port 43. The valve 47 is disposed such that a valve rotary shaft 47*a* serving as a rotary shaft thereof is set at a right angle to the outflow direction of the developer passing through the developer outflow port 43. The valve rotary shaft 47*a* is connected to a valve motor 46, and the valve 47 is rotated by driving the valve motor 46.

Figure 6A:
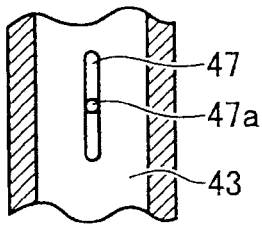
FIG. 6A is a view showing a state in which a developer outflow port is opened in an opening/closing operation to open or close the developer outflow port.
Figure 6B:
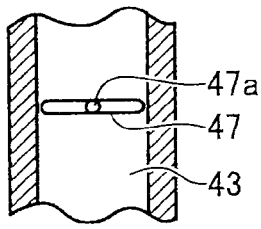
FIG. 6B is a view showing a state in which the developer outflow port is closed.

FIGS. 6A and 6B are views illustrating an opening/closing operation for opening or closing the developer outflow port 43, which is a part of the developer transfer passage for transferring the developer from the stirrer 140 to the developing machine 130, by rotating the valve 47. FIG. 6A is a view illustrating a state in which the developer outflow port 43 is open, and FIG. 6B is a view illustrating a state in which the developer outflow port 43 is closed.

By controlling the rotation of the valve motor 46 using control means not shown in the drawing, the rotation of the valve 47 is controlled, and hence the developer outflow port 43 can be opened or closed and the amount of outflowing developer can be adjusted. More specifically, by controlling the ratio between the duration of the open state shown in FIG. 6A and the duration of the closed state shown in FIG. 6B, the amount of developer that is transferred from the stirrer 140 to the developing machine 130 can be adjusted.

The toner container 110 is made from metal, resin, or another material. The toner container 110 and the stirrer 140 are connected to each other by the toner replenishment passage 141. A toner conveyance auger 142 constituted by a coil screw or the like is provided in the interior of the toner replenishment passage 141, and by rotating an externally provided toner replenishment motor 148, the toner conveyance auger 142 is rotated such that replenishment toner is supplied to the stirrer 140.

Next, circulation of the developer through the developing apparatus 40 will be described.

In the developing machine 130, developer is supplied to the surface of the developing roller 131 from the supply conveyance passage 136 and passes through the development area. The developer is then collected in the collection conveyance passage 137 comprising the collection conveyance screw 133 as collected developer, and conveyed in sequence in the direction of the arrow D in FIG. 4. Further, the developer that is not supplied to the developing roller 131 and travels to the conveyance direction downstream end of the supply conveyance screw 132 falls from the supply conveyance passage 136 to the collection conveyance passage 137 under its own weight through the opening portion in the partition wall 134 as surplus developer. The surplus developer that falls into the collection conveyance passage 137 is then conveyed in the direction of the arrow D in FIG. 4, similarly to the collected developer. The developer that is conveyed in the direction of the arrow D by the collection conveyance screw 133 so as to reach the conveyance direction downstream end of the collection conveyance screw 133 falls through the developing machine lower portion opening portion 153 under its own weight and enters the second developer transfer pipe 150.

After entering the second developer transfer pipe 150, the developer is transferred to the stirrer 140 by the second auger 151. As shown in FIG. 5, developer accumulates in the interior of the stirrer 140 in advance, and the developer flows through the developer inflow port 42 and is stirred into the accumulated developer by the agitator 41. At the bottom of the stirrer 140, the developer is discharged through the developer outflow port 43 under its own weight, but by controlling the rotation of the valve motor 46 using the control means, not shown in the drawing, the rotation of the valve 47 can be controlled to control the amount of discharged developer. The discharged developer falls into the first developer transfer pipe 120 and is transferred to the top of the supply conveyance passage 136 in the developing machine 130 by the first auger 121. Having reached the top of the supply conveyance passage 136, the developer falls through the developing machine upper portion opening portion 123 under its own weight, and is transferred to the supply conveyance passage 136. Having been transferred to the supply conveyance passage 136, the developer is supplied to the developing roller 131 while being conveyed in the direction of the arrow C in FIG. 4 by the supply conveyance screw 132.

In the developer circulation described above, the toner contained in the developer is consumed when the developer carried on the surface of the developing roller 131 passes through the development area, which is the opposing portion between the developing roller 131 and the photosensitive body 12. When the toner is consumed, the toner concentration of the developer decreases, and this reduction in the toner concentration is detected by the toner concentration sensor 139. To replace the reduced toner, replenishment toner is supplied to the stirrer 140 from the toner container 110 through the toner replenishment passage 141, and the replenishment toner is mixed with the developer in the stirrer 140. Note that the amount of replenishment toner may be calculated by detecting the area ratio of the formed image. Further, the position of the toner concentration sensor is not limited to the developing machine 130, and the toner concentration sensor may be provided in the stirrer 140.

When the developing apparatus 40 operates normally, the valve 47 rotates at a constant speed such that the amount of developer discharged from the stirrer 140 is constant. When image formation is not underway in the developing apparatus, the valve 47 is closed and the developing apparatus is driven as usual. As a result, the developer gradually accumulates in the stirrer 140 until eventually, substantially all of the developer is stored in the stirrer 140. At this time, the developing machine 130 continues to be driven, but since no developer enters the developing machine 130, the developer is not subjected to stress. Note, however, that the developing machine 130 may also be halted. When image formation resumes and the valve 47 is rotated at a constant speed, the developer is transferred from the stirrer 140 to the developing machine 130, and circulation of the developer begins.

In a developing apparatus that uses a two-component developer containing a toner and a magnetic carrier, charge-deficient toner appears in the developing unit if the developer is not stirred sufficiently, and this charge-deficient toner causes toner scattering. Hence, it is desirable to secure a sufficient stirring time during which the toner can be charged to a desired charge. In a high-speed apparatus, however, the speed with which the developer circulates through the developing apparatus is high, and it is therefore difficult to secure the stirring time required to charge the toner sufficiently. By increasing the volume of developer in the developing apparatus to ensure that the toner is stirred sufficiently, the replenishment toner can be dispersed easily, but in a conventional developing apparatus in which the developing unit and stirring unit are formed integrally, this leads to an increase in the size of the developing apparatus and a corresponding increase in the size of the machine main body.

This problem can be solved by forming the developing machine 130 serving as the developing unit and the stirrer 140 serving as the stirring unit separately and connecting the developing machine 130 and stirrer 140 using developer transfer pipes serving as the developer transfer passage-forming members, as shown in FIG. 2.

By providing the stirring unit separately to the developing unit and stirring the developer therewith, the developer can be supplied to the developing roller with the toner in a more reliably charged state. Furthermore, the developer circulation path is longer than that of a developing apparatus in which the developing unit and stirring unit are provided integrally, and therefore the toner and carrier have more opportunities to come into contact with each other, making charging defects less likely. Further, by providing the developing unit and stirring unit separately, the stirring unit can be provided at a remove from the developing unit, and therefore the space for providing the developing unit can be made smaller than that of a developing apparatus in which the developing unit and stirring unit are provided integrally. As a result, the layout freedom of the entire image forming apparatus can be increased, and the size of the apparatus main body can be reduced.

By providing the developing machine 130 and stirrer 140 separately, the disposal freedom of the stirrer 140 can be increased. As a result, the stirrer 140 can be disposed in a position that is unlikely to be affected by temperature and the outside air even if the developing machine 130 is disposed in a position that is likely to be affected by temperature and the outside air. Thus, deterioration and alteration of the developer due to temperature and the outside air can be suppressed.

Note that in a conventional developing apparatus in which the developing unit and stirring unit are provided separately, the developer circulates through the developing apparatus constantly, while the developing roller and stirring means typically receive drive from the apparatus main body and rotate via a gear or the like. By providing as few motors and other drive sources as possible, reductions in cost, space, and energy can be achieved, and therefore various units are usually driven by the same motor. In such a case, the following problems arise.

The developing apparatus is driven constantly, and therefore rotates idly when the developer is not in use (when a development operation is not underway). Hence, even through no toner is consumed, stress is applied to the developer, causing deterioration of the developer to advance. In other words, it is more advantageous in terms of the life of the developer to drive the developing apparatus only when the developer is in use.

The aforementioned stress that is applied to the developer will now be described.

In the developing apparatus 40, the greatest amount of stress is applied to the developer at the doctor gap, i.e. the gap between the developing roller 131 and the doctor blade 135.

Figure 7:
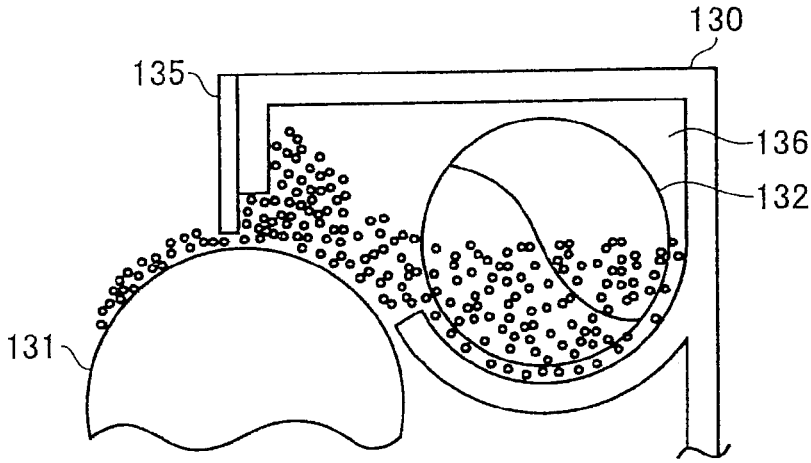
FIG. 7 is a view showing the constitution of the periphery of a doctor blade of the developing machine.

FIG. 7 is an enlarged view of the periphery of the doctor blade 135 in the developing machine 130 of the developing apparatus 40 shown in FIG. 3. As shown in FIG. 7, the developer in the supply conveyance passage 136 is conveyed in the rotary axis direction of the developing roller 131 by the supply conveyance screw 132, attracted by the magnetic force of the developing roller 131, and thereby carried on the surface of the developing roller 131. The developer carried on the surface of the developing roller 131 rotates together with the surface of the developing roller 131, and at the doctor gap, excess developer is dammed by the doctor blade 135, whereby the amount of conveyed developer is restricted. As a result, friction acts on the developer. The toner can be charged by this friction, but at the same time, the friction causes the toner and magnetic carrier to deteriorate.

Hence, friction on the upstream side of the doctor gap in the surface motion direction of the developing roller 131 is the main cause of developer deterioration, and it is therefore desirable to reduce the stress received by the developer at the doctor gap. Note that in some developing apparatuses, the developer carrier or conveyance means in the developing apparatus may be driven even when development is not underway due to reasons such as the use of a power source that is shared with another developing apparatus. If the developing apparatus is driven to rotate idly even when development is not underway, unnecessary stress is applied to the developer as it passes through the doctor gap, thereby advancing deterioration of the developer.

In the development apparatus 40 of the first embodiment, the toner is charged by mixing and stirring the developer in the stirrer 140, and therefore the stress received by the developer at the doctor gap can be reduced. The developer is transferred to the developing machine 130 only when image formation is underway, and therefore the developer can be prevented from passing through the doctor gap when image formation is not underway. As a result, the frequency with which stress is applied to the developer is reduced greatly in comparison with a conventional developing apparatus, and therefore the life of the developer can be extended.

Next, a case in which the developing apparatus is left in a halted state for a long time will be described.

When the developer is left inoperative for a long time, the toner charge decreases. Conventionally in this case, color concentration adjustment (process control) is typically performed after supplying power to the main body to bring the developer to an appropriate condition. A conventional developing apparatus is driven continuously during this adjustment, and therefore stress is applied to the developer in the manner described above, causing the developer to deteriorate.

Furthermore, the reduced-charge toner has poor adsorbability relative to the magnetic carrier, and therefore separates from the magnetic carrier easily. As a result, the toner may scatter during adjustment, contaminating the interior of the apparatus.

In the developing apparatus 40 of the first embodiment, when the developer is left inoperative for a long time, the developer is stirred in the stirrer 140 to apply a charge to the toner after power is supplied, and only then is the developer transferred to the developing machine 130. Thus, while process control is performed on the developer, which has a reduced toner charge after being left inoperative for a long time, unnecessary stress is not applied to the developer, and the interior of the apparatus is not contaminated with charge-deficient toner.

Further, in a developing apparatus, a part of the developer carrier protrudes to the outside for the purposes of image formation, and therefore when developer is present in the developing unit and the developing apparatus is left inoperative for a long time, as occurs in a conventional developing apparatus, the air-tightness deteriorates and the apparatus is easily affected by the temperature and humidity of the outside air. The fluidity and the charge of the developer decrease particularly rapidly in a state of high humidity. In the developing apparatus 40 of the first embodiment, the developer is stored in the stirrer 140, which is formed separately to the developing machine 130 comprising the developing roller 131, or in other words the developer carrier, while the apparatus is inoperative, and therefore the developing apparatus 40 is unlikely to be affected by the outside air. Further, a shutter or the like may be provided to increase the air-tightness.

To prevent stress from being applied unnecessarily to the developer when the developing apparatus rotates idly while not in use, as described above, a clutch or the like may be disposed between the developing unit conveyance member or the like and the power source such that the developing roller 131 is driven only when the developer is in use. However, even when a clutch or the like is provided, the following problems occur.

In a developing apparatus that is driven only when the developer is in use, the developer is not stirred when not in use. Therefore, the toner charge decreases continuously while the developer is not in use, and cannot be brought to the desired charge immediately when the developing apparatus is driven and the developer is to be used. In a conventional developing apparatus, the toner is charged by stirring the developer in the developing unit, and the toner charge decreases when the developer is not in use. Accordingly, the developer must be stirred in the developing unit for a certain amount of time to raise the toner charge. While the developer is being stirred to raise the toner charge, development cannot be performed, and this state is tantamount to idle rotation. The toner charge decreases by a particularly large degree when the apparatus main body is left inoperative for a long time, and therefore a long period of idle rotation is required. When idle rotation is performed in this manner to charge the toner, unnecessary stress is applied to the developer as the developer passes through the doctor gap. Moreover, during stirring, insufficiently charged toner scatters through gaps such as the doctor gap on the periphery of the developer carrier so as to contaminate the interior of the apparatus.

In the developing apparatus 40 of the first embodiment, on the other hand, stirring is performed in the stirrer 140 serving as the stirring unit until the toner charge rises, and substantially no developer having an insufficient toner charge is present in the developing machine 130 serving as the developing unit. Hence, the developer can be prevented from receiving unnecessary stress at the doctor gap while the toner charge rises, and as a result, the life of the developer can be extended. Moreover, during stirring performed while the toner charge rises, substantially no developer containing insufficiently charged toner is present in the developing machine 130, and therefore toner scattering through gaps such as the doctor gap on the periphery of the developing roller 131 can be prevented. As a result, contamination of the interior of the apparatus due to toner scattering can be prevented.

Further, in the developing apparatus 40 of the first embodiment, when a large amount of replenishment toner is supplied to the stirrer 140 serving as the stirring unit, the developer is stirred in the stirrer 140 after halting developer transfer from the stirrer 140 to the developing machine 130 serving as the developing unit. More specifically, when more than a predetermined amount of replenishment toner is supplied to the stirrer 140 from the toner container 110, rotation of the valve motor 46 is controlled such that the valve 47 closes the developer outflow port 43, as shown in FIG. 6B. With the valve 47 in the state shown in FIG. 6B, the valve motor 46 is halted and the stirring motor 45 is driven to rotate the agitator 41 serving as the stirring means, whereby the developer in the stirrer 140 is stirred. The driving duration of the stirring motor 45 is controlled in accordance with the amount of replenishment toner while the valve motor 46 remains halted. In so doing, the developer can be transferred from the stirrer 140 to the developing machine 130 after being stirred sufficiently by the stirrer 140.

When a large amount of replenishment toner is supplied to a two-component developer, stirring must be performed for a certain amount of time until the toner reaches the desired charge. However, in a developing apparatus in which the developer circulates constantly, the time required for the developer to move from a toner replenishment position to a development position is fixed, and therefore when a large amount of replenishment toner is supplied, developer containing charge-deficient toner is transferred to the developing unit. When charge-deficient toner is transferred to the developing unit, toner scattering occurs, and as a result, the interior of the apparatus is contaminated.

In the developing apparatus 40 of the first embodiment, on the other hand, when a large amount of replenishment toner is supplied, the developer is transferred from the stirrer 140 to the developing machine 130 after being stirred sufficiently by the stirrer 140, and therefore toner scattering can be suppressed.

According to the developing apparatus 40 of the first embodiment described above, the developing machine 130 is provided as a developing unit and the stirrer 140 is provided as a stirring unit. When a development operation ends, the developer in the developing machine 130 is transferred to the stirrer 140, which serves as a developer storage unit external to the developing machine 130, such that substantially no developer is present in the developing machine 130. As a result, the existence of charge-deficient toner, including uncharged toner, in the developing machine 130 can be suppressed, and toner scattering caused by the presence of charge-deficient toner in the developing machine 130 can be suppressed. Hence, toner scattering that may occur when the development operation is halted for a long time can be suppressed, and as a result, contamination of the apparatus interior can be suppressed.

Further, when the development operation is resumed after the development operation ends and the developer is transferred to the stirrer 140, the developer transferred to the stirrer 140 is transferred to the developing machine 130 after being stirred by the stirrer 140, and therefore substantially all of the developer is stirred by the stirrer 140 before being transferred to the developing machine 130. Hence, the existence of charge-deficient toner in the developing machine 130 can be suppressed, and toner scattering caused by the presence of charge-deficient toner in the developing machine 130 can be suppressed. Accordingly, toner scattering occurring when a development operation is resumed after being stopped for a long time can be suppressed, and as a result, contamination of the apparatus interior after the development operation is halted for a long time can be suppressed.

Moreover, since the stirrer 140 serves as the developer storage unit external to the developing machine 130, there is no need to provide a developer storage unit in addition to the stirrer 140 and developing machine 130. As a result, increases in the size of the apparatus can be prevented.

Further, by rotating the agitator 41 serving as the stirring means while the developer outflow port 43 is closed by the valve 47 and developer transfer from the stirrer 140 to the developing machine 130 is halted, the developer in the stirrer 140 can be stirred by the agitator 41. Hence, the developer containing toner having a reduced charge due to being left for a long time can been stirred to increase the toner charge before the developer is transferred from the stirrer 140 to the developing machine 130. As a result, toner scattering caused by the presence of charge-deficient toner in the developing machine 130 can be suppressed. Since developer transfer from the stirrer 140 to the developing machine 130 is resumed only after the toner has been stirred sufficiently, the toner charge in the developing machine 130 is particularly stable, and therefore the quality of the formed image is also stable.

Further, the toner replenishment passage 141, serving as toner replenishing means for supplying replenishment toner from the toner container 110, supplies the developer in the stirrer 140 with replenishment toner. By supplying the stirrer 140 with replenishment toner, the newly supplied, uncharged replenishment toner is stirred until the charge of the toner has been increased sufficiently, and only then is the developer transferred to the developing machine 130.

Further, in the developing apparatus 40 of the first embodiment, the developer in the stirrer 140 can be stirred by the agitator 41 serving as the stirring means while transfer of the developer from the stirrer 140 serving as the stirring unit to the developing machine 130 serving as the developing unit is halted, and therefore when a large amount of replenishment toner is supplied to the stirrer 140, the developer in the stirrer 140 is stirred by the agitator 41 while transfer of the developer from the stirrer 140 to the developing machine 130 is halted. Hence, the developer can be transferred from the stirrer 140 to the developing machine 130 after being stirred sufficiently by the stirrer 140. As a result, toner scattering caused when developer containing charge-deficient toner is transferred to the developing machine 130 after a large amount of replenishment toner has been supplied can be suppressed. Accordingly, contamination of the apparatus interior due to charge-deficient toner scattering, which occurs easily after a large amount of replenishment toner has been supplied, can be prevented.

Furthermore, by providing the developing machine 130 serving as the developing unit and the stirrer 140 serving as the stirring unit separately, and connecting the developing machine 130 and stirrer 140 using the first developer transfer pipe 120 and second developer transfer pipe 150, which constitute the two developer transfer pipes serving as the developer transfer passage-forming members, the stirring unit can be provided at a remove from the developing unit, and hence the space for providing the developing unit can be reduced in comparison with a developing apparatus in which the developing unit and stirring unit are provided integrally. As a result, the layout freedom of the entire image forming apparatus can be increased, and the size of the apparatus main body can be reduced. Moreover, by disposing the stirrer 140 in a position where it is unlikely to be affected by temperature and the outside air, deterioration and alteration of the developer in the stirrer 140 due to the effects of temperature and the outside air can be suppressed.

Further, the first auger 121, which serves as the stirred developer transfer member for transferring developer through the first developer transfer pipe 120 from the stirrer 140 to the developing machine 130, and the second auger 151, which serves as the developed developer transfer member for transferring developer through the second developer transfer pipe 150 from the developing machine 130 to the stirrer 140, are constituted such that drive is transmitted thereto from a drive source shared by the supply conveyance screw 132 and collection conveyance screw 133 of the developing machine 130 or the developing roller 131. In so doing, the number of motor components serving as drive sources can be reduced, enabling a reduction in cost.

Further, the developer supply unit comprises the supply conveyance passage 136 serving as a developer supply conveyance passage comprising the supply conveyance screw 132, which serves as a developer supply conveyance member for conveying the developer along the axial direction of the developing roller 131 and supplying the developer to the developing roller 131, and therefore a stable amount of developer can be supplied to the developing roller 131.

Further, during a normal development operation, the developer used for development in the developing machine 130 is replenished with toner by the stirrer 140, and by stirring the replenishment toner, developer suitable for development is obtained, whereupon the developer is circulated through the developing machine 130 and stirrer 140. As a result, the developing roller 131 can be supplied with developer suitable for development at all times.

Further, by providing the valve 47, the valve motor 46, and the control unit, not shown in the drawing, for controlling the rotation of the valve motor 46, which serve as the developer transfer amount control means for controlling the amount of developer transferred from the stirrer 140 to the developing machine 130, the amount of developer in the developing machine 130 can be maintained in an appropriate state. Furthermore, by controlling the amount of developer transferred from the stirrer 140 to the developing machine 130 to zero, developer transfer from the stirrer 140 to the developing machine 130 can be halted when the development operation ends or a large amount of replenishment toner is supplied.

Further, the developer transfer amount control means are constituted by the valve 47, serving as the transfer passage opening/closing member, and the valve motor 46, serving as opening/closing member control means, and therefore the developer transfer amount can be regulated simply by performing an opening/closing operation on the valve 47.

Further, the copier 100 serving as the image forming apparatus comprises the developing apparatus 40 serving as developing means, and therefore contamination of the apparatus interior due to toner scattering can be prevented. Moreover, the amount of stress applied to the developer can be reduced, and therefore the life of the developer can be extended.

Second Embodiment

In the first embodiment described above, the developing apparatus 40, in which the developing unit and stirring unit are provided separately, was described. However, a developing apparatus in which the developing unit and stirring unit are provided integrally may be employed as a developing apparatus for preventing toner scattering caused by charge-deficient toner. Below, a developing apparatus in which the developing unit and stirring unit are provided integrally will be described as the second embodiment.

Figure 8A:
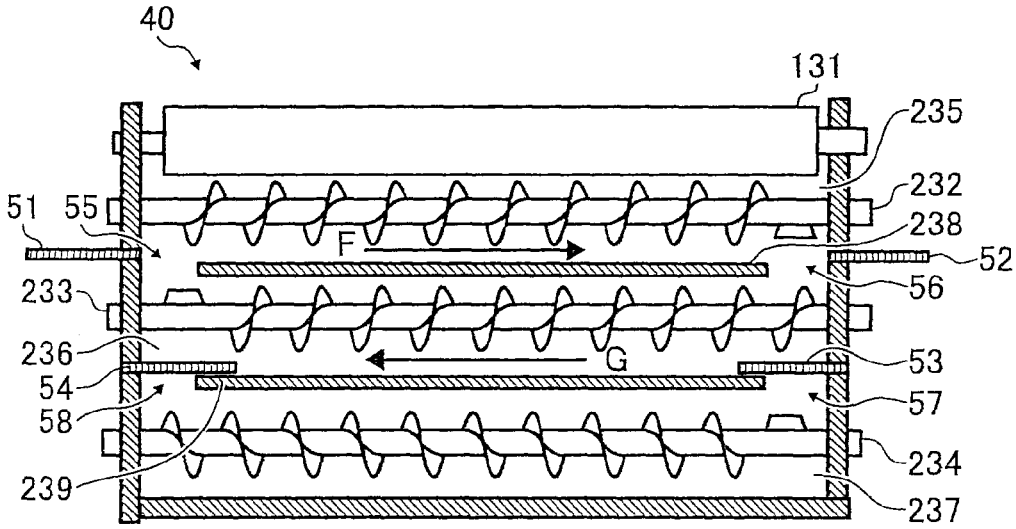
FIG. 8A is a view showing the schematic constitution of a developing apparatus according to a second embodiment of the present invention, and illustrating a normal development operation.
Figure 8B:
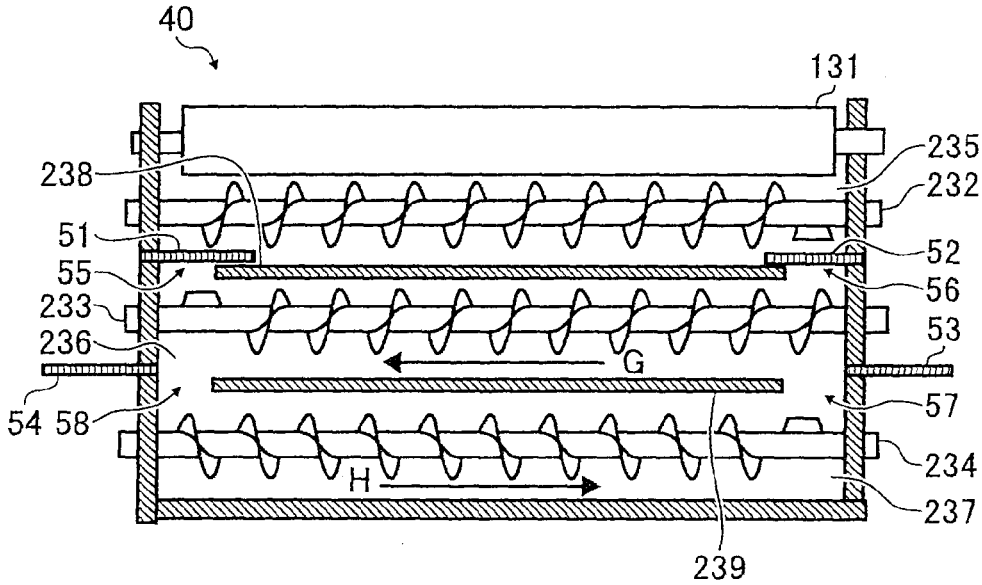
FIG. 8B is a view illustrating a development operation of the developing apparatus during a non-development period.

FIGS. 8A and 8B are views showing the schematic constitution of the developing apparatus 40 according to the second embodiment. FIG. 8A is a view illustrating a normal development operation, and FIG. 8B is a view illustrating a non-development period.

This developing apparatus 40 is constituted by a supply collection conveyance passage 235 serving as a developing unit for supplying developer to the developing roller 131 and collecting the developer from the developing roller 131 after the developer has passed through the development area, and a first stirring conveyance passage 236 and a second stirring conveyance passage 237 serving together as a stirring unit. As developer conveyance members, the developing apparatus 40 comprises a supply collection conveyance screw 232 in the supply collection conveyance passage 235, a first stirring conveyance screw 233 in the first stirring conveyance passage 236, and a second stirring conveyance screw 234 in the second stirring conveyance passage 237.

The supply collection conveyance passage 235 and the first stirring conveyance passage 236 are partitioned by a first partition wall 238. The first partition wall 238 comprises two opening portions, namely a supply opening portion 55 on the conveyance direction upstream side of the supply collection conveyance screw 232 and a collection opening portion 56 on the conveyance direction downstream side of the supply collection conveyance screw 232. The supply collection conveyance passage 235 and the first stirring conveyance passage 236 communicate with each other via the supply opening portion 55 and collection opening portion 56.

The first stirring conveyance passage 236 and second stirring conveyance passage 237 are partitioned by a second partition wall 239. The second partition wall 239 comprises two opening portions, namely a first stirring opening portion 57 on the conveyance direction upstream side of the first stirring conveyance screw 233 and a second stirring opening portion 58 on the conveyance direction downstream side of the first stirring conveyance screw 233. The first stirring conveyance passage 236 and second stirring conveyance passage 237 communicate with each other via the first stirring opening portion 57 and second stirring opening portion 58.

The supply opening portion 55, collection opening portion 56, first stirring opening portion 57, and second stirring opening portion 58 each comprise an openable and closable shutter member serving as a transfer passage opening/closing member. The supply opening portion 55 is provided with a supply shutter 51, the collection opening portion 56 is provided with a collection shutter 52, the first stirring opening portion 57 is provided with a first stirring shutter 53, and the second stirring opening portion 58 is provided with a second stirring shutter 54.

Note that each shutter member is connected to a combination mechanism, such as a solenoid or cam, of the image forming apparatus main body, and is opened and closed in accordance with a control command from control means, not shown in the drawing, such as a CPU on the main body side.

As shown in FIG. 8A, during a normal development operation in the developing apparatus 40, the supply shutter 51 and collection shutter 52 are open, whereas the first stirring shutter 53 and second stirring shutter 54 are closed. The developer in the developing apparatus 40 is transferred in the direction of an arrow F and an arrow G in the drawing, and thereby circulated through the developing apparatus 40.

When the development operation ends and a shift is performed from a normal development operation to a non-development period, the supply shutter 51 is closed to close the supply opening portion 55, and the first stirring shutter 53 and second stirring shutter 54 are opened to open the first stirring opening portion 57 and second stirring opening portion 58. By closing the supply opening portion 55, the developer flows through the open second stirring opening portion 58 into the second stirring conveyance passage 237 after reaching the conveyance direction downstream end of the first stirring conveyance screw 233. After flowing into the second stirring conveyance passage 237, the developer is conveyed in the direction of an arrow H in the drawing while being stirred by the second stirring conveyance screw 234.

Once a certain fixed time (for example, the time required for the developer to reach the conveyance direction downstream end of the second stirring conveyance screw 234 after flowing into the second stirring conveyance passage 237) has elapsed after the supply shutter 51 is closed, the collection shutter 52 is closed. Having reached the conveyance direction downstream end of the second stirring conveyance screw 234, the developer is transferred from the second stirring conveyance passage 237 to the first stirring conveyance passage 236 and circulates between the first stirring conveyance passage 236 and second stirring conveyance passage 237. At this time, no developer exists in the supply collection conveyance passage 235, and therefore no developer is drawn up to the developing roller 131. Note that the developer does not have to be removed from the supply collection conveyance passage 235 completely.

To return to the normal development operation from the non-development period, first the supply shutter 51 and collection shutter 52 are opened, and then the second stirring shutter 54 is closed. Once a fixed time (the time required to remove the developer from the second stirring conveyance passage 237) has elapsed, the first stirring shutter 53 is closed, thereby returning the developing apparatus 40 to the state shown in FIG. 8A for performing a normal development operation.

When returning to the state for performing a normal development operation after the developer in the developing apparatus 40 has not been used and the developing apparatus 40 has been left inoperative for a long time, the developing apparatus 40 is driven for a predetermined time period with the supply shutter 51 and collection shutter 52 closed. After driving the developing apparatus 40 for the predetermined time period, the supply shutter 51 and collection shutter 52 are opened, and the second stirring shutter 54 is closed. In so doing, the developer can be transferred to the supply collection conveyance passage 235 after the toner charge of the developer, which contains toner having a reduced charge due to being left for a long time, has been raised. By performing this operation, the existence of charge-deficient toner in the supply collection conveyance passage 235 serving as the developing unit can be suppressed, and charge-deficient toner scattering through gaps in the developing roller 131 can be suppressed.

Further, during the non-development period, substantially no developer is present in the supply collection conveyance passage 235 serving as the developing unit, and therefore developer is not drawn up to the developing roller 131. As a result, the developer can be prevented from being subjected to the unnecessary stress that is applied when the developer passes through the doctor gap.

Note that in the developing apparatus 40 of the second embodiment, replenishment toner is supplied to the first stirring conveyance passage 236 on the periphery of the conveyance direction upstream end of the first stirring conveyance screw 233. The replenishment toner supplied to the periphery of the conveyance direction upstream end of the first stirring conveyance screw 233 is mixed with the magnetic carrier and charged while being conveyed through the first stirring conveyance passage 236 in the direction of the arrow G in the drawing.

When a large amount of replenishment toner is to be supplied to the first stirring conveyance passage 236, the supply shutter 51 is closed to halt developer transfer from the first stirring conveyance passage 236 to the supply collection conveyance passage 235, and in this state, the first stirring conveyance screw 233 is rotated. When a time period corresponding to the toner replenishment amount has elapsed, the supply shutter 51 is opened such that developer transfer from the first stirring conveyance passage 236 to the supply collection conveyance passage 235 is resumed. Thus, even when a large amount of replenishment toner is supplied, the developer can be transferred to the supply collection conveyance passage 235 serving as the developing unit after the toner has been stirred sufficiently. As a result, toner scattering occurring when charge-deficient toner is transferred to the developing unit after a large amount of replenishment toner has been supplied can be prevented. Note that when a large amount of replenishment toner is to be supplied, the first stirring shutter 53 and second stirring shutter 54 may be opened if necessary such that the developer is stirred by the first stirring conveyance screw 233 and the second stirring conveyance screw 234.

Note that when the developing unit and stirring unit are provided integrally, as in the developing apparatus 40 of the second embodiment, replacement of the developing apparatus 40 is easy.

According to the developing apparatus 40 of the second embodiment described above, the supply collection conveyance passage 235 serving as the developing unit and the first stirring conveyance passage 236 and second stirring conveyance passage 237 serving as the stirring unit are provided, and when the development operation ends, the developer in the supply collection conveyance passage 235 is transferred to the first stirring conveyance passage 236 and second stirring conveyance passage 237, which serve as a developer storage unit external to the supply collection conveyance passage 235, such that substantially no developer exists in the supply collection conveyance passage 235. Thus, the existence of charge-deficient toner, including uncharged toner, in the supply collection conveyance passage 235 can be suppressed, and toner scattering caused by the existence of charge-deficient toner in the supply collection conveyance passage 235 can be suppressed. Hence, toner scattering that may occur when the development operation is halted for a long time can be suppressed, and as a result, contamination of the apparatus interior can be suppressed.

Further, the developing apparatus 40 of the second embodiment is capable of stirring the developer in the first stirring conveyance passage 236 using the first stirring conveyance screw 233 serving as the stirring means while developer transfer from the first stirring conveyance passage 236, which serves as the stirring unit, to the supply collection conveyance passage 235, which serves as the developing unit, is halted, and therefore when a large amount of replenishment toner is supplied to the first stirring conveyance passage 236, the developer in the first stirring conveyance passage 236 is stirred using the first stirring conveyance screw 233 while developer transfer from the first stirring conveyance passage 236 to the supply collection conveyance passage 235 is halted. In so doing, the developer can be transferred from the first stirring conveyance passage 236 to the supply collection conveyance passage 235 after being stirred sufficiently in the first stirring conveyance passage 236. Hence, toner scattering occurring when developer containing charge-deficient toner is transferred to the supply collection conveyance passage 235 after a large amount of replenishment toner has been supplied can be suppressed. As a result, contamination of the apparatus interior due to charge-deficient toner scattering, which occurs easily after a large amount of replenishment toner has been supplied, can be prevented.

Further, with the developing apparatus 40, in which the supply collection conveyance passage 235 serving as the developing unit and the first stirring conveyance passage 236 and second stirring conveyance passage 237 serving as the stirring unit are provided integrally, replacement of the developing apparatus 40 is easy.

Third Embodiment

Next, a third embodiment will be described. Note, however, that FIGS. 1 to 5 and the description of the first embodiment referencing these drawings are all substantially applied to this embodiment, and therefore redundant description has been omitted, and only features of the third embodiment that differ from the first embodiment will be described.

First, the developer of the third embodiment is a two-component developer constituted by a toner having a particle diameter between 4 and 10 [μm] (volume average particle diameter), and a carrier having a particle diameter between 15 and 60 [μm] (average particle diameter, microtrack). The toner concentration depends on the size selection, but a concentration of approximately 3.5 to 10[%] is usable. The developing apparatus 40 uses a developer having a toner particle diameter of 7 [μm], a carrier particle diameter of 35 [μm], and a toner concentration of 7[%].

Figure 9:
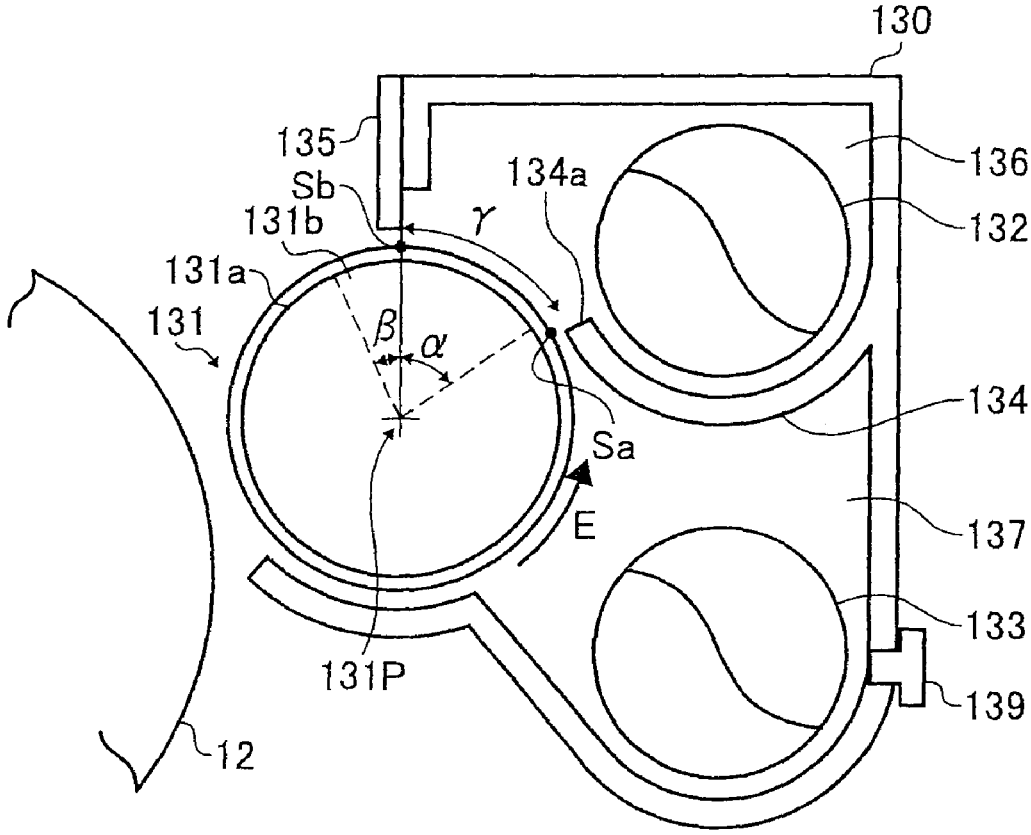
FIG. 9 is a sectional view showing the schematic constitution of a developing machine in a developing apparatus according to a third embodiment of the present invention, seen from the direction of the arrow A in FIG. 2.

FIG. 9 shows the schematic constitution of the developing machine 130 according to the third embodiment, seen from the direction of the arrow A in FIG. 2. As described above, the developing machine 130 comprises the developing roller 131 serving as the developer carrier, and the supply conveyance screw 132 serving as the developer supply conveyance member for supplying the developer to the developing roller 131 while conveying the developer in the direction of the arrow C in FIG. 4. Note that the developing roller 131 is constituted by a magnet roller 131*b* comprising a plurality of magnets serving as electric field generating means, to be described in detail below, and a non-magnetic sleeve 131*a* provided rotatably on the outer side of the magnet roller 131*b*. The developing machine 130 also comprises the collection conveyance screw 133 serving as the developer collection conveyance member for collecting the developer from the surface of the developing roller 131 after the developer has been supplied to the developing roller 131 and has passed through the development area, and conveying the developer in the direction of the arrow D in FIG. 4. The supply conveyance screw 132 and the collection conveyance screw 133 serve as developing unit conveyance members for conveying the developer through the developing machine 130 serving as the developing unit. These developing unit conveyance members are formed by coiling a spline in a spiral shape around a spindle. The diameter of the spline is $\phi$=18 [mm], and the spiral pitch is 27 [mm].

The developing roller 131 holds the developer in the supply conveyance passage 136 on its surface using the magnetic force of the magnet roller 131*b* disposed in the interior thereof and frictional force between the surface of the sleeve 131*a* and the developer, while performing a surface motion in the direction of an arrow E in FIG. 9. Further, the developer in the supply conveyance passage 136 is supplied to the surface of the developing roller 131 from a partition wall end portion 134*a*, i.e. the tip end of the partition wall 134 opposing the developing roller 131.

Next, the features of the developing machine 130 serving as the developing unit of the third embodiment will be described in further detail using FIG. 9.

As shown in FIG. 9, the developing machine 130 comprises the developing roller 131, which serves as a developer carrier disposed in the vicinity of, and opposing, the photosensitive body 12 serving as a latent image carrier, and the doctor blade 135, which serves as a developer amount restricting member disposed in a position removed from the surface of the developing roller 131 by a gap. The developing roller 131 serving as the developer carrier is constituted by the magnet roller 131*b*, which comprises a plurality of magnets serving as the electric field generating means fixed in the interior thereof, and the non-magnetic sleeve 131*a* provided rotatably on the periphery of the magnet roller 131*b*. The sleeve 131*a* is driven by driving means, not shown in the drawing, to rotate in the direction of the arrow E in the drawing. When the developer in the supply conveyance passage 136 is supplied to the surface of the sleeve 131*a* of the developing roller 131, the developer is conveyed in the direction of the arrow E together with the sleeve 131*a*, and development is performed in the development area, i.e. the portion opposing the photosensitive body 12, by supplying toner to a latent image formed on the photosensitive body 12.

In the developing machine 130 of the third embodiment, a low magnetic flux density area $\gamma$ is formed in accordance with the magnetic pole arrangement of the magnet roller 131*b* further toward the surface motion direction upstream side of the developing roller 131 than a position in which the surface of the developing roller 131 faces the doctor blade 135. The low magnetic flux density area $\gamma$ is an area in which the normal direction magnetic flux density on the surface of the developing roller 131 is low. Thus, the connection between the magnetic carriers of the developer carried on the surface of the developing roller 131 in the position opposing the doctor blade 135, and the area on the upstream side of this position in the surface motion direction of the developing roller 131, can be weakened.

Hence, when the developer passes through the doctor gap, which is the gap between the doctor blade 135 and the surface of the developing roller 131, the inter-carrier connection of the developer is weak, and even if the developer in a higher position than the doctor gap contacts the doctor blade 135, the developer moves easily in accordance with the shape of the doctor blade 135. Thus, rubbing of the developer with a high degree of stress at the doctor gap can be suppressed. As a result, deterioration of the developer can be suppressed, and the life of the developer can be extended.

As shown in FIG. 9, the doctor blade 135 faces the surface of the developing roller 131 above a developing roller center point 131P, which serves as the rotary center of the sleeve 131*a*, in a vertical direction. In this position, the frictional force generated between the developer and the surface of the developing roller 131 by the weight of the developer helps to carry the developer on the surface of the developing roller 131, and therefore the magnetic force required to carry and convey the developer can be reduced. In particular, the doctor blade 135 faces the uppermost peripheral portion of the surface of the developing roller 131, as shown in FIG. 9, and therefore the frictional force generated by the weight of the developer increases, enabling a further reduction in the magnetic force required to carry and convey the developer.

Further, the width of the doctor gap, which is the gap between the doctor blade 135 and the developing roller surface, is between 0.3 [mm] and 1.0 [mm], and in the developing apparatus 40 of the third embodiment, the width of the doctor gap is set at 0.5 [mm].

In a conventional developing apparatus, the normal direction magnetic flux density on the developer carrier surface is set high in the area on the upstream side of the developer amount restricting member in the surface motion direction of the developer carrier, which in FIG. 9 is illustrated as the low magnetic flux density area γ. The reasons for this are as follows.

With a two-component developer using a magnetic brush development method, the developer on the developer carrier is set at a suitable conveyance amount for development by setting the size of the gap between the developer carrier and the developer amount restricting member appropriately. The toner in the developer on the developer carrier, which has been restricted to a suitable amount for development, is adhered to the electrostatic latent image on the photosensitive body by applying a development voltage, and thus an image is formed.

In this case, when charge-deficient toner, i.e. insufficiently charged toner, is used in the development, toner scattering occurs such that the charge-deficient toner contained in the developer carried on the developer carrier scatters. The reason for this is that the charge-deficient toner that has not been sufficiently charged has poor adsorbability relative to the magnetic carrier, and therefore separates from the magnetic carrier and scatters easily. When toner scattering occurs, problems such as contamination of the apparatus interior and surface staining of the image arise. Hence, the toner charge must be adjusted to ensure that an appropriate amount of toner adheres to the electrostatic latent image.

When a two-component developer is used, the toner is typically charged by a method employing frictional charging between the toner and carrier. More specifically, in the developing apparatus, the toner and carrier are mixed in advance in predetermined amounts inside a conveyance passage for conveying the developer, whereupon the developer is conveyed while being stirred.

During stirring in a conventional developing apparatus, which is performed until the developer is supplied to the developer carrier, it may be impossible to raise the toner charge sufficiently depending on conditions such as the image area ratio of the output chart (the continuous passage of sheets having a high image area being most unfavorable) and the use environment.

The reason for this is that an auger or screw serving as a conventional developer conveyance member for stirring and conveying the developer has a shape that is suitable for conveying the developer, but cannot be said to exhibit a sufficient stirring function, and therefore, under unfavorable stirring conditions, for example, it may be impossible to stir the toner until the toner is sufficiently charged. Further, in some developing apparatuses, when replenishment toner is supplied to the developer after the developer passes through the development area such that toner is consumed, the developer is returned to the developer supply unit without undergoing a stirring process, and hence it may also be impossible in these developing apparatuses to raise the toner charge sufficiently before the developer is supplied to the developer carrier.

By increasing the stress received when surplus developer is scraped away by the developer amount restricting member after the developer is drawn onto the developing roller, intense friction is applied between the toner and carrier, and the frictional charging produced at this time raises the toner charge to a suitable charge for development. To increase the stress received by the developer at the developer amount restricting member, the normal direction magnetic flux density on the developer carrier surface in the area on the upstream side of the developer amount restricting member in the developer carrier surface motion direction is set high, and as a result, the developer is rubbed with a high degree of stress. By increasing the stress received from the developer amount restricting member in this manner, the charge of the toner particles can be raised to a suitable state for development. When the toner charge is adjusted to a suitable charge for development at all times, high quality image formation can be performed. In other words, in a conventional developing apparatus, the magnetic flux density in the area on the upstream side of the developer amount restricting member in the developer carrier surface motion direction is set high in order to raise the toner charge to a suitable charge for development.

In the developing apparatus 40 of the third embodiment, on the other hand, the low magnetic flux density area γ is formed on the upstream side of the position opposing the doctor blade 135 in the surface motion direction of the developing roller 131. In the developing apparatus 40, the developer is transferred to the developing machine 130 serving as the developing unit after being stirred sufficiently by the stirrer 140 serving as the stirring unit, and therefore the toner charge of the developer supplied to the surface of the developing roller 131 is set in a suitable state for development. Hence, there is no need to raise the toner charge using frictional charging at the opposing portion between the doctor blade 135 and the developing roller 131, and toner scattering caused by charge-deficient toner can be suppressed even when the low magnetic flux density area γ is formed on the developing roller 131.

Note that since the developer in the stirrer 140 of the developing apparatus 40 is conveyed under its own weight and the agitator 41 is provided for stirring the developer, the developer can be stirred more efficiently than in a case where a conventional stirring member doubling as conveyance means is provided. Also, at least half of the developer in the developing apparatus 40, specifically between 50[%] and 80[%] of all of the developer, is stored in the stirrer 140. It is desirable to secure sufficient stirring time so that the toner can be charged to the desired charge more reliably, but in a high-speed apparatus, the circulation speed of the developer through the developing apparatus is high, and hence it is difficult to secure the stirring time required to charge the toner sufficiently. The developing apparatus 40 solves this problem by increasing the volume of the stirrer 140 such that at least half of the developer in the developing apparatus is stored in the stirrer 140. Thus, the time required to stir the developer can be secured, and the toner charge can be raised more reliably.

Further, in the developing apparatus 40, the stirrer 140 is provided with the toner replenishment passage 141, which serves as toner replenishing means for providing the developer in the developing apparatus 40 with replenishment toner from the toner container 110. Accordingly, the developer containing the replenishment toner is transferred to the developing machine 130 after undergoing the stirring process in the stirrer 140, and therefore the developer can be transferred to the developing machine 130 after being charged to a suitable charge for development even when replenished with uncharged, unused toner. Moreover, in the developing apparatus 40, the developing machine 130 is provided with the collection conveyance passage 137, which serves as a developer collection unit for collecting developer that has been supplied to the developing roller 131 and has passed through the development area, and the collected developer collected in the collection conveyance passage 137 is transferred to the stirrer 140 through the second developer transfer pipe 150. When being stirred by the stirrer 140, the collected developer is mixed together with unused toner to adjust the decreased toner concentration, after which the developer is transferred to the developing machine 130 with a suitable toner concentration for development. Thus, image defects caused by variation in the toner concentration of the developer can be suppressed.

Furthermore, in some conventional developing apparatuses, replenishment toner is supplied using an auger or screw from the top of a conveyance passage for conveying the developer in a substantially horizontal direction. When replenishment toner is supplied in this manner, the replenishment toner may slide over the upper interface of the developer such that the uncharged replenishment toner is not mixed together with the carrier, and as a result, charge-deficient toner may be produced, leading to toner scattering. On the other hand, when the developer moves in a vertical direction under its own weight, as in the stirrer 140, the replenishment toner is less likely to slide over the interface of the developer than in a case where the developer only moves in a horizontal direction, and the defective charging caused by such surface sliding can be prevented.

When charging is performed at the doctor gap, which is the gap between the doctor blade 135 and the developing roller 131, charging is performed rapidly, and therefore a high degree of stress must be applied to the developer, leading to deterioration of the developer. In the stirrer 140, on the other hand, charging is performed over a long time period, and therefore the charge can be raised with low stress such that deterioration of the developer can be suppressed.

Note that when the volume of the stirring unit in the developing apparatus is increased to ensure that the toner is stirred sufficiently, as in the stirrer 140, the required charging time can be secured, but in a conventional developing apparatus in which the developing unit and stirring unit are provided integrally, this leads to an increase in the size of the developing apparatus, and hence an increase in the size of the machine main body.

In the developing apparatus 40, on the other hand, the developing machine 130 serving as the developing unit and the stirrer 140 serving as the stirring unit are provided separately, and the developing machine 130 and stirrer 140 are connected by the developer transfer pipes serving as the developer transfer passage-forming members, and hence this problem can be solved.

By providing the stirring unit separately to the developing unit and stirring the developer therewith, the developer can be supplied to the developing roller with the toner in a more reliably charged state. Furthermore, the developer circulation path is longer than that of a developing apparatus in which the developing unit and stirring unit are provided integrally, and therefore the toner and carrier have more opportunities to come into contact with each other, making charging defects less likely to occur in the toner. Further, by providing the developing unit and stirring unit separately, the stirring unit can be provided at a remove from the developing unit, and therefore the space for providing the developing unit can be made smaller than that of a developing apparatus in which the developing unit and stirring unit are provided integrally. As a result, the layout freedom of the entire image forming apparatus can be increased, and the size of the apparatus main body of the copier 100 can be reduced. Furthermore, even though the stirrer 140 is increased in size, the apparatus main body of the copier 100 can be reduced in size by providing the stirrer 140 in the dead space in the interior of the copier 100 or the like.

By performing stirring using the stirrer 140 in the manner described above, the developer can be transferred to the developing machine 130 after a sufficient charging performance has been applied thereto. Hence, even when the low magnetic flux density area γ, in which the magnetic flux density in the normal direction of the developer carrier surface is reduced, is provided in the area on the upstream side of the developer amount restricting member in the developer carrier surface motion direction in order to reduce the stress that is applied to the developer when the developer passes through the doctor gap, the toner charging performance can be secured, and long-term high quality image formation can be maintained.

Note that the developer stirring means provided in the stirrer 140 and the stirrer 140 are not limited to the constitutions described above, and may be constituted arbitrarily as long as the developer can be stirred sufficiently to ensure that the toner is charged to a state suitable for development.

Further, by providing the developing machine 130 and stirrer 140 separately, the disposal freedom of the stirrer 140 can be increased. As a result, the stirrer 140 can be disposed in a position that is unlikely to be affected by temperature and the outside air even if the developing machine 130 is disposed in a position that is likely to be affected by temperature and the outside air. Thus, deterioration and alteration of the developer due to temperature and the outside air can be suppressed.

Further, in some conventional developing apparatuses, the developer supply unit is provided beneath the developer carrier such that the developer is drawn up by the magnetic force of the magnets in the interior of the developer carrier. With a constitution in which the developer is drawn up by magnetic force, drawing defects may occur when the magnetic flux density in the normal direction on the developer carrier surface is reduced in the area on the upstream side of the developer amount restricting member in the developer carrier surface motion direction. When a drawing defect occurs in the developer, defects (an uneven image, for example) occur in the image quality.

In the developing apparatus 40 of the third embodiment, on the other hand, a developer supply position Sa opposing the partition wall end portion 134*a*, in which the supply conveyance passage 136 serving as the developer supply unit supplies the developer to the surface of the developing roller 131, is higher than the center point of the developing roller 131 in the vertical direction. Hence, the frictional force generated between the developer and the surface of the developing roller 131 by the weight of the developer helps to carry the developer on the surface of the developing roller 131, and therefore the magnetic force required to carry and convey the developer supplied from the supply conveyance passage 136 can be reduced. As a result, drawing defects can be suppressed even when the magnetic flux density in the normal direction of the developer carrier surface is reduced in the area on the upstream side of the developer amount restricting member in the developer carrier surface motion direction. Note that in the developing machine 130 shown in FIG. 3, the frictional force generated by the weight of the developer can be increased by reducing the angle of a restricting member upstream side central angle α of the developer supply position Sa, and in so doing, the frictional force required to carry and convey the developer can be reduced further.

Next, examples of the magnetic pole arrangement of the magnet roller 131*b* for forming the low magnetic flux density area will be described. Note that in each example, a position opposing the doctor blade 135 on the surface of the developing roller 131 will be referred to as a restricting member opposing position Sb, and a position opposing the partition wall end portion 134*a* will be referred to as the developer supply position Sa, as shown in FIG. 9. Further, a central angle at the developing roller center point 131P, which is the rotary center of the sleeve 131*a*, between a position further toward the upstream side of the surface motion direction of the developing roller 131 than the restricting member opposing position Sb and the restricting member opposing position Sb will be referred to as the restricting member upstream side central angle α. Further, a central angle at the developing roller center point 131P between a position further toward the downstream side of the surface motion direction of the developing roller 131 than the restricting member opposing position Sb and the restricting member opposing position Sb will be referred to as a restricting member downstream side central angle β.

First Example

Figure 10:
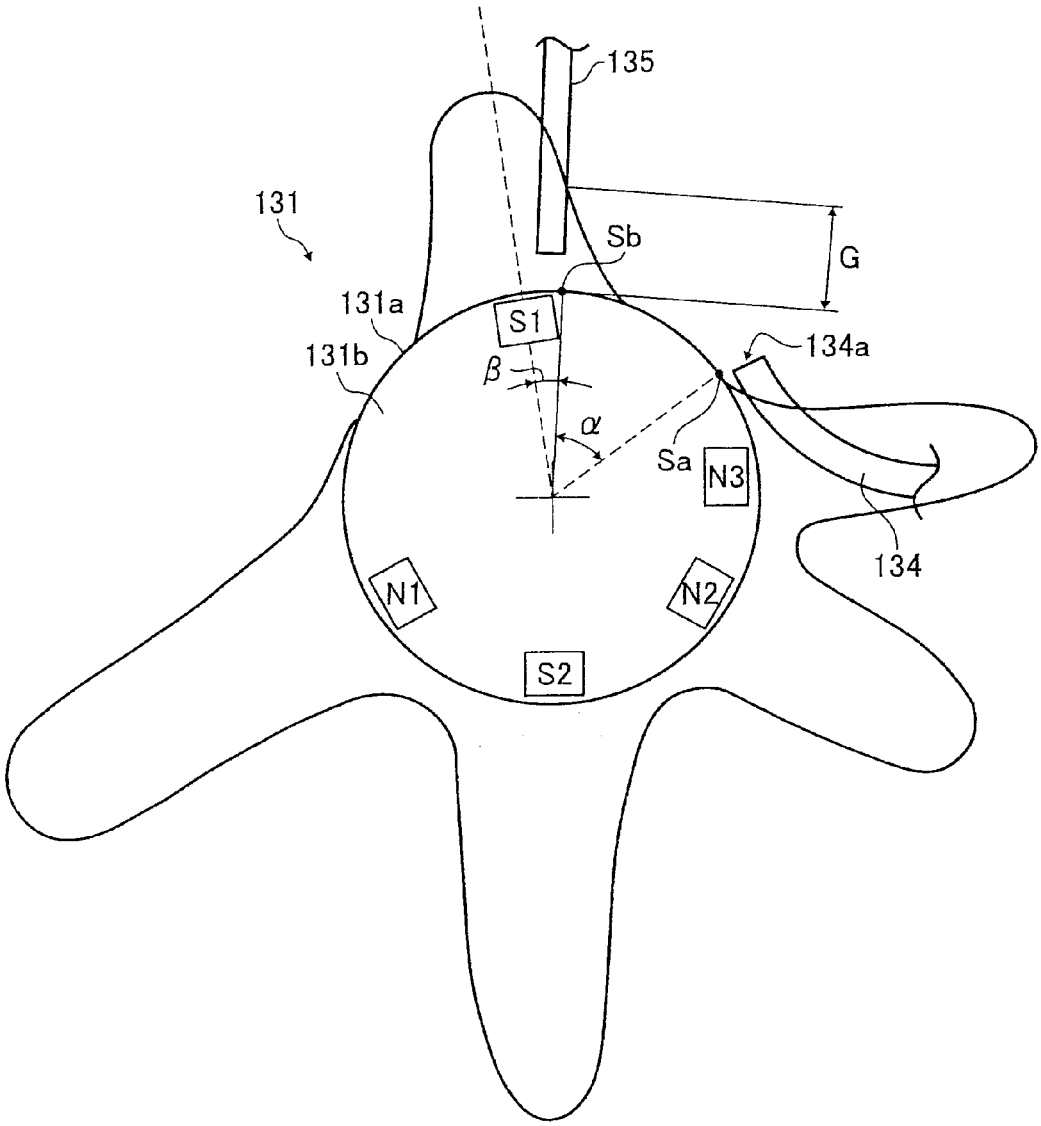
FIG. 10 is a view illustrating a magnetic pole arrangement in a magnet roller according to a first example of the third embodiment.

FIG. 10 is a view showing the schematic constitution of a first example of a magnetic pole arrangement in the magnet roller 131*b* of the developing roller 131, which may be applied to the developing apparatus 40 of the third embodiment.

As shown in FIG. 10, the magnet roller 131*b* of the first example is fixed and comprises an S1 pole, an N1 pole, an S2 pole, an N2 pole, and an N3 pole, and the sleeve is provided so as to be free to rotate. The maximum value of the normal direction magnetic flux density of the respective magnetic poles on the surface of the developing roller 131 are as follows: S1 pole 60 [mT], N1 pole 120 [mT], S2 pole 120 [mT], N2 pole 80 [mT], and N3 pole 80 [mT]. As regards the curves in positions opposing the respective magnetic poles in FIG. 10, the distance from each curve to the surface of the sleeve 131*a* indicates the magnitude of the normal direction magnetic flux density on the surface of the sleeve 131*a*.

The developer amount restricting member 135 is a doctor blade or the like disposed at a remove from the developing sleeve surface with a gap therebetween, for example. As shown in FIG. 10, the developer amount restricting member 135 is disposed between the S1 pole and the N3 pole. Further, the N3 pole is disposed such that the magnetic force thereof does not affect the area on the surface of the developing roller 131 on the downstream side of the developer supply position Sa in the surface motion direction.

The developer is supplied under its own weight from the partition wall end portion 134*a* to the developer supply position Sa on the surface of the developing roller 131, and is held on the developing roller 131 by frictional force that is generated between the developer and the surface of the developing roller 131 by its own weight. In this example, the developer supply position Sa is located on the surface of the developing roller 131 on a straight line linking the center of the developing roller 131 and the partition wall end portion 134*a*. As the sleeve 131*a* rotates, the developer is conveyed on the developing roller 131 to the restricting member opposing position Sb opposing the doctor blade 135. By passing through the doctor gap, which is the gap between the developing roller 131 and the doctor blade 135 in the restricting member opposing position Sb, the developer on the surface of the developing roller 131 is leveled to a thin layer. After the developer passes through the doctor gap, the S1 pole conveys the developer to a development nip area, and at the N1 pole, development is performed onto the photosensitive body 12. Following development, the developer is conveyed by the magnetic force of the S2 pole, whereupon the repulsive magnetic force of the N2 pole and N3 pole serves to peel the developer away from the developing roller 131.

In the first example, the low magnetic flux density area γ, in which no magnetic poles are disposed on the inner side of the sleeve 131*a*, is set within a range of no less than 0 [°] and no more than 60 [°] in terms of the restricting member upstream side central angle α. Also in the first example, the developing roller 131 and partition wall 134 are disposed such that the partition wall end portion 134*a* is disposed at 60 [°] in terms of the restricting member upstream side central angle α of the developer supply position Sa. In other words, no magnetic poles serving as magnetic field generating means are disposed in the interior of the sleeve 131*a* within a range extending from the downstream side of the developer supply position Sa in the surface motion direction of the developing roller 131 to the upstream side of the restricting member opposing position Sb in the surface motion direction of the developing roller 131.

Also in the first example, the normal direction magnetic flux density on the surface of the developing roller 131 in the low magnetic flux density area γ is set at no less than 0 [mT] and no more than 30 [mT]. More specifically, the restricting member downstream side central angle β of the S1 pole, which is the closest pole to the restricting member on the downstream side of the restricting member, and the magnetic force of the S1 pole are adjusted such that a maximum value G of the normal direction magnetic flux density within the low magnetic flux density area γ, i.e. the magnetic flux density generated by the magnetic field of the S1 pole in the restricting member opposing position Sb, is no more than 30 [mT].

In the low magnetic flux density area γ, the developer supplied to the developing roller 131 is little affected by normal direction magnetic force from the magnet roller 131*b*, and the inter-carrier connection is weak. Therefore, the developer passes through the doctor gap so as to be leveled to a thin layer without receiving excessive stress. As a result, deterioration of the developer is suppressed, and long-term high image quality can be maintained.

Figure 11:
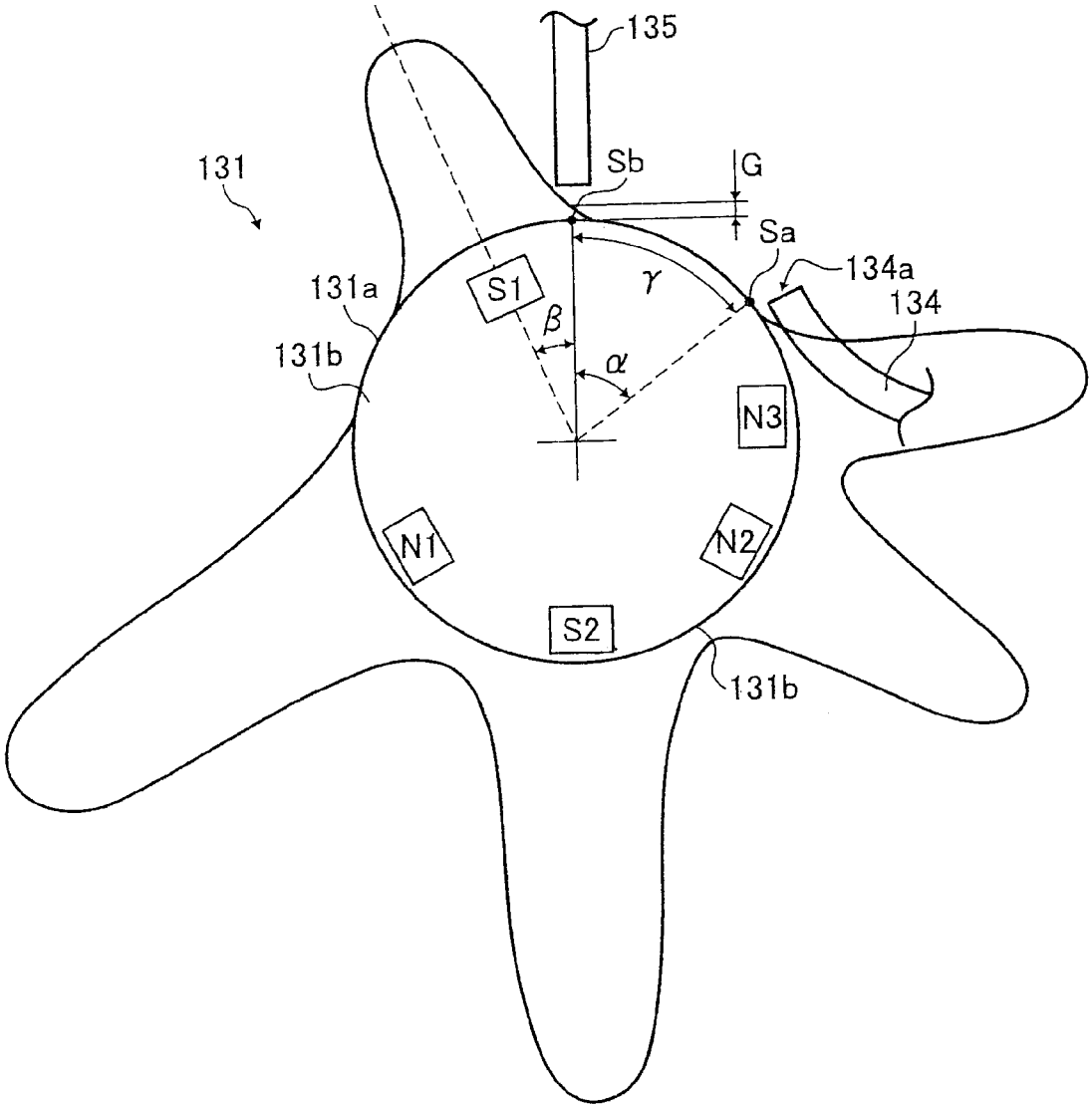
FIG. 11 is a view illustrating a more preferable magnetic pole arrangement in the magnet roller according to the first example of the third embodiment.

The value of the normal direction magnetic flux density in the low magnetic flux density area γ is preferably as small as possible. When the magnetic force of the S1 pole is not modified, the value of the restricting member downstream side central angle β of the S1 pole is increased, and the S1 pole is disposed such that the magnetic force of the S1 pole does not affect the low magnetic flux density area γ, as shown in FIG. 11. At this time, the S1 pole is disposed such that the maximum value G of the normal direction magnetic flux density generated by the magnetic field of the S1 pole in the restricting member opposing position Sb is no greater than 5 [mT], and thus the stress received by the developer when passing through the doctor gap can be reduced even further.

As will be described below using FIG. 13, the low magnetic flux density area γ may be formed by disposing the N3 pole on the inner side of the sleeve 131*a* within a range of no less than 0 [°] and no more than 60 [°] in terms of the restricting member upstream side central angle α, and using a magnet having a weak magnetic force as the N3 pole. However, it is difficult to keep the maximum value G of the normal direction magnetic flux density in the low magnetic flux density area γ within 5 [mT] when the N3 pole is disposed therein. Hence, to keep the maximum value G of the normal direction magnetic flux density within 5 [mT], the low magnetic flux density area γ is preferably formed with no magnetic poles on the inner side of the sleeve 131*a*.

More preferably, the maximum value of the normal direction magnetic flux density in the low magnetic flux density area γ should be made substantially zero such that the developer is not held on the surface of the developing roller 131 by magnetic force. In this case, the supplied developer is passed through the doctor gap by the rotary conveyance force of the sleeve 131*a* and a weak magnetic force drawn from the S1 pole, and then conveyed to the development area by the magnetic force generated by the S1 pole.

In consideration of the ability to convey the developer after it passes through the doctor gap, the restricting member downstream side central angle β of the S1 pole is preferably no greater than 15 [°], and within this range, the normal direction magnetic flux density in the restricting member opposing position Sb is adjusted within 5 [mT].

The reason for this is as follows.

To convey the developer with a weak magnetic force when the restricting member downstream side central angle β of S1 exceeds 15 [°], the full width at half maximum of the S1 pole must be increased. In this case, the motion of the magnetic brush in the development area (the standing and lying motion of the magnetic brush corresponding to variation in the normal direction magnetic flux density depending on the position on the surface of the developing roller 131) increases, and hence it becomes more difficult to control toner scattering within the electric field, which is unfavorable for adhering the toner evenly to the image carrier. When the restricting member downstream side central angle β of S1 is within 15 [°], there is no need for this, and the toner can be adhered evenly to the image carrier. As a result, the toner is capable of realizing a faithful, high image quality on the latent image.

In the first example, the developing roller 131 and partition wall 134 are disposed such that the partition wall end portion 134*a* is disposed in a position where the restricting member upstream side central angle α of the developer supply position Sa is 60 [°]. Here, the conveyance of the developer can be stabilized by making the restricting member upstream side central angle α of the developer supply position Sa smaller, for example making the restricting member upstream side central angle α of the developer supply position Sa 45 [°] or less. The reason for this is that as the restricting member upstream side central angle α of the developer supply position Sa decreases, the tangent gradient of the surface of the developing roller 131 in the developer supply position Sa decreases, leading to an increase in the frictional force generated on the developing roller 131 by the weight of the developer immediately after the developer is supplied to the surface of the developing roller 131.

Note that in the low magnetic flux density area γ, which is the range in which the normal direction magnetic flux density reaches 30 [mT] or the range in which no magnetic pole is disposed in the interior of the sleeve 131*a* as the magnetic field generating means, the restricting member upstream side central angle α is preferably within a range of 0 [°] to 20 [°]. When the normal direction magnetic flux density on the conveyance direction upstream side of the doctor blade is sufficiently small, the developer can be conveyed without being retained even if the angle of the low magnetic flux density area γ is small, and even if the developer is retained, great stress is not applied thereto. By setting the low magnetic flux density area γ in a narrow range of 0 [°] to 20 [°], the developer is conveyed smoothly upon reception of the suction force of the weak magnetic force derived from the magnetic pole S1. Moreover, since the developer is accelerated by its own weight, the developer that falls from the supply conveyance passage 136 is conveyed easily by conveyance force in the rotary direction of the sleeve 131*a*.

First Comparative Example

Figure 12:
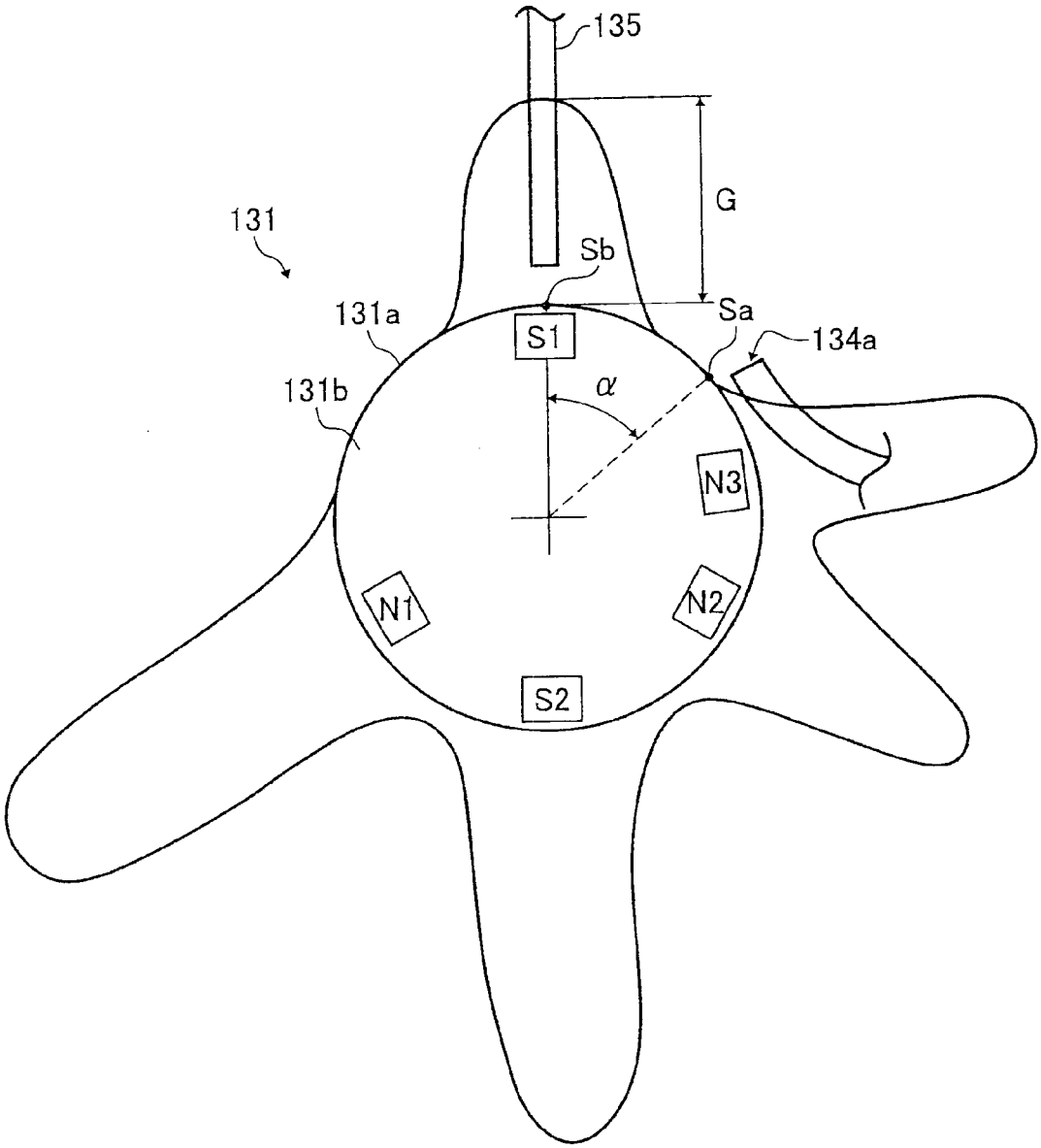
FIG. 12 is a view illustrating a magnetic pole arrangement in a magnet roller according to a first comparative example of the third embodiment.

FIG. 12 is a schematic illustrative view of a first comparative example of the magnetic pole arrangement in the magnet roller 131*b*. This magnetic pole arrangement is similar to that of the first example, but the restricting member downstream side central angle β of the S1 pole is set at 0 [°] as a comparative example 1.

As shown in FIG. 12, the arrangement is identical to that of the first example shown in FIG. 10 other than the position of S1. Since the restricting member downstream side central angle β of the S1 pole is set at 0 [°], the maximum value G of the normal direction magnetic flux density generated by the magnetic field of the S1 pole in the restricting member opposing position Sb takes a substantially identical value to 60 [mT], which is the maximum value of the normal direction magnetic flux density of the S1 pole. When the maximum value G of the normal direction magnetic flux density increases in this manner, the inter-carrier connection strengthens, and therefore excessive stress is applied to the developer as it passes through the doctor gap, accelerating deterioration of the developer.

Second Example

Figure 13:
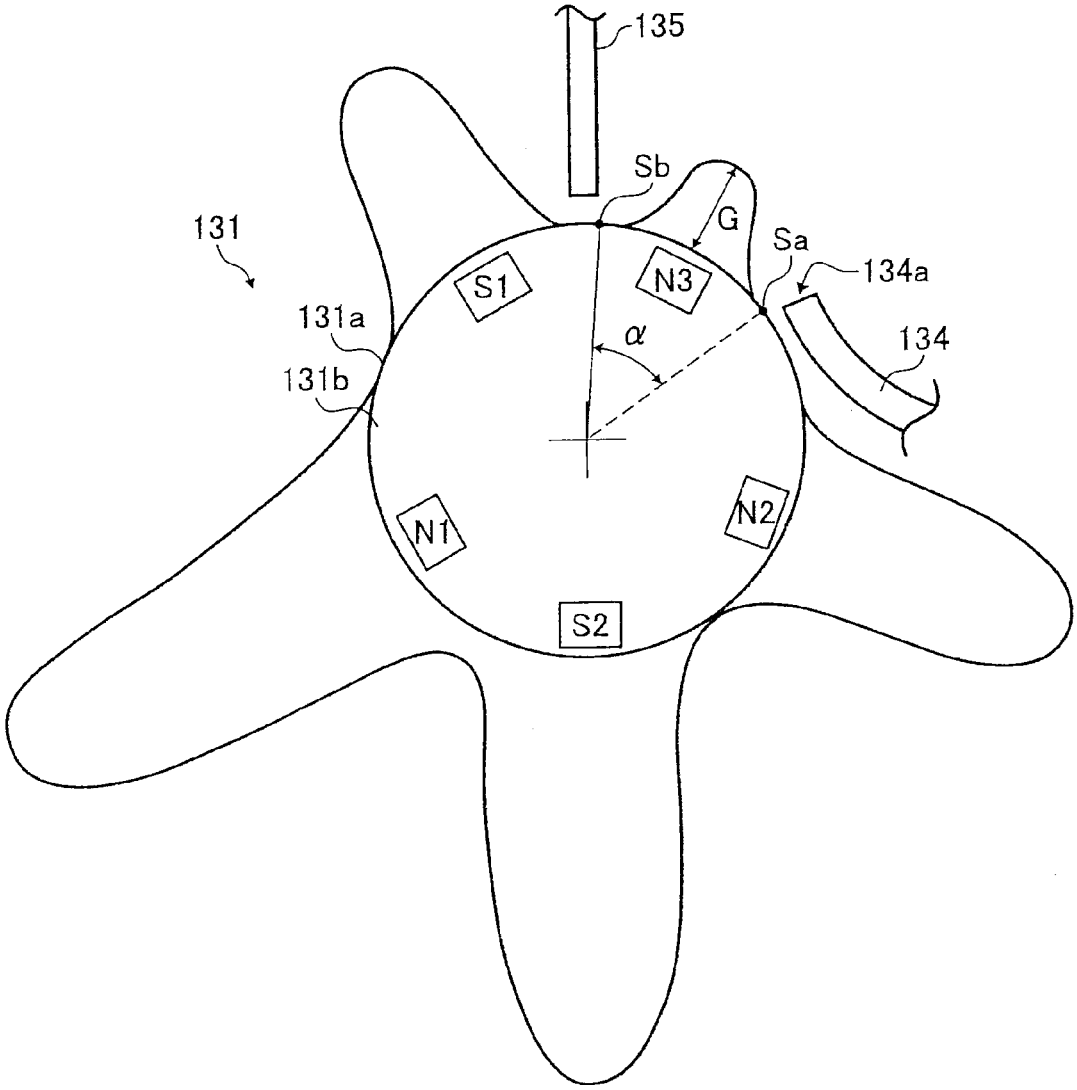
FIG. 13 is a view illustrating a magnetic pole arrangement in a magnet roller according to a second example of the third embodiment.

FIG. 13 is a schematic illustrative view of a second example of the magnetic pole arrangement in the magnet roller 131*b* of the developing roller 131, which may be applied to the developing apparatus 40 of the third embodiment.

Similarly to the first example described above, the magnet roller 131*b* of the second example is fixed and comprises an S1 pole, an N1 pole, an S2 pole, an N2 pole, and an N3 pole, and the sleeve 131*a* is provided so as to be free to rotate. The developer amount restricting member 135 is constituted by a doctor blade or the like disposed at a remove from the developing sleeve surface with a gap therebetween, for example. As shown in FIG. 13, the developer amount restricting member 135 is disposed between the S1 pole and the N3 pole.

The developer is held on the developing roller 131 by its own weight and the magnetic force of the N3 pole, and is conveyed on the surface of the developing roller 131 by the rotation of the sleeve 131*a* to the restricting member opposing position Sb, i.e. a position opposing the doctor blade 135. By passing through the doctor gap, which is the gap between the developing sleeve 131*a* and the doctor blade 135 at the restricting member opposing position Sb, the developer on the surface of the developing roller 131 is leveled to a thin layer. After passing through the doctor gap, the developer is conveyed to the development nip area by the S1 pole, and at the N1 pole, development onto the photosensitive body 12 is performed. Once development is complete, the developer is conveyed by the magnetic force of the S2 pole, whereupon the repulsive magnetic force of the N2 pole and N3 pole serves to peel the developer away from the developing sleeve.

In the second example, a range of 0 [°] to 60 [°] in terms of the restricting member upstream side central angle α is set as the low magnetic flux density area γ, in which the normal direction magnetic flux density value on the surface of the developing roller 131 is small. More specifically, the maximum value G of the normal direction magnetic flux density of the N3 pole, which serves as the magnetic field generating means provided in the sleeve 131*a* within a restricting member upstream side central angle α range of 0 [°] to 60 [°], is no more than 30 [mT]. Furthermore, in the second example, the developing roller 131 and partition wall 134 are disposed such that the partition wall end portion 134*a* is disposed in a position where the restricting member upstream side central angle α of the developer supply position Sa is 60 [°], similarly to the first example. In other words, the maximum value G of the normal direction magnetic flux density in a range extending from the downstream side of the developer supply position Sa in the surface motion direction of the developing roller 131 to the upstream side of the restricting member opposing position Sb in the surface motion direction of the developing roller 131 is no more than 30 [mT].

The developer supplied to the surface of the developing roller 131 is not held tightly on the developing sleeve and conveyed by the magnetic force of the N3 pole alone. In other words, the developer is carried on the developing roller 131 by the weak magnetic force generated by the N3 pole and the frictional force generated by its own weight in relation to the sleeve 131*a*, and is transferred to the magnetic force area of the S1 pole after passing through the doctor gap by a conveyance force generated as the sleeve 131*a* rotates.

In the second example, the magnetic force of the N3 pole has little effect on the developer as it passes the doctor blade, and therefore stress generated by compression as the developer passes through the doctor gap can be reduced. As a result, deterioration of the developer can be suppressed over the long term.

Second Comparative Example

Figure 14:
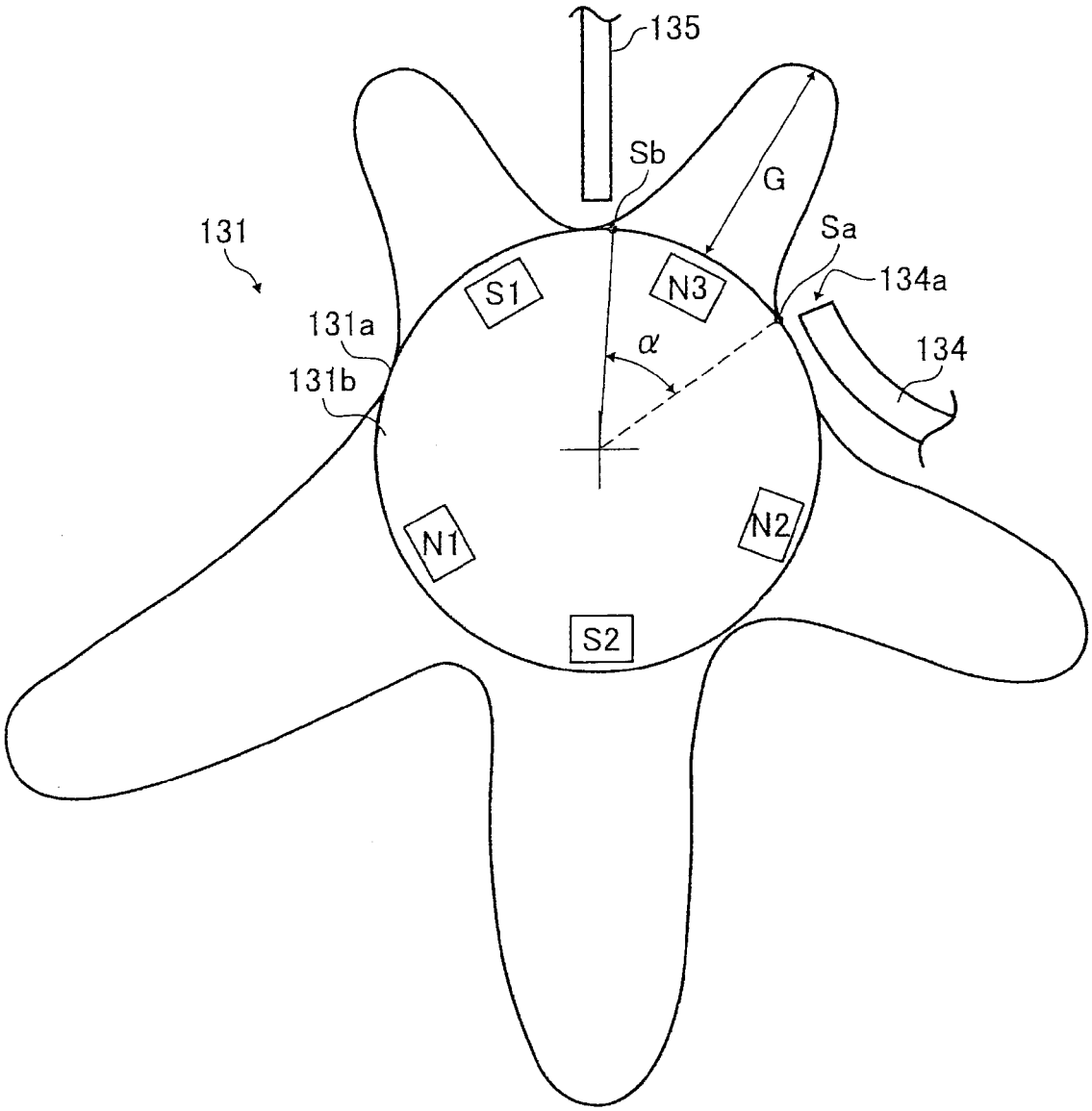
FIG. 14 is a view illustrating a magnetic pole arrangement in a magnet roller according to a second comparative example of the third embodiment.

FIG. 14 is a schematic illustrative view showing a second comparative example of the magnetic pole arrangement in the magnet roller 131*b*. This magnetic pole arrangement is similar to that of the second example, but the maximum value G of the normal direction magnetic flux density of the N3 pole is set at 60 [mT] as a comparative example 2.

In FIG. 14, the maximum value G of the normal direction magnetic flux density in a range of 0 [°] to 60 [°] in terms of the restricting member upstream side central angle α is 60 [mT]. Even within a restricting member upstream side central angle α range of 0 [°] to 20 [°], the maximum value of the normal direction magnetic flux density does not fall below 30 [mT].

Hence, the developer carried by the magnetic force of the N3 pole is retained on the upstream side before passing through the doctor gap such that when the developer passes through the doctor gap, the developer is compressed and subjected to great stress. Due to the application of long-term stress, the developer deteriorates. Hence, although high image quality can be maintained in the initial stage of use, charging deficiencies occur as time passes, leading to deterioration of the image quality.

Figure 15:
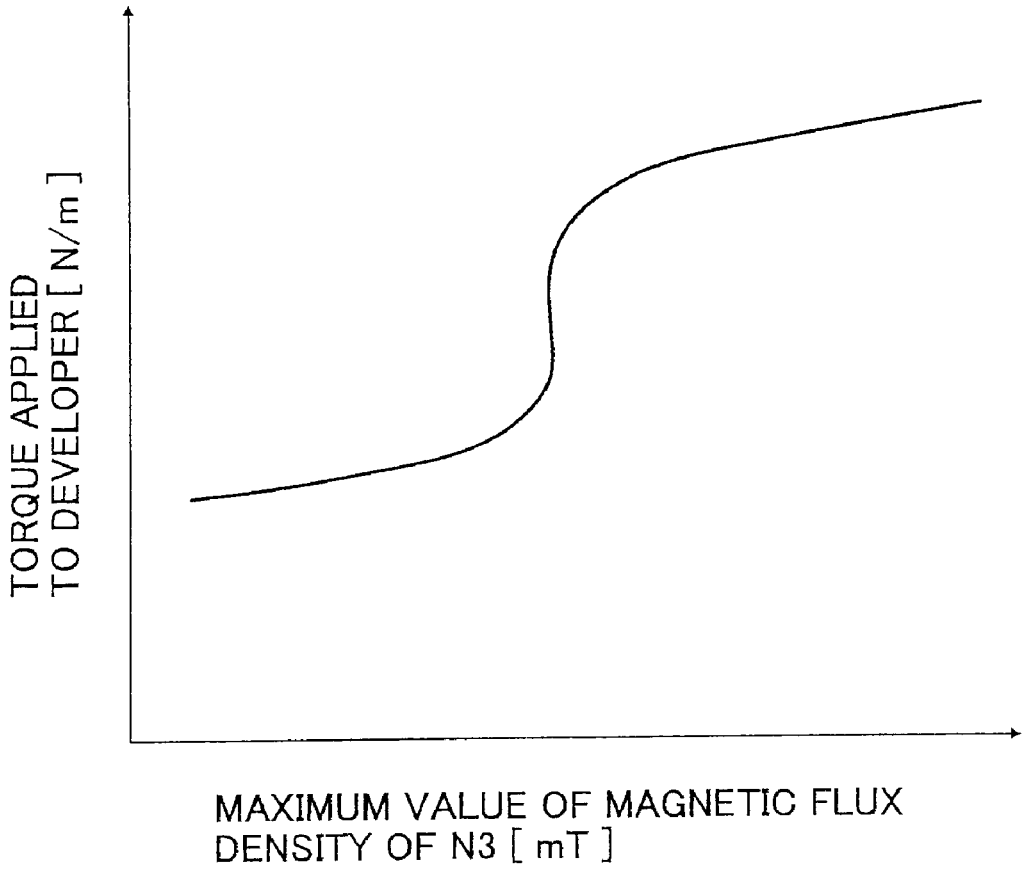
FIG. 15 is a graph showing the relationship between a maximum value of a normal direction magnetic flux density of an N3 pole, and torque applied to a developer.

FIG. 15 is a graph relating to a similar magnetic pole arrangement to that of the second example and second comparative example, which shows the relationship between the maximum value G [mT] of the normal direction magnetic flux density of the N3 pole and torque applied to the developer.

The maximum value G [mT] of the normal direction magnetic flux density of the N3 pole is the force applied to the developer carried on the sleeve 131*a* in the position of the N3 pole. A torque [N/m] applied to the developer is a value obtained by subtracting the torque of an empty unit containing no developer from the torque of the entire developing unit containing developer. It can be seen from FIG. 15 that when the maximum value G [mT] of the normal direction magnetic flux density of the N3 pole increases, the torque applied to the developer increases, leading to an increase in the stress that is applied to the developer. Hence, as the maximum value G [mT] of the normal direction magnetic flux density increases, deterioration of the developer advances.

Third Example

Figure 16:
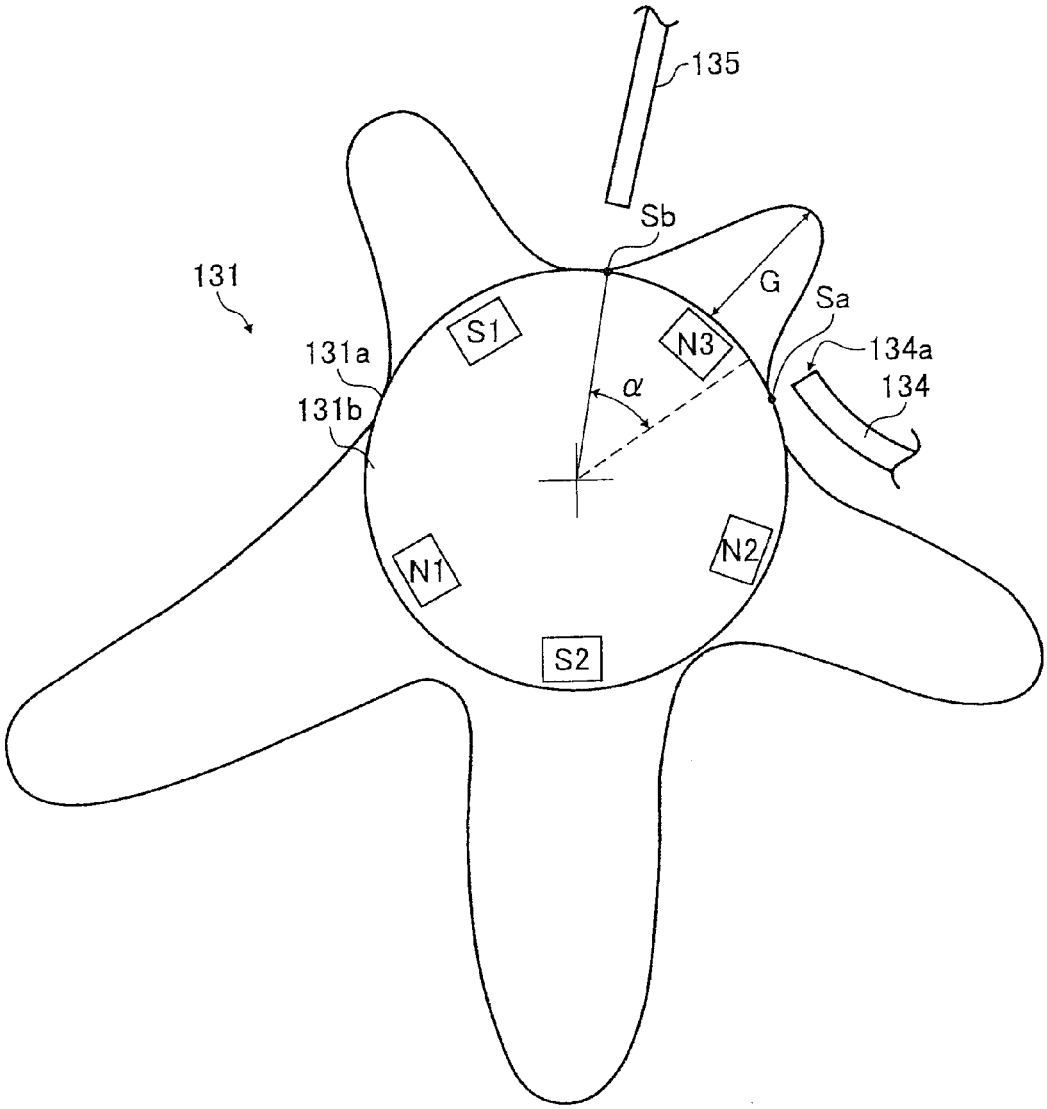
FIG. 16 is a view illustrating a magnetic pole arrangement in a magnet roller according to a third example of the third embodiment.

FIG. 16 is a schematic illustrative view of a third example of the magnetic pole arrangement in the magnet roller 131*b* of the developing roller 131, which may be applied to the developing apparatus 40 of the third embodiment.

In the developer 130 of the third example, the doctor blade 135 is provided in a lower position than in the second example, and the restricting member opposing position Sb and developer supply position Sa are also provided in lower positions than in the second example.

In the developing apparatus 40 of the third example, the developer must be drawn upward, and therefore the maximum value of the normal direction magnetic flux density of the N3 pole is set at 40 [mT], i.e. higher than that of the second example. The developer is carried on the surface of the developing roller 131 by the magnetic force of the N3 pole, and conveyed as the sleeve 131*a* rotates. The N3 pole is arranged, and the magnetic force generated thereby is set, such that the maximum value of the normal direction magnetic flux density thereof is 30 [mT] within a restricting member upstream side central angle α range of 0 [°] to 20 [°].

With the constitution of the third example, the amount of drawn-up developer increases in accordance with the increased magnetic force, and therefore more stress is applied to the developer than in the second example. However, in comparison with a developing apparatus in which a powerful magnetic holding force is applied to the developer, such as that of the first comparative example and second comparative example, the amount of stress that is applied to the developer can be reduced.

Third Comparative Example

In the third comparative example, the magnet roller 131*b* comprises a two-shaft screw, and the N2 pole of the magnetic pole arrangement described above in the second comparative example is changed to an S3 pole. This magnet roller 131*b* is then applied to a developing apparatus in which the developer supply unit is disposed below the developing roller.

Figure 17:
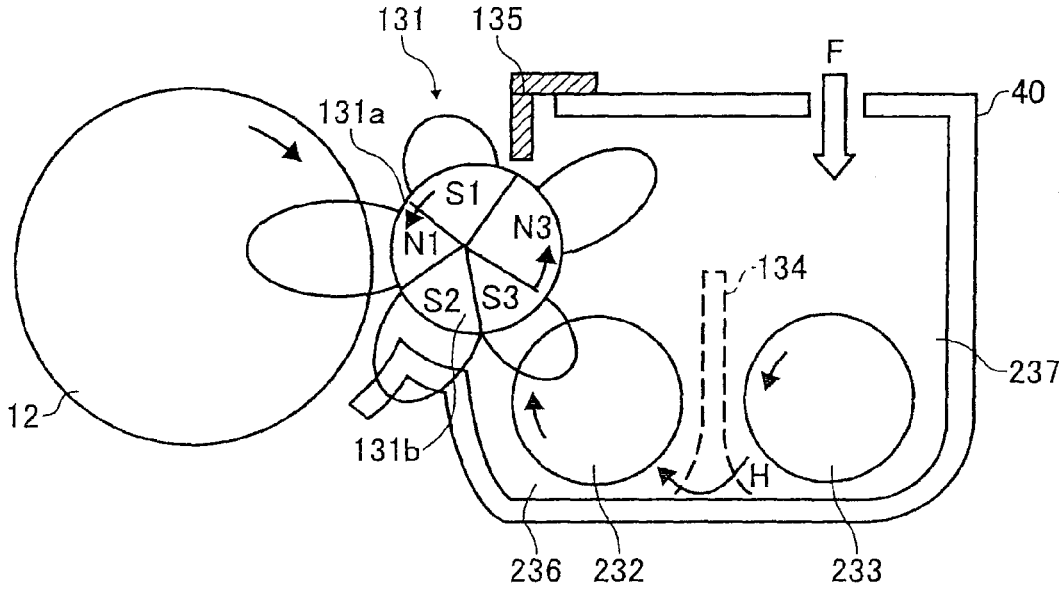
FIG. 17 is a view showing the schematic constitution of a developing apparatus according to a third comparative example of the third embodiment.

FIG. 17 is a schematic illustrative view of the developing apparatus 40 of the third comparative example. In the developing apparatus 40 of the third comparative example, the supply collection conveyance screw 232 and the stirring screw 233 are provided as the two-shaft screw. Further, the supply collection conveyance passage 236 comprising the supply collection conveyance screw 232 and the stirring conveyance passage 237 comprising the stirring conveyance screw 233 are partitioned by the partition wall 134.

In the developing apparatus 40 shown in FIG. 17, the developer in the supply collection conveyance passage 236 is supplied to the surface of the developing roller 131, and having passed through the development area, the developer is collected in the supply collection conveyance passage 236. After reaching the conveyance direction downstream side of the supply collection conveyance passage 236, the developer is transferred to the stirring conveyance passage 237, receives replenishment toner as shown by an arrow F in the drawing, and is conveyed and stirred by the stirring conveyance passage 237. After reaching the conveyance direction downstream side of the stirring conveyance passage 237, the developer is transferred back to the supply collection conveyance passage 236, as shown by an arrow H in the drawing.

In the magnet roller 131*b* provided in the interior of the developing roller 131, the S3 pole serves as a drawing magnetic pole, and once development is complete, the developer is conveyed by the magnetic force of the S2 pole, whereupon the repulsive magnetic force of the S2 pole and S3 pole serves to peel the developer away from the developing roller 131.

The developing apparatus 40 shown in FIG. 17 employs a known conventional two-shaft screw drawing method, and in order to draw the developer upward, the magnetic force of the S3 pole and N3 pole is set high. Hence, the developer forms a magnetic brush having a strong inter-carrier connection due to the large magnetic force of the N3 pole, and when this developer passes through the doctor gap, great stress is applied to the developer, thereby accelerating its deterioration and increasing the likelihood of a reduction in image quality over repeated, long-term printing. Furthermore, it is known that with this method, when the magnetic force of the N3 pole is reduced to weaken the stress applied to the developer, the developer is not drawn up correctly. As a result, density unevenness occurs in the lengthwise direction of the developing roller 131, and it becomes impossible to maintain an appropriate charge.

Next, the toner charge on the sleeve 131*a* serving as a developing sleeve and the toner charge in the stirring unit were compared in relation to the constitution of the first example shown in FIG. 11 and the third comparative example.

Figure 18A:
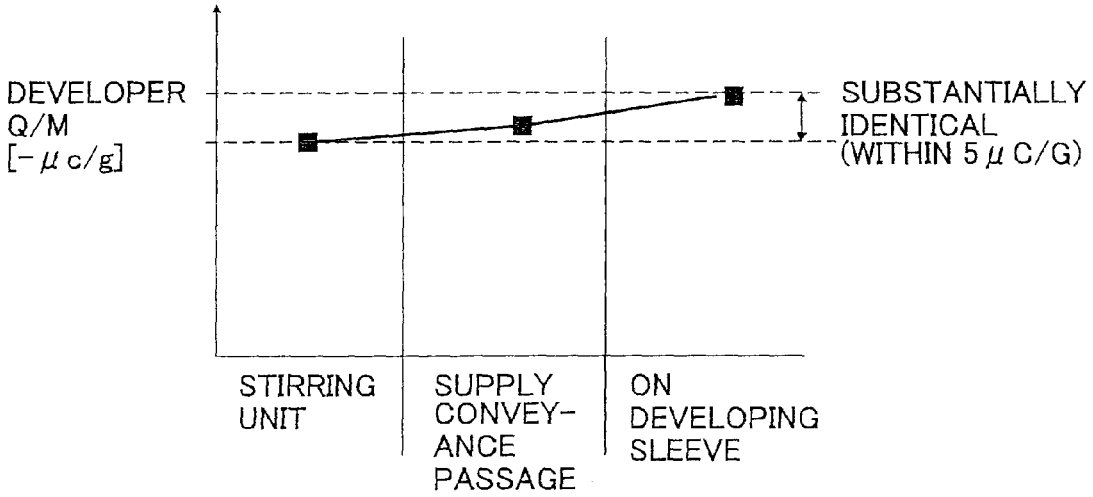
FIG. 18A is a graph showing the course of a toner charge in the developing apparatus of the first example in the course of the toner charge in each part of the developing apparatus.
Figure 18B:
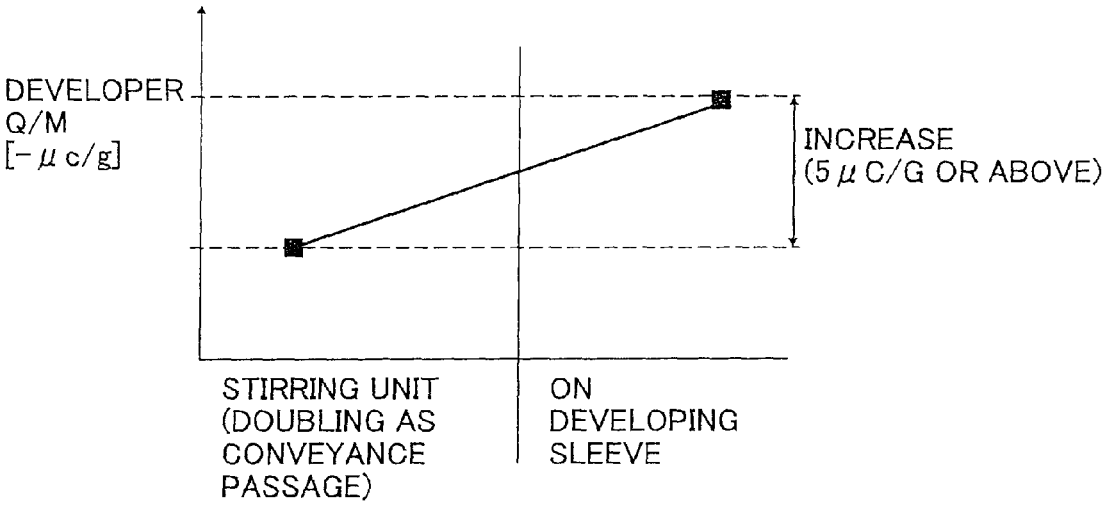
FIG. 18B is a graph showing the course of the toner charge in the developing apparatus of the third comparative example.

FIGS. 18A and 18B are graphs showing the course of the toner charge in each part of the developing apparatus, FIG. 18A showing the course of the toner charge in the developing apparatus of the first example, and FIG. 18B showing the course of the toner charge in the developing apparatus of the third comparative example.

In FIGS. 18A and 18B, Q/M on the ordinate shows the charge measured using a blow-off method after measuring out 1 [g] of developer. The measurement value in the stirring unit is the measurement value of the charge of the developer on the furthest downstream side of the stirring unit in the developer movement direction, or in other words the charge of the developer upon discharge from the stirring unit. The measurement value on the developing sleeve is the measurement value of the charge of the developer after passing through the doctor gap and reaching the development area.

The charges shown in FIGS. 18A and 18B are evaluations of the developer in its initial stage of use, and the measurement values were taken at a temperature of 23 [° C.] and a humidity of 50[%].

In the developing apparatus of the first example, shown in FIG. 18A, the value of Q/M in the stirring unit was 30 [−μC/g], and the value of Q/M on the developing sleeve was 35 [−μC/g]. Meanwhile, in the developing apparatus of the third comparative example, shown in FIG. 18B, the value of Q/M in the stirring unit was 18 [−μC/g], and the value of Q/M on the developing sleeve was 35 [−μC/g].

Note that in the blow-off method, 1 [g] of developer is measured onto a blow-off gauge covered in mesh having an aperture of 22 [μm], whereupon the developer is blown with air such that the toner in the developer separates from the carrier (the carrier remains on the mesh). The charge of the separated toner is then measured.

In the first example, when the developer is transferred from the stirrer 140 serving as the stirring unit to the developing roller 131 through the supply conveyance passage 136, a charge is applied to the developer by stirring the developer sufficiently in the stirrer 140, and therefore the charge Q/M of the developer is comparatively high. The charge Q/M of this developer is substantially identical to the charge Q/M of the developer in the supply conveyance passage 136 and the developer on the surface of the developing roller 131. More specifically, the rate of change in the toner charge after being supplied from the stirrer 140 to the supply conveyance passage 136 is held within 5 [−μC/g].

Note that a certain amount of stress is also applied in the stirring unit by the stirring that is performed by the stirring means, constituted by the agitator, screws, and so on, to raise the charge, but in comparison with the great stress applied when the developer passes through the doctor gap in the developing unit, the developer can be charged with high efficiency and greatly reduced stress.

In the third comparative example, on the other hand, the supply collection conveyance screw 232 and the stirring conveyance screw 233 perform both stirring and conveyance, and in order to reduce the size of the apparatus, a sufficient stirring conveyance distance cannot be secured. Therefore, depending on conditions, it may be impossible to charge the developer sufficiently. Accordingly, charging is typically performed by applying great stress as the developer passes through the doctor gap. Hence, the charge Q/M of the developer in the supply collection conveyance passage 236, which also serves as the stirring unit, is relatively low, but in the development area on the developing sleeve, the charge Q/M of the developer rises rapidly. More specifically, the rate of increase in the charge of the developer when the developer passes through the doctor gap reaches or exceeds 5 [μC/g].

With the constitution of the third comparative example, the developer deteriorates due to the stress that is applied when the charge Q/M is raised rapidly, and therefore the ability to charge the developer decreases over time. Accordingly, the constitution of the first example is preferable.

First Experiment

Next, the course of the developer charge over time and the image formation quality were evaluated in a running experiment using the developing apparatuses according to the first to third examples and the third comparative example. More specifically, the charge Q/M of the developer before and after the running experiment was checked, and at the same time, surface staining and toner scattering on an image produced at the end of the running experiment were evaluated.

The experiment conditions were set as follows.

Experiment apparatus: an IPSIO8000 printer manufactured by RICOH.

Photosensitive body drum diameter: ϕ30 [mm].

Photosensitive body linear velocity: 160 [mm/sec].

Developing sleeve: ϕ18 [mm].

Developing sleeve linear velocity: 240 [mm/sec].

Developing gap (gap between developing sleeve and photosensitive body drum): 0.3 [mm].

Image formation speed: 45 A4 sheets per minute.

Developer: a mixture of toner (6.8 [μm]) and carrier (35 [μm]).

Pre-running (initial stage): 10 sheets passed through apparatus after start-up.

Post-running (time elapsed): 50,000 sheets passed through apparatus.

Running mode: image area 20[%], 100 consecutive [sheets/job].

The toner charge Q/M [−μC/g] was measured by withdrawing the developing unit after passing a predetermined number of sheets therethrough, sampling the developer from the surface of the developing sleeve after passing the doctor blade, and measuring the toner charge Q/M using a V blow-off apparatus (created, developed, and manufactured by RICOH).

Figure 19:
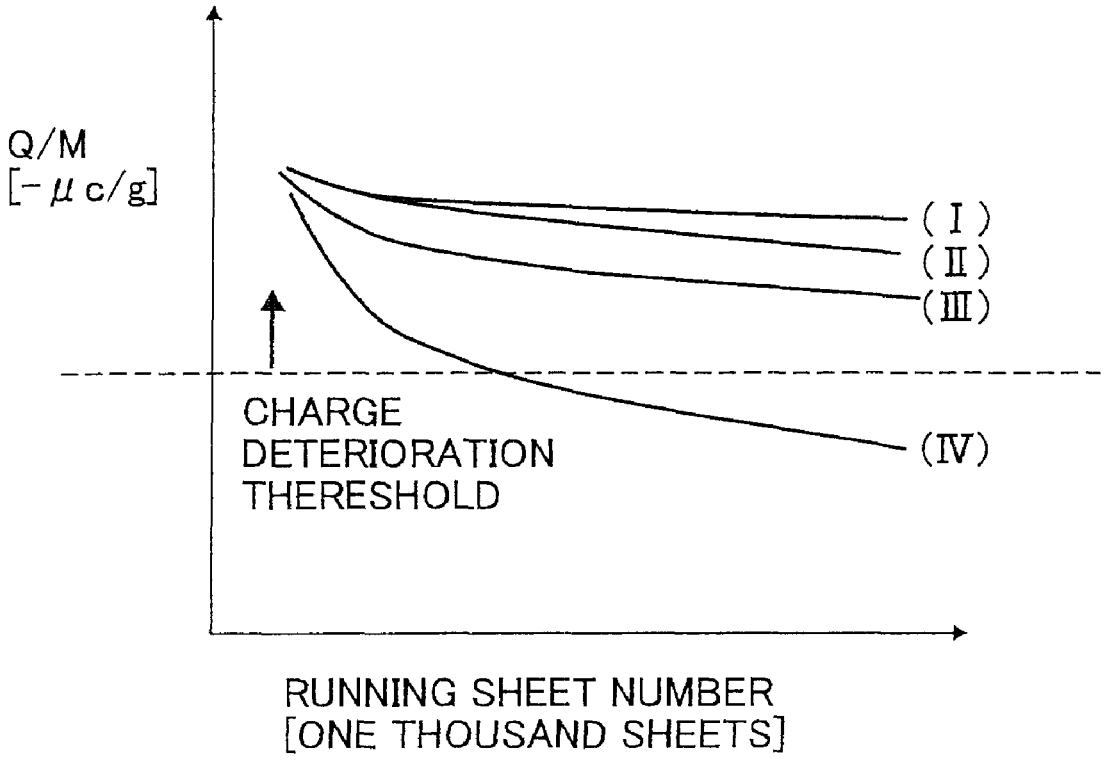
FIG. 19 is a graph showing the course of a toner charge Q/M in a first experiment of the third embodiment.

FIG. 19 shows the course of the toner charge Q/M in the first experiment. In FIG. 19, the constitution of the first example shown in FIG. 11 is indicated by (I), the constitution of the second example is indicated by (II), the constitution of the third example is indicated by (III), and the constitution of the third comparative example is indicated by (IV).

A charge deterioration threshold was set from image quality-related issues including image surface staining and toner scattering. It can be seen from the drawing that with the constitutions (I to III), the chargeability of the toner is maintained over the long term, but with the constitution (IV), the charge deteriorates to the extent that the image quality deteriorates.

An allowable image quality range is set using an image having an image quality of [CIRCLE] or [TRIANGLE] as a reference, as will be described below using FIG. 20. Accordingly, a value close to a lower limit of a developer charge for achieving levels of surface staining and toner scattering that produce a visual evaluation of [TRIANGLE] or greater is set as the threshold.

Note that in FIG. 19, the charge deterioration threshold is set at Q/M=25 [−μC/g].

The results of this experiment are shown in FIG. 20.

In FIG. 20, image surface staining was evaluated by visually observing (with a magnifying glass) the degree of toner staining in the surface portion of the transfer sheet following an output endurance test in which 50,000 sheets were passed through the apparatus continuously in a temperature 10 [° C.], humidity 15[%] environment. Evaluations of [CIRCLE], [TRIANGLE], [CROSS] were applied in descending order of preference. The [CIRCLE] evaluation denotes a favorable state in which absolutely no toner staining was observed, while the [TRIANGLE] evaluation denotes an allowable range, in which slight staining was observed but not enough to pose a problem. The [CROSS] evaluation indicates a state outside of the allowable range, in which staining was clearly observed.

Toner scattering was evaluated by visually observing the state of toner staining in the copier following an output endurance test in which 50,000 sheets were passed through the apparatus continuously in a temperature 40 [° C.], humidity 90[%] environment. The [CIRCLE] evaluation denotes a favorable state in which absolutely no toner staining was observed, while the [TRIANGLE] evaluation denotes an allowable range, in which slight staining was observed but not enough to pose a problem. The [CROSS] evaluation indicates a state outside of the allowable range, in which a large amount of staining was observed.

As is evident from the results shown in FIG. 20, with the constitutions of the first to third examples, the decrease in the charge following the passage of 50,000 sheets from the initial stage was small, and both toner scattering and image surface staining were within the allowable ranges. With the constitution of the third comparative example, on the other hand, the charge decrease following the passage of 50,000 sheets from the initial stage was large, and both toner scattering and image surface staining were outside the allowable ranges.

First Modification

In the developing apparatus 40 of the third embodiment, the second developer transfer pipe 150 for transferring the developer from the developing machine 130 to the stirrer 140 is connected to the top of the stirrer 140, and the first developer transfer pipe 120 for transferring the developer from the stirrer 140 to the developing machine 130 is connected to the bottom of the stirrer 140. Below, a first modification in which the second developer transfer pipe 150 is connected to the bottom of the stirrer 140 and the first developer transfer pipe 120 is connected to the top of the stirrer 140 such that the developer in the stirrer 140 is stirred while being conveyed from the bottom to the top of the stirrer 140 will be described.

Figure 21:
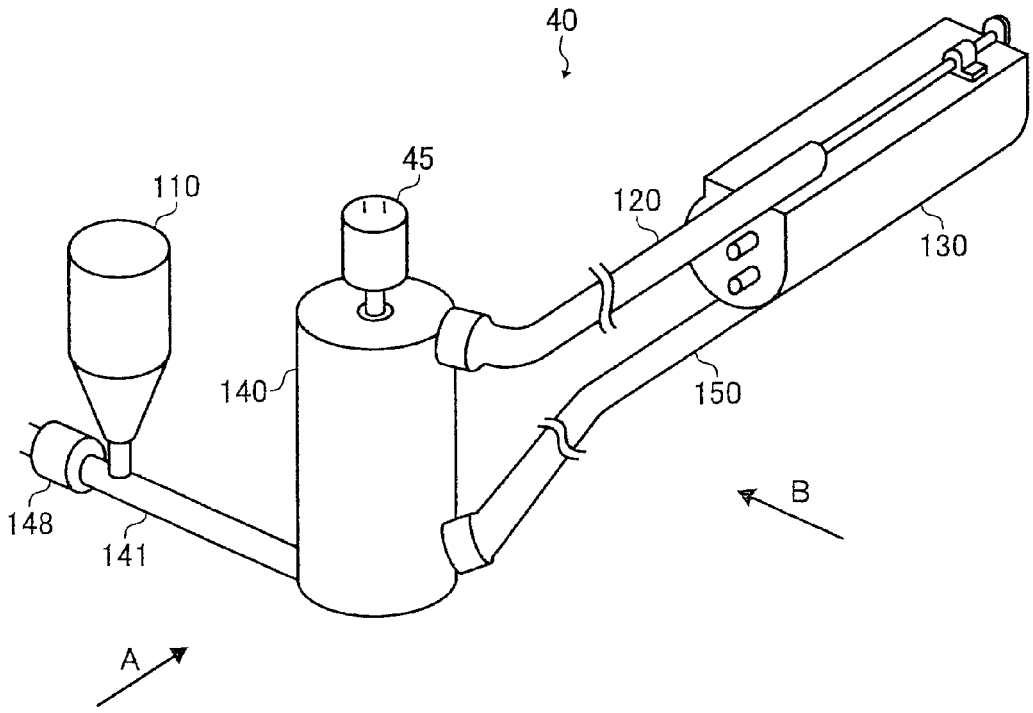
FIG. 21 is a perspective view showing the constitution of a developing apparatus according to a first modification of the third embodiment.

FIG. 21 is a perspective view illustrating the developing apparatus 40 of the first modification. The developing machine 130 of the developing apparatus 40 according to the first modification may be identical to the developing machine 130 of the developing apparatus 40 according to the third embodiment described above using FIGS. 4 and 9, and therefore a detailed description of the developing machine 130 will not be provided. In the developing apparatus 40 of the first modification, as shown in FIG. 21, the first developer transfer pipe 120 for transferring the developer from the stirrer 140 to the developing machine 130 is connected to the top of the stirrer 140. On the other hand, the second developer transfer pipe 150 for transferring the developer from the developing machine 130 to the stirrer 140 is connected to the bottom of the stirrer 140.

Figure 22:
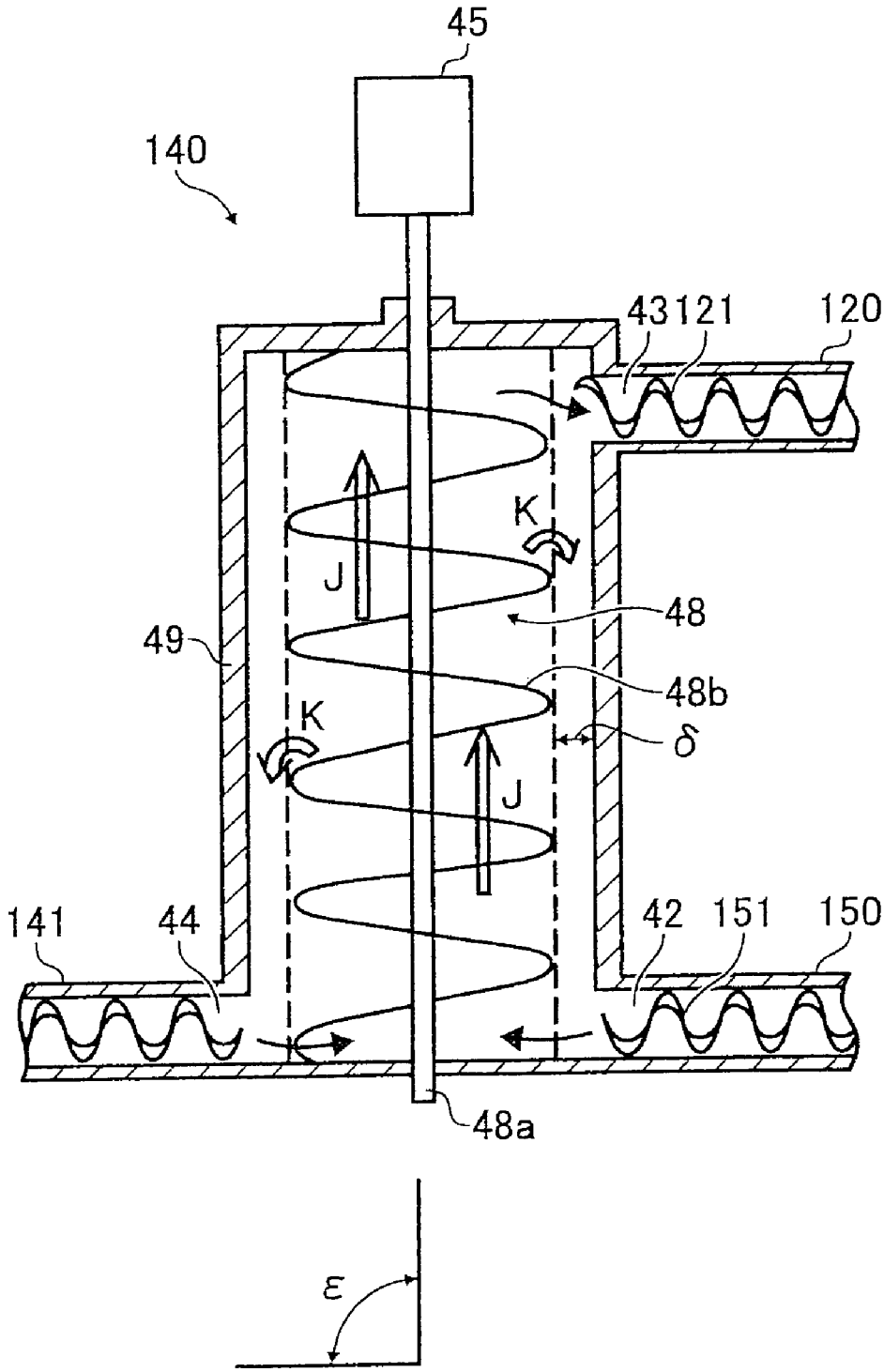
FIG. 22 is a sectional view showing the schematic constitution of a developing machine, seen from the direction of an arrow A in FIG. 21.

FIG. 22 is a schematic sectional view of the stirrer 140 of the first modification, seen from the direction of an arrow A in FIG. 21.

The stirrer 140 comprises a stirring casing 49, which is a cylindrical member storing the developer in its interior, and a stirring screw 48 serving as a screw member. The stirring screw 48 is constituted by stirring fins 48*b* and a stirring rotary shaft 48*a*, and is rotated by an externally provided stirring motor 45 in order to convey the developer in the stirring casing 49 from bottom to top while stirring the developer.

Further, as shown in FIG. 21, the developer inflow port 42, through which developer transferred from the developing machine 130 flows, is provided in the stirrer 140 at the bottom of the stirring casing 49, and the developer outflow port 43, through which the developer to be transferred toward the developing machine 130 flows, is provided in the stirrer 140 at the top of the stirring casing 49. The toner replenishment port 44, through which replenishment toner supplied from the toner container 110 flows, is also provided at the bottom of the stirring casing 49.

The developer is conveyed from the developing machine 130 to the developer inflow port 42 at the bottom of the stirrer 140 by the second developer transfer pipe 150, and flows through the developer inflow port 42 into the stirring casing 49, where it is conveyed in the upward direction (the direction of an arrow J in the drawing) by the stirring screw 48. Having reached the top of the stirring casing 49, the developer is pushed out toward the first developer transfer pipe 120 through the developer outflow port 43 and conveyed back to the developing machine 130 by the first developer transfer pipe 120.

Note that the stirring screw 48 is driven to rotate by the stirring motor 45, and therefore the rotation speed of the stirring screw 48 can be adjusted by controlling the rotation speed of the motor arbitrarily in accordance with the condition of the developer (toner concentration, deterioration condition) and external conditions (environment, usage mode).

Meanwhile, replenishment toner to be added to the developer in the stirring casing 49 is supplied to the stirring casing 49 from the toner container 110 through the toner replenishment passage 141 and the toner replenishment port 44 at the bottom of the stirrer 140. Since toner is supplied to the bottom of the stirrer 140, subsequently supplied replenishment toner is mixed with the developer while being conveyed in the upward direction so as to be stirred sufficiently, and therefore the developer containing the replenishment toner can be conveyed to the developing machine 130 after the charge of the toner has been raised sufficiently. Note that the toner concentration sensor 139 shown in FIG. 3 is provided near the developing machine lower portion opening portion 153 serving as the developer discharge port of the developing machine 130. The toner concentration sensor 139 employs a replenishment control method in which the toner concentration of the developer formed by mixing together collected developer that has passed through the development area and surplus developer is detected thereby, and the amount of replenishment toner supplied from the toner container 110 is controlled in accordance with feedback information relating to the detection result.

Next, developer circulation through the developing apparatus 40 according to the first modification will be described. The flow of developer through the developing machine 130 is partially identical to that of the first embodiment, and therefore only the differences therebetween will be described. After entering the second developer transfer pipe 150 from the developing machine 130, the developer is conveyed through the second developer transfer pipe 150, and flows into the stirrer 140 from the bottom of the stirrer 140. After the developer flows into the stirrer 140, toner replenishment and adjustment are performed, and the developer is stirred while being lifted from the bottom to the top of the stirrer 140 interior by the stirring screw 48, as will be described in detail below. Once toner replenishment and adjustment have been performed and the toner charge has been raised through stirring, the developer is supplied to the developing machine 130 through the first developer transfer pipe 120.

Next, the flow of the developer through the stirrer 140 of the first modification will be described in detail.

A conveyance force for conveying the developer in the stirrer 140 from the bottom to the top of the stirrer 140 is applied to the developer by rotating the stirring screw 48, and the developer is lifted in the upward direction thereby. The developer is then discharged to the first developer transfer pipe 120 through the developer outflow port 43 in the upper portion of the stirring casing 49 and conveyed to the developing machine 130. At this time, the flow of the developer through the interior of the stirring casing 49 includes a flow in which the developer is transferred in the upward direction using the stirring screw 48, as shown by the arrow J in the drawing, and a flow in which the developer falls under its own weight through a gap 6 between the stirring screw 48 and the inner wall of the cylindrical stirring casing 49, as shown by an arrow K in the drawing. In the developer that flows into the stirring casing 49, the flow indicated by the arrow J and the flow indicated by the arrow K are mixed together, and therefore the opportunities for stirring increase due to the upward direction movement and downward direction movement of the developer, enabling more reliable mixing. Furthermore, since the developer in the stirring casing 49 moves in this manner, the developer is charged when it rubs against the inner wall of the cylindrical stirring casing 49 and the stirring fins 48*b* of the stirring screw 48, and this is believed to contribute to stabilization of the charge of the developer that is supplied to the developing machine 130.

As regards the downward flow of developer shown by the arrow K in FIG. 22, the amount of developer flowing downward is affected by the size of the gap δ. When the gap δ is small, the amount of developer flowing downward is small in relation to the amount of developer conveyed upward by the rotation of the stirring screw 48, and hence the developer that flows into the stirrer 140 is discharged in a short period of time so that stirring cannot be performed sufficiently. Alternatively, developer may become stuck in the small area between the stirring fins and stirring casing, making bottom-to-top movement impossible. On the other hand, if the gap δ is too large, the developer may spill through the gap, making upward conveyance impossible. It is therefore important to set the gap δ at an appropriate value.

Hence, the present inventors performed an experiment on the stirrer 140 shown in FIG. 22 to adjust the value of the gap δ by modifying the conditions of the stirring screw 48, using the stirring casing 49 having a cylinder inner diameter of 14 [mm] and a height from the interior bottom surface to the developer outflow port 43 of 100 [mm]. When the stirring screw 48, in which the outer diameter of the stirring rotary shaft 48*a* is 12 [mm] and the pitch width of the stirring fins 48*b* is 15 [mm], was rotated at a rotation speed of 1,400 [rpm], and the outer diameter of the stirring fins 48*b* was within a range of 11 to 13 [mm], the flow rate through the developer outflow port 43 and the charge of the toner supplied to the developing machine 130 could both be set appropriately. In other words, it was learned that an appropriate range for the gap δ in the stirrer 140 is 0.5 to 1.5 [mm].

Similarly to the third embodiment, in the developing apparatus 40 comprising the stirrer 140 used in the experiment described above, developer having a toner particle diameter of 7 [μm], a carrier particle diameter of 35 [μm], and a toner concentration of 7[%] was used, and in a state where the developer circulated between the stirrer 140 and developing machine 130 with stability, the height from the upper surface of the developer in the stirring casing 49 to the developer outflow port 43 was approximately 10 [mm].

The angle indicated by ϵ in FIG. 22 is the angle of the stirring rotary shaft 48*a* of the stirring screw 48 relative to the horizontal plane, and in the stirrer 140 shown in FIG. 22, the angle of ϵ has a maximum value of 90 [°]. To maintain the stirring performance, the angle ϵ is preferably set at no less than 60 [°]. The stirring efficiency varies depending on the angle ϵ, and as the value thereof decreases, the stirring efficiency of the stirring screw 48 decreases. In the stirrer 140 used in the experiment described above, if the angle ϵ is smaller than 60 [°], contact between the upward developer flow J and the downward developer flow K decreases, leading to deterioration of the charging performance, and therefore the stirring efficiency deteriorates and the mixing effect produced by up-down rubbing becomes insufficient such that the desired charge cannot be obtained. It has been confirmed that when the angle becomes even smaller (in a direction approaching the horizon), a sufficient charging performance cannot be obtained.

In the developing apparatus 40 of the third embodiment, rubbing of the developer due to the great stress applied at the doctor gap can be suppressed, and therefore deterioration of the developer can be suppressed, enabling an increase in the life of the developer. In a developing apparatus using a stirrer which stirs the developer in its interior while conveying the developer from bottom to top, as in the developing apparatus 40 of the first modification, deterioration of the developer can be suppressed similarly, and therefore the life of the developer can be extended.

Note that the first auger 121 and the second auger 151 are provided as developer transfer members in the interior of the first developer transfer pipe 120 and second developer transfer pipe 150 connecting the developing machine 130 and stirrer 140. The developer transfer member is not limited to an auger, and a screw or a suction method using air or the like may be employed. When an auger or screw is used as the developer transfer member, mechanical contact, including that of the stirring screw 48 in the stirrer 140, is great throughout the entire conveyance process of the developing apparatus 40, and as a result, stress may be applied to the developer, causing the developer to deteriorate. In actuality, however, developer that is subjected to stress by the first auger 121, second auger 151, stirring screw 48, and so on can be maintained in a state of reduced deterioration for longer than developer that is subjected to stress by rubbing at a conventional doctor gap.

Figure 23:
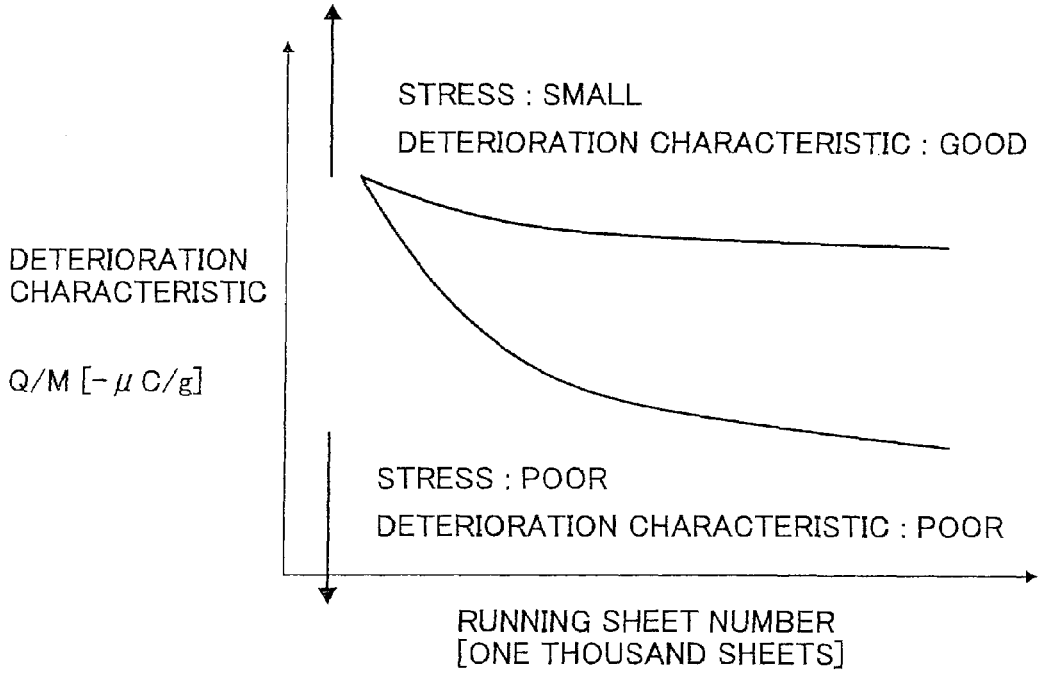
FIG. 23 is a graph showing the course of a developer deterioration characteristic Q/M in an experiment using the developing apparatus of the first modification.

FIG. 23 is a graph showing results obtained when the developer deterioration characteristic Q/M was measured after performing running under similar experiment conditions to those of the first experiment using the constitution of the first example, shown in FIG. 11, as the developing machine 130 of the developing apparatus 40 according to the first modification. The constitution of the developing apparatus 40 of the first modification, in which the constitution of the first example is applied to the developing machine 130, is indicated by (V). Note that (IV) denotes the constitution of the third comparative example.

The first experiment and the experiment whose results are shown in FIG. 23 differ in that in the first experiment, measurement is performed using the post-running developer as is, whereas in the experiment whose results are shown in FIG. 23, the developer charge of a newly-created developer containing the post-running carrier and NEW toner is measured. In the first experiment, charge measurement includes deterioration of the charge between the toner and carrier, whereas in the experiment of FIG. 23, charge measurement focuses on the charging ability of the carrier. Note that in the experiment shown in FIG. 23, the toner and carrier of the developer were separated, and measurement was performed using a magnet roll mill[f] (a small stirring apparatus).

As shown in FIG. 23, with the constitution of the first modification, the developer deterioration characteristic is maintained in a favorable state over the long term in comparison with the constitution of the third comparative example. The reason for this is that the flow of developer through the stirrer 140 per unit time in the first modification is great, and therefore stress is received in a dispersed manner (stress is alleviated). Moreover, stirring can be performed sufficiently by the stirrer 140, and therefore the constitution of the first example shown in FIG. 11 can be applied to the developing machine 130. Accordingly, the normal direction magnetic flux density on the surface of the developing sleeve in the developing machine 130 is set in the low magnetic flux density area, and therefore the stress applied to the developer is reduced greatly. On the other hand, with the constitution of the third comparative example, in which the magnetic force of the doctor pole is high and rubbing occurs at the doctor gap, great stress is applied to the developer locally in a concentrated manner when the developer is rubbed at the doctor gap, and as a result, the developer deteriorates.

Note that the developer deterioration characteristic in FIG. 23 refers to the carrier charging ability (CA) of the developer. To measure the developer deterioration characteristic, new toner is added to the carrier of developer from which the toner has been blown away at various time intervals, whereupon the resultant developer is rotated at 280 [rpm] using a magnet roll mill (created, developed, and manufactured by RICOH) for 300 [sec]. The Q/M value of the developer is then measured using the aforementioned blow-off method. The Q/M value encompasses the carrier charging ability (CA). Naturally, when stress increases, the carrier charging ability (CA) decreases.

In comparison with a conventional constitution in which great stress is applied at the doctor gap, as in the first to third comparative examples, the amount of stress generated in the entire developing apparatus 40 can be reduced with a constitution such as that of the first modification, in which the stirrer 140 for mixing and conveying the developer from bottom to top is provided such that the developer is circulated between the stirrer 140 and the developing machine 130 having the constitution described in the first to third examples.

When the developer is conveyed from bottom to top, as in the developing apparatus 40 of the first modification, the developer that is conveyed upward and the developer that falls downward under its own weight are mixed together, and therefore the developer is mixed and stirred together with replenishment toner well. As a result, a highly efficient charging effect and stable image quality can be obtained.

Further, by improving the charging efficiency of the stirrer 140, the role played by the doctor gap of a conventional developing machine in charging the developer is greatly reduced, and therefore developer deterioration caused by the high stress that is applied when the developer is rubbed during charging can be suppressed. Hence, with the developing apparatus 40 comprising the stirrer 140, in which the developer is stirred and conveyed from bottom to top using a screw, the amount of stress that is applied throughout the entire developing apparatus 40 can be reduced below that of a conventional constitution, and the life of the developer can be extended.

Second Modification

In the developing apparatus 40 of the third embodiment, developer transfer between the developing machine 130 and stirrer 140 is performed using two augers (the first auger 121 and second auger 151) serving respectively as developer transfer members. In a second modification to be described below, a developer transfer member is provided for developer transfer between the developing machine 130 and stirrer 140 in one direction only.

Figure 24:
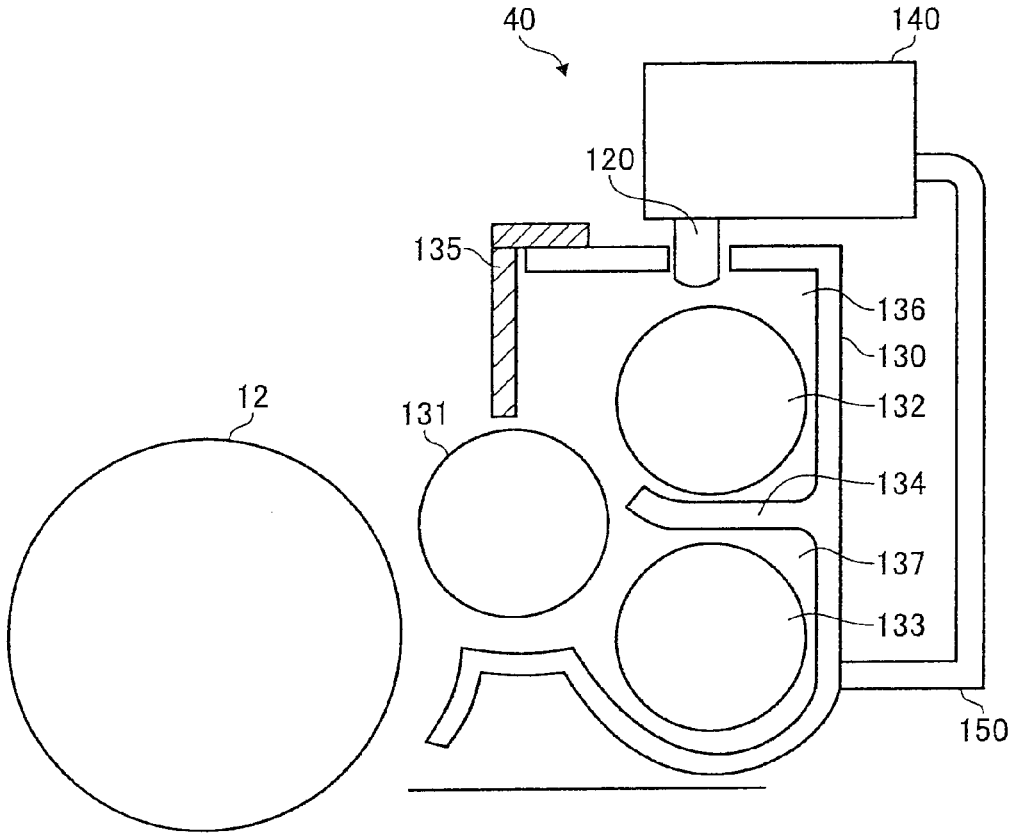
FIG. 24 is a sectional view showing the schematic constitution of a developing apparatus according to a second modification of the third embodiment.

FIG. 24 is a view showing the schematic constitution of the developing apparatus 40 according to the second modification. In the developing apparatus 40 of the second modification, the stirrer 140 is provided above the developing machine 130. The collected developer collected by the collection conveyance passage 137 passes through the second developer transfer pipe 150, and is lifted up to the stirrer 140 by a developer transfer member constituted by an auger or the like provided in the interior of the second developer transfer pipe 150. After being subjected to toner concentration adjustment and stirring in the stirrer 140, the developer passes through the first developer transfer pipe 120 under its own weight, and is transferred to the supply conveyance passage 136 of the developing machine 130. By providing the stirrer 140 above the developing machine 130 such that the developer is transferred from the stirrer 140 to the developing machine 130 under its own weight in this manner, the number of developer transfer members can be reduced. Further, since the developer falls under its own weight, the stress that is applied to the developer can be reduced below that of a case in which the developer is transferred using an auger or screw, and hence the life of the developer can be extended. Note that the stirrer 140 is not limited to a disposal position near the developing machine 130, as shown in FIG. 24, and the stirrer 140 may be disposed anywhere in the main body of the copier 100 as long as the developer can be transferred under its own weight.

When an auger or screw is used as the developer transfer member provided in the interior of the second developer transfer pipe 150, stress is applied to the collected developer during conveyance to the stirrer 140, which is disposed above the developing machine 130, and as a result of this stress, the developer may deteriorate. However, the stress that is generated by conveying the developer upward can be suppressed to a lower level than the stress that is generated by rubbing at the doctor gap when the developer is drawn onto and carried on the developing roller 131 by a powerful magnetic force. Hence, in comparison with a conventional constitution in which great stress is applied at the doctor gap, a constitution such as that of the second modification, in which the developer is lifted up to the stirrer 140 disposed in a higher position than the developing machine 130, transferred to the supply conveyance passage 136 under its own weight, and thereby supplied to the surface of the developing roller 131, is capable of reducing the stress that is applied to the developer throughout the entire developing apparatus 40.

According to the third embodiment described above, a maximum range of 0 [°] to 60 [°] in terms of the restricting member upstream side center angle α, which is the central angle of the developing roller 131 on the upstream side of the restricting member opposing position Sb opposing the doctor blade 135, which serves as a member for restricting the amount of developer on the surface of the developing roller 131, i.e. the developer carrier, in the surface motion direction of the developing roller 131, is set as the low magnetic flux density area γ, in which the maximum value G of the normal direction magnetic flux density is no more than 30 [mT]. Since the effect of normal direction magnetic force from the magnet roller 131*b* is small and the inter-carrier connection is weak, the developer is leveled to a thin layer at the doctor gap without being subjected to excessive stress. Hence, developer deterioration can be suppressed, and the life of the developer can be extended. Moreover, by suppressing developer deterioration, reductions in image quality caused by developer deterioration can be suppressed, and high image quality can be maintained over the long term.

Furthermore, by narrowing the range of the low magnetic flux density area γ, in which the maximum value G of the normal direction magnetic flux density is no more than 30 [mT], to a maximum range of 0 [°] to 20 [°] in terms of the restricting member upstream side center angle α, the developer is conveyed smoothly upon reception of the suction force of the weak magnetic force derived from the S1 pole. Moreover, since the developer is accelerated by its own weight, the developer that falls from the supply conveyance passage 136 serving as the developer supply unit is conveyed easily by conveyance force in the rotary direction of the sleeve 131*a*.

Furthermore, a range extending from the downstream side of the developer supply position Sa, in which the supply conveyance passage 136 serving as the developer supply unit supplies the developer to the surface of the developing roller 131, in the surface motion direction of the developing roller 131 to the upstream side of the restricting member opposing position Sb in the surface motion direction of the developing roller 131 is set as the low magnetic flux density area in which the maximum value G of the normal direction magnetic flux density is no more than 30 [mT]. Since the effect of normal direction magnetic force from the magnet roller 131*b* is small and the inter-carrier connection is weak, the developer is leveled to a thin layer at the doctor gap without being subjected to excessive stress. Hence, developer deterioration can be suppressed, and the life of the developer can be extended. Moreover, by suppressing developer deterioration, reductions in image quality caused by developer deterioration can be suppressed, and high image quality can be maintained over the long term.

Further, by reducing the maximum value G of the normal direction magnetic flux density in the low magnetic flux density area γ to 5 [mT] or less, the stress applied during passage through the doctor gap can be reduced even further, enabling a further extension to the life of the developer.

Further, by reducing the normal direction magnetic flux density in the low magnetic flux density area γ to 0 [mT] and conveying the developer simply by frictional force generated by the weight of the developer in relation to the surface of the developing roller 131, the stress applied during passage through the doctor gap can be reduced even further, enabling a further extension to the life of the developer.

Further, a range of at least 0 [°] to 60 [°] in terms of the restricting member upstream side center angle α is set as the low magnetic flux density area γ, in which no magnetic poles serving as magnetic field generating means are disposed on the inside of the sleeve 131*a* serving as a non-magnetic developing sleeve. Since the effect of normal direction magnetic force from the magnet roller 131*b* is small and the inter-carrier connection is weak, the developer is leveled to a thin layer at the doctor gap without being subjected to excessive stress. Hence, developer deterioration can be suppressed, and the life of the developer can be extended. Moreover, by suppressing developer deterioration, reductions in image quality caused by developer deterioration can be suppressed, and high image quality can be maintained over the long term.

Further, a range extending from the downstream side of the developer supply position Sa in the surface motion direction of the developing roller 131 to the upstream side of the restricting member opposing position Sb in the surface motion direction of the developing roller 131 is set as the low magnetic flux density area γ in which no magnetic poles are disposed on the inside of the sleeve 131*a*. Since the effect of normal direction magnetic force from the magnet roller 131*b* is small and the inter-carrier connection is weak, the developer is leveled to a thin layer at the doctor gap without being subjected to excessive stress. Hence, developer deterioration can be suppressed, and the life of the developer can be extended. Moreover, by suppressing developer deterioration, reductions in image quality caused by developer deterioration can be suppressed, and high image quality can be maintained over the long term.

Further, the doctor blade 135 opposes the surface of the developing roller 131 above the developing roller center point 131P, i.e. the rotary center of the sleeve 131*a*, in the vertical direction. In this position, frictional force generated between the developer and the developing roller 131 surface by the weight of the developer assists in carrying the developer on the surface of the developing roller 131, and therefore the magnetic force required to carry and convey the developer can be reduced.

Further, the developer supply position Sa opposite the partition wall end portion 134*a*, in which the supply conveyance passage 136 serving as the developer supply unit supplies the developer to the surface of the developing roller 131, is above the developing roller center point in the vertical direction. In this position, frictional force generated between the developer and the developing roller 131 surface by the weight of the developer assists in carrying the developer on the surface of the developing roller 131, and therefore the magnetic force required to carry and convey the developer supplied from the supply conveyance passage 136 can be reduced. As a result, the occurrence of image quality defects (an uneven image, for example) due to failure to draw up the developer can be suppressed.

Further, by setting the developer supply position Sa within the low magnetic flux density area γ, the developer supplied to the surface of the developing roller 131 receives substantially no magnetic force effect, and is carried to the doctor gap by frictional force generated between itself and the developing roller 131 surface by its own weight. As a result, the amount of stress applied at the doctor gap can be reduced.

Further, by providing the collection conveyance passage 137 as a developer collecting unit for collecting the developer after the developer passes through the development area on the surface of the developing roller 131, developer having a reduced toner concentration can be prevented from being reused for development, and stable image quality can be maintained.

Further, by providing the stirrer 140, which is capable of sending and receiving the developer to and from the developing machine 130 and comprises the agitator 41 serving as stirring means that are capable of charging the developer more reliably than a conventional developing apparatus, toner scattering and surface staining can be suppressed even when the developer is not charged at the doctor gap.

Further, by providing the developing machine 130 serving as the developing unit and the stirrer 140 serving as the stirring unit separately, and connecting the developing machine 130 and stirrer 140 using the first developer transfer pipe 120 and second developer transfer pipe 150, which serve as two developer transfer pipes, or in other words developer transfer passage-forming members, the stirring unit can be provided at a remove from the developing unit, whereby the space for providing the developing unit can be made smaller than that of a developing apparatus in which the developing unit and stirring unit are formed integrally. As a result, the layout freedom of the entire image forming apparatus can be increased, and the size of the apparatus main body can be reduced. Moreover, by disposing the stirrer 140 in a position where it is unlikely to be affected by temperature and the outside air, deterioration and alteration of the developer in the stirrer 140 due to the effects of temperature and the outside air can be suppressed.

Further, at least half of the developer in the developing apparatus 40, more specifically between 50[%] and 80[%] of all of the developer, is stored in the stirrer 140. Hence, the required developer stirring time can be secured, and the toner charge can be raised more reliably. As a result, toner scattering can be suppressed more reliably.

Further, the stirrer 140 comprises the toner replenishment passage 141 serving as toner replenishing means for replenishing the developer in the developing apparatus 40 with the toner in the toner container 110. Thus, developer provided with replenishment toner is conveyed to the developing machine 130 after undergoing the stirring process in the stirrer 140, and therefore, even if the replenishment toner is uncharged and unused, it can be transferred to the developing machine 130 after being charged to a suitable charge for development. As a result, a situation in which uncharged, unused toner becomes charge-deficient toner and is supplied thus to the developing roller 131 such that toner scattering occurs can be suppressed.

Further, in the developing apparatus 40, the developing machine 130 comprises the collection conveyance passage 137 serving as a developer collecting unit for collecting the developer after the developer has been supplied to the developing roller 131 and has passed through the development area, and the collected developer collected by the collection conveyance passage 137 is transferred to the stirrer 140 by the second developer transfer pipe 150. During stirring by the stirrer 140, the collected developer is stirred together with unused toner such that the reduced toner concentration is adjusted, whereupon developer having a suitable toner concentration for development is transferred to the developing machine 130. Thus, image defects caused by variation in the toner concentration of the developer can be suppressed.

Further, the blade-form doctor blade 135 is used as the developer amount restricting member, and therefore the developer on the surface of the developing roller 131 can be restricted to a suitable amount for development using a simple constitution.

Furthermore, a roller-shaped doctor roller 135R may be used as the developer amount restricting member so that the stress applied to the developer at the doctor gap can be reduced while restricting the amount of developer on the surface of the developing roller 131 to a suitable amount for development.

Furthermore, the copier 100 serving as the image forming apparatus comprises the developing apparatus 40 as developing means, and therefore the life of the developer can be extended. Moreover, deterioration of the developer can be suppressed, and therefore reductions in image quality caused by deterioration of the developer can be suppressed, and a high image quality can be maintained over the long term.

Fourth Embodiment

In the third embodiment described above, the developing apparatus 40 in which the developing unit and stirring unit are provided separately was described, but a developing apparatus in which the developing unit and stirring unit are formed integrally may be used as a developing apparatus for preventing toner scattering caused by charge-deficient toner. Below, a developing apparatus in which the developing unit and stirring unit are formed integrally will be described as a fourth embodiment.

Figure 25:
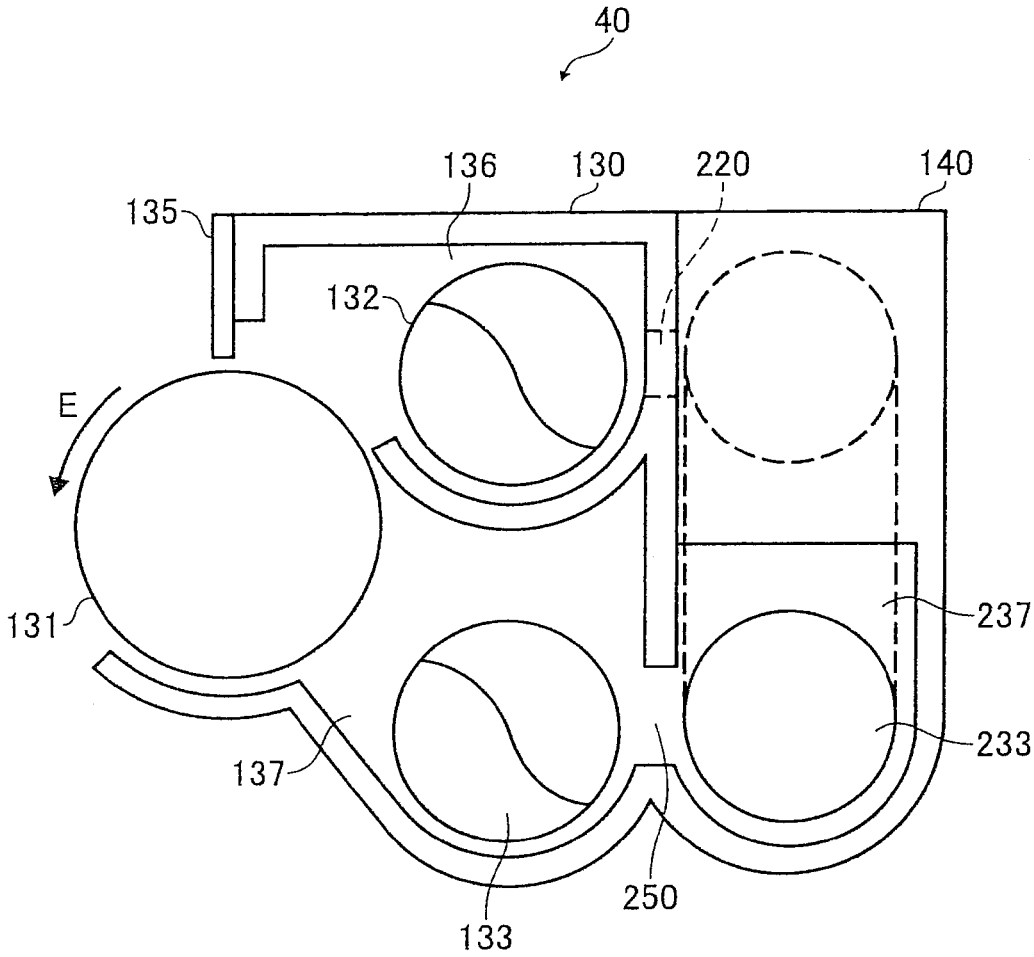
FIG. 25 is a view showing the schematic constitution of a developing apparatus according to a fourth embodiment of the present invention.

FIG. 25 is a view showing the schematic constitution of the developing apparatus 40 according to the fourth embodiment. In the developing apparatus 40 of the third embodiment, the stirrer 140 and developing machine 130 are provided separately, but the developing apparatus 40 of the second embodiment differs from the developing apparatus 40 of the third embodiment in that the stirrer 140 is provided integrally with the developing machine 130. All other constitutions are shared with the third embodiment, and therefore only the differences between the two embodiments will be described here.

As shown in FIG. 25, the stirrer 140 in the developing apparatus 40 of the fourth embodiment is formed integrally with the developing machine 130 by the stirring conveyance passage 237, which comprises the stirring conveyance screw 233 serving as the developer stirring means. A conveyance direction downstream side end portion of the stirring conveyance screw 233 in the stirring conveyance passage 237 is connected to a conveyance direction upstream side end portion of the supply conveyance passage 136 by a first transfer opening portion 220. Meanwhile, a conveyance direction upstream side end portion of the stirring conveyance screw 233 in the stirring conveyance passage 237 is connected to a conveyance direction downstream side end portion of the collection conveyance passage 137 by a second transfer opening portion 250.

In contrast to the supply conveyance passage 136 and collection conveyance passage 137 for conveying the developer in a substantially horizontal direction, the stirring conveyance passage 237 conveys the developer diagonally upward from the collection conveyance passage 137 provided at the bottom to the supply conveyance passage 136 provided at the top.

Further, charging is not performed at the doctor gap, i.e. the gap between the doctor blade 135 and the developing roller 131, and therefore the developer must be stirred sufficiently in the stirrer 140 to raise the toner charge to a suitable state for development.

In the developing apparatus shown in FIG. 25, a long stirring time must be secured to raise the toner charge to a state suitable for development.

In the stirring conveyance passage 237, the developer is conveyed diagonally upward, and therefore, if the stirring conveyance screw 233 has the same shape and is rotated at the same speed as the supply conveyance screw 132, the conveyance speed slows such that the developer is held in the stirrer 140 for a longer time than the developing machine 130. To extend the length of time the developer is held in the stirrer 140, a longer stirring time must be secured.

To secure the required stirring time, the stirring conveyance screw 233 formed to have poor conveyance ability is preferably used.

Figure 26:
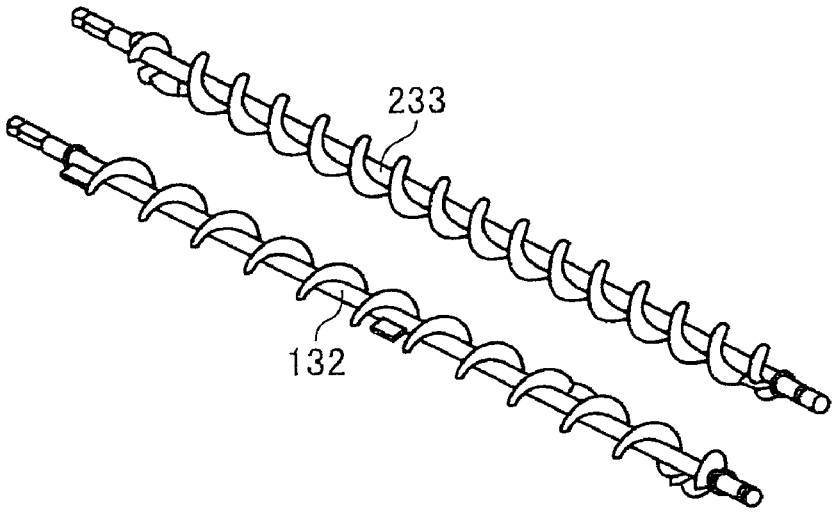
FIG. 26 is a perspective view showing a first example of a stirring conveyance screw formed to have poor conveyance ability.

FIG. 26 is a perspective view showing a first example of the stirring conveyance screw 233 formed to have poor conveyance ability and a comparison thereof with the supply conveyance screw 132. As shown in FIG. 26, in the stirring conveyance screw 233, the screw pitch width of a vane portion coiled around a shaft portion is made narrower than the screw pitch width of the vane portion of the supply conveyance screw 132. When the screw pitch width of a conveyance screw is narrowed, the distance traveled by the developer during a single revolution of the conveyance screw is short. Hence, when the stirring conveyance screw 233 and the supply conveyance screw 132 rotate at the same speed, the conveyance speed of the stirring conveyance screw 233 is lower than the conveyance speed of the supply conveyance screw 132.

Hence, a longer stirring time can be secured, and therefore developer having a stable toner charge can be transferred to the supply conveyance passage 136. As a result, toner scattering and surface staining can be suppressed.

Figure 27:
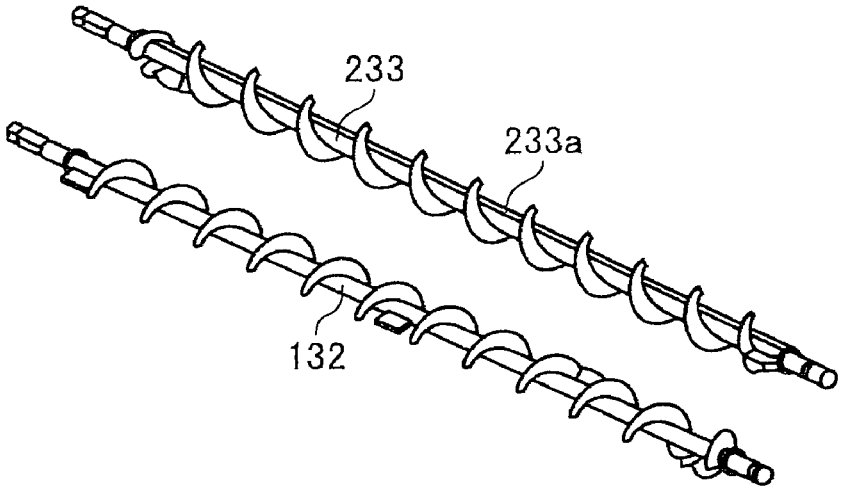
FIG. 27 is a perspective view showing a second example of a stirring conveyance screw formed to have poor conveyance ability.

FIG. 27 is a perspective view showing a second example of the stirring conveyance screw 233 formed to have poor conveyance ability and a comparison thereof with the supply conveyance screw 132. As shown in FIG. 27, a rib 233*a* serving as a plate-form member is provided on the stirring conveyance screw 233 parallel to the axial direction of the shaft portion thereof. By providing the stirring conveyance screw 233 with the rib 233*a*, a force moving in the rotation direction is applied by the rib to the developer that is pushed by the vane portion as the stirring conveyance screw 233 rotates and thereby moved in the axial direction, and as a result of this force, the conveyance efficiency in the axial direction decreases. Hence, when the stirring conveyance screw 233 and the supply conveyance screw 132 rotate at the same speed, the conveyance speed of the stirring conveyance screw 233 is lower than the conveyance speed of the supply conveyance screw 132. Moreover, a force moving in the rotation direction is applied by the rib, and therefore the stirring performance improves.

Hence, a longer stirring time can be secured and the stirring performance can be improved. Therefore, developer having a stable toner charge can be transferred to the supply conveyance passage 136, and as a result, toner scattering and surface staining can be suppressed.

Note that when the conveyance speed of the conveyance passage 237 alone is reduced, it becomes impossible to respond to high speeds, and therefore the stirring conveyance passage 237 is formed with a larger volume than the supply conveyance passage 136 and collection conveyance passage 137. In so doing, substantially all of the developer in the developing apparatus 40 can be stored in the stirring conveyance passage 237, and hence a longer developer stirring time can be secured.

Further, toner replenishing means, not shown in the drawing, supply unused replenishment toner to the conveyance direction downstream side end portion of the collection conveyance passage 137 or the conveyance direction upstream side end portion of the stirring conveyance passage 237, near the second transfer opening portion 250. Thus, the uncharged, unused toner can be stirred reliably such that toner scattering and surface staining caused when unused toner becomes charge-deficient toner can be suppressed.

Further, as shown in FIG. 25, by providing the stirrer 140 and developing machine 130 integrally, the developing apparatus 40 can be removed from the main body of the copier 100 serving as the image forming apparatus easily, and therefore maintenance can be performed easily.

Third Modification

In the third and fourth embodiments, a blade-form doctor blade is used as the developer amount restricting member. In the developing apparatuses 40 of these embodiments, stirring is performed sufficiently by the stirrer 140 so that there is no need to apply great stress at the doctor gap, and therefore the developer amount restricting member is not limited to a blade.

Figure 28:
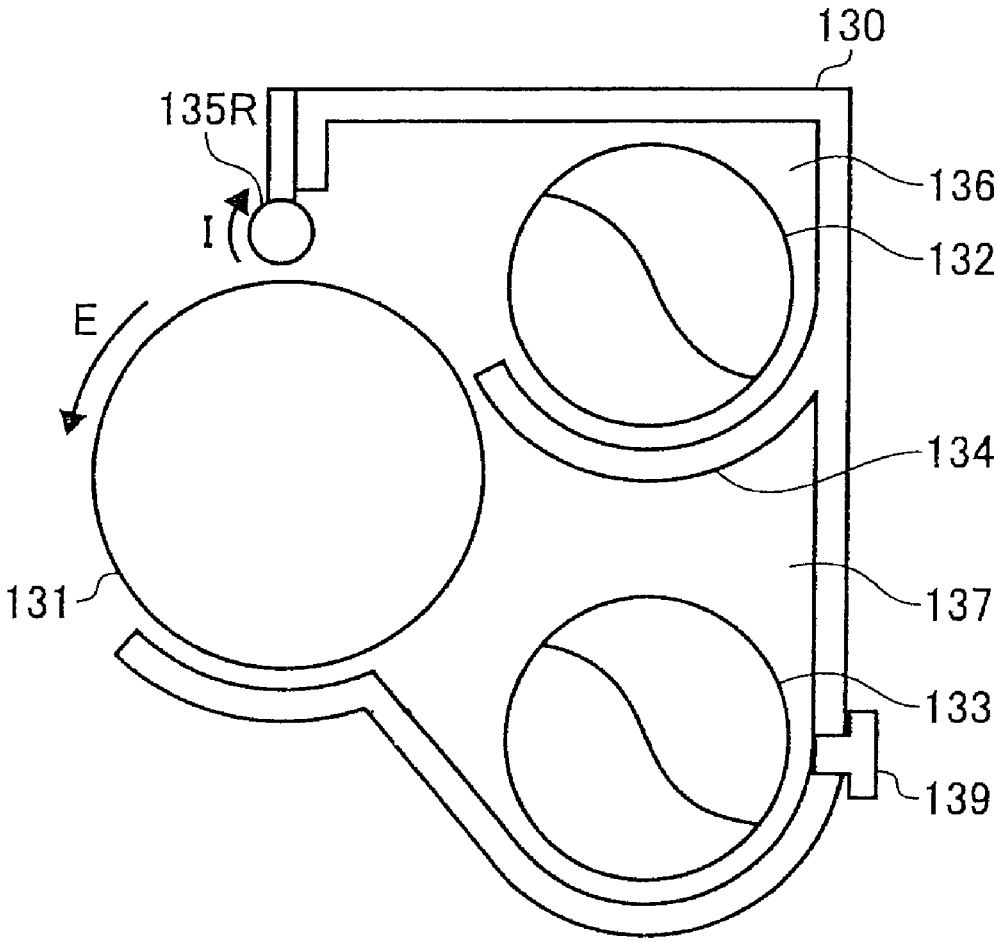
FIG. 28 is a view showing the schematic constitution of a developing machine serving as a third modification in the fourth embodiment.

FIG. 28 is a view showing the schematic constitution of the developing machine 130 serving as the developing unit according to the third modification. As shown in FIG. 28, in the developing machine 130 of the third modification, a roller-shaped doctor roller 135R, which is rotated in conjunction with the surface movement of the developing roller 131 in the direction of an arrow E in the drawing and is capable of rotating in the direction of an arrow I in the drawing, is provided as the developer amount restricting member.

When the roller-shaped doctor roller 135R is used as the developer amount restricting member, a further reduction in the amount of stress applied at the doctor gap can be achieved, and hence the life of the developer can be extended even further.

According to the developing apparatus 40 of the fourth embodiment, the developing machine 130 and the stirrer 140 are structured integrally, and therefore the developing apparatus 40 can be removed easily from the main body of the copier 100 serving as the image forming apparatus. Hence, maintenance can be performed easily.

Various modifications will be possible for those skilled in the art after receiving the teachings of the present disclosure, without departing from the scope thereof.

The invention claimed is:

1. A developing apparatus comprising:

a developing unit including a developer carrier that rotates while carrying, on a surface thereof, a two-component developer constituted by a magnetic carrier and a toner, the developer carrier performing development in a location opposing a latent image carrier by supplying the toner to a latent image on a surface of the latent image carrier, and a developer supply unit that supplies the two-component developer to the developer carrier; and a partitioning member that partitions a space into a supply conveyance passage and a collection conveyance passage, the space storing the developer;

a restricting member opposing the developer carrier at a restricting member opposing position that restricts an amount of developer on the surface of the developer carrier;

a stirring unit including stirring device which stirs the two-component developer, the stirring unit sending and receiving the two-component developer to and from the developing unit, respectively, wherein, when a development operation, in which the toner is supplied to the latent image on the surface of the latent image carrier from the developer carrier, is complete, the two-component developer in the developing unit is transferred to a developer storage unit outside the developing unit, and wherein an area of the developer carrier defined by a restricting member upstream side central angle is a low magnetic flux density area, the restricting member upstream side central angle being no more than 60°, having a vertex at a rotary center of the developer carrier, and extending between the restricting member opposing position and a position of an end portion of the partitioning member located on an upstream side of the restricting member.

2. The developing apparatus as claimed in claim 1, wherein an area of the developer carrier opposing the partitioning member is located between a peak position of a normal direction magnetic flux density on a magnetic pole disposed on an upstream side of the developer carrier in a surface motion direction of the developer carrier and a peak position of a normal direction magnetic flux density on a magnetic pole disposed on a downstream side of the developer carrier in the surface motion direction of the developer carrier, and wherein the normal direction magnetic flux density on the magnetic pole disposed on the downstream side is not more than 5 mT.

3. The developing apparatus as claimed in claim 2, wherein a location of the normal direction magnetic flux density on the magnetic pole disposed on the downstream side is located at a surface position of the developer carrier opposing the developer amount restricting member.

4. A developing apparatus comprising:

a developing unit including a developer carrier that performs a surface motion while carrying, on a surface thereof, a two-component developer constituted by a magnetic carrier and a toner, the developer carrier performing development in a development area opposing a latent image carrier by supplying the toner to a latent image on a surface of the latent image carrier, a developer supply unit including a supply conveyance screw that supplies the two-component developer to the surface of the developer carrier, a developer amount restricting member opposing the surface of the developer carrier, the developer amount restricting member restricting a layer thickness of the two-component developer that is supplied to the surface of the developer carrier by the developer supply unit and conveyed to the development area, a partitioning member that partitions a space into a supply conveyance passage and a collection conveyance passage, the space storing the developer, a collection conveyance screw that collects the developer from the developer carrier, and a stirring conveyance screw that stirs the developer, wherein magnetic poles of a same polarity are arranged side by side within the developer carrier, wherein an area of the developer carrier opposing the partitioning member is located between a peak position of a normal direction magnetic flux density on a magnetic pole disposed on an upstream side of the developer carrier in a surface motion direction of the developer carrier and a peak position of a normal direction magnetic flux density on a magnetic pole disposed on a downstream side of the developer carrier in the surface motion direction of the developer carrier, and wherein the normal direction magnetic flux density on the magnetic pole disposed on the downstream side is not more than 30 mT.

5. The developing apparatus as claimed in claim 4, wherein an end portion of the partitioning member is slanted toward the surface of the developer carrier.

6. The developing apparatus as claimed in claim 4, further comprising a passage through which the developer is discharged to an outside of the developing apparatus.

7. The developing apparatus as claimed in claim 4, wherein the developer carrier includes a sleeve, and wherein no magnetic poles are disposed within a low magnetic flux density area on an inner side of the sleeve.

8. The developing apparatus as claimed in claim 4, wherein a location of the normal direction magnetic flux density on the magnetic pole disposed on the downstream side is located at a surface position of the developer carrier opposing the developer amount restricting member.

9. The developing apparatus as claimed in claim 8, wherein the normal direction magnetic flux density on the magnetic pole disposed on the downstream side at the surface position of the developer carrier opposing the developer amount restricting member is not more than 5 mT.

10. An image forming apparatus comprising:

a developing apparatus including a developing unit including a developer carrier that performs a surface motion while carrying, on a surface thereof, a two-component developer constituted by a magnetic carrier and a toner, the developing carrier performing development in a development area opposing a latent image carrier by supplying the toner to a latent image on a surface of the latent image carrier;

a developer supply unit including a supply conveyance screw that supplies the developer to the surface of the developer carrier;

a developer amount restricting member opposing the surface of the developer carrier, the developer amount restricting member restricting a layer thickness of the two-component developer that is supplied to the surface of the developer carrier by the developer supply unit and conveyed to the development area;

a partitioning member that partitions a space into a supply conveyance passage and a collection conveyance passage, the space storing the developer;

a collection conveyance screw that collects the developer from the developer carrier; and a stirring conveyance screw that stirs the developer, wherein magnetic poles of a same polarity are arranged side by side within the developer carrier, wherein an area of the developer carrier opposing the partitioning member is located between a peak position of a normal direction magnetic flux density on a magnetic pole disposed on an upstream side of the developer carrier in a surface motion direction of the developer carrier and a peak position of a normal direction magnetic flux density on a magnetic pole disposed on a downstream side of the developer carrier in the surface motion direction of the developer carrier, and wherein the normal direction magnetic flux density on the magnetic pole disposed on the downstream side is not more than 30 mT.

11. The developing apparatus as claimed in claim 10, wherein the developer carrier includes a sleeve, and wherein no magnetic poles are disposed within a low magnetic flux density area on an inner side of the sleeve.

12. The developing apparatus as claimed in claim 10, wherein a location of the normal direction magnetic flux density on the magnetic pole disposed on the downstream side is located at a surface position of the developer carrier opposing the developer amount restricting member.

13. The developing apparatus as claimed in claim 12, wherein the normal direction magnetic flux density on the magnetic pole disposed on the downstream side at the surface position of the developer carrier opposing the developer amount restricting member is not more than 5 mT.

14. A developing apparatus comprising:

a developing unit including a developer carrier that performs a surface motion while carrying, on a surface thereof, a two-component developer constituted by a magnetic carrier and a toner, the developer carrier performing development in a development area opposing a latent image carrier by supplying the toner to a latent image on a surface of the latent image carrier, a developer supply unit including a supply conveyance screw that supplies the two-component developer to the surface of the developer carrier, a developer amount restricting member opposing the surface of the developer carrier, the developer amount restricting member restricting a layer thickness of the two-component developer that is supplied to the surface of the developer carrier by the developer supply unit and conveyed to the development area, a partitioning member that partitions a space into a supply conveyance passage and a collection conveyance passage, the space storing the developer, a collection conveyance screw that collects the developer from the developer carrier, and a stirring conveyance screw that stirs the developer, and a passage through which the developer is discharged to an outside of the developing apparatus, wherein magnetic poles of a same polarity are arranged side by side within the developer carrier, wherein an area of the developer carrier opposing the partitioning member is located between a peak position of a normal direction magnetic flux density on a magnetic pole disposed on an upstream side of the developer carrier in a surface motion direction of the developer carrier and a peak position of a normal direction magnetic flux density on a magnetic pole disposed on a downstream side of the developer carrier in the surface motion direction of the developer carrier, wherein the normal direction magnetic flux density on the magnetic pole disposed on the downstream side is not more than 30 mT, and wherein an end portion of the partitioning member is slanted toward the surface of the developer carrier.

* * * * *